US010316509B2

(12) United States Patent
Jackson et al.

(10) Patent No.: US 10,316,509 B2
(45) Date of Patent: Jun. 11, 2019

(54) POST AND BEAM SYSTEM

(71) Applicant: Revamp Panels, LLC, Spokane, WA (US)

(72) Inventors: Sheldon Grant Jackson, Spokane, WA (US); Damian Matthew Brandon Cronkhite, Spokane, WA (US); Duncan Jackson, Spokane, WA (US); Shawn McCartney, Spokane, WA (US)

(73) Assignee: Revamp Panels, LLC, Spokane, WA (US)

( * ) Notice: Subject to any disclaimer, the term of this patent is extended or adjusted under 35 U.S.C. 154(b) by 0 days.

(21) Appl. No.: 15/943,510

(22) Filed: Apr. 2, 2018

(65) Prior Publication Data

US 2018/0291613 A1 Oct. 11, 2018

Related U.S. Application Data

(60) Provisional application No. 62/480,919, filed on Apr. 3, 2017.

(51) Int. Cl.

| | |
|---|---|
| ***E04B 1/24*** | (2006.01) |
| ***E04B 1/343*** | (2006.01) |
| ***E04H 6/02*** | (2006.01) |
| *E04B 1/58* | (2006.01) |

(52) U.S. Cl.

CPC ..... *E04B 1/2403* (2013.01); *E04B 1/34326* (2013.01); *E04H 6/025* (2013.01); *E04B 1/5806* (2013.01); *E04B 2001/2406* (2013.01); *E04B 2001/2445* (2013.01); *E04B 2001/2457* (2013.01); *E04B 2001/2469* (2013.01)

(58) Field of Classification Search

CPC .. E04B 1/2403; E04B 1/34326; E04B 1/5806; E04B 2001/2445; E04B 2001/2406; E04B 2001/2457; E04B 2001/2469; E04H 6/025

USPC ..... 52/646, 650.1, 653.1, 846, 848

See application file for complete search history.

(56) References Cited

U.S. PATENT DOCUMENTS 1,144,288 A * 6/1915 Bente ..... E04H 17/10 256/57
1,917,764 A * 7/1933 Alexander ..... A47B 47/027 220/4.01
3,127,961 A * 4/1964 Frazier ..... A47B 96/1408 52/633
3,284,971 A * 11/1966 Attwood ..... A47B 96/1408 52/100
3,353,854 A * 11/1967 Hansen ..... E04B 1/5818 403/171
3,769,772 A * 11/1973 Oetiker ..... A47C 17/64 52/646
4,261,470 A * 4/1981 Dolan ..... F16B 12/36 108/55.1

(Continued)

*Primary Examiner* — Brent W Herring
(74) *Attorney, Agent, or Firm* — Lee & Hayes, P.C.

(57) ABSTRACT

A framing system for constructing at least a portion of a building. The framing system comprising beams, cross beams, corner posts, and inline posts. The beams including flanges and a wall arranged between the flanges. The cross beams including a flange and a wall attached to the flange. The corner posts including walls and flanges. The inline posts including flanges and a wall arranged between the flanges. The flanges include slots and the walls include open areas. Panels may attach to the slots. Decorative patterns may be integrally formed in the open areas.

15 Claims, 118 Drawing Sheets

(56) References Cited

U.S. PATENT DOCUMENTS

| | | | | | |
|---|---|---|---|---|---|
| 4,317,523 | A * | 3/1982 | Konstant | A47B 57/402 | 108/107 |
| 5,050,358 | A * | 9/1991 | Vladislavic | E04B 1/161 | 52/250 |
| 5,289,665 | A * | 3/1994 | Higgins | E04B 1/2403 | 211/191 |
| 5,542,227 | A * | 8/1996 | Frayne | E04C 3/07 | 403/363 |
| 7,364,243 | B2 * | 4/2008 | Wyatt | H02B 1/30 | 211/182 |
| 8,695,310 | B2 * | 4/2014 | Tremblay | E04B 1/24 | 52/483.1 |
| 9,441,372 | B2 * | 9/2016 | Swenters | E04C 3/08 | |
| 10,047,513 | B2 * | 8/2018 | Yang | E04B 1/2403 | |
| 2009/0013639 | A1 * | 1/2009 | Tremblay | E04B 1/24 | 52/745.13 |
| 2009/0249743 | A1 * | 10/2009 | Bodnar | E04C 3/09 | 52/846 |
| 2012/0266562 | A1 * | 10/2012 | Woolf | E04C 3/07 | 52/846 |
| 2015/0101280 | A1 * | 4/2015 | Woolf | E04C 3/07 | 52/846 |
| 2015/0313357 | A1 * | 11/2015 | David | A47B 47/0083 | 211/187 |
| 2015/0315787 | A1 * | 11/2015 | Swenters | E04C 3/08 | 52/633 |
| 2016/0160515 | A1 * | 6/2016 | Wallance | E04B 1/3483 | 52/79.1 |
| 2018/0030717 | A1 * | 2/2018 | Yang | E04B 1/2403 | |

* cited by examiner

POST AND BEAM SYSTEM

BACKGROUND

Typical construction requires materials such as structural I-beams or wood studs. Problems exist with both materials since wood is susceptible to rot or insects and may not support the required load, while steel I-beams are excessively heavy and only have the single configuration. In addition, neither material has inherent aesthetics qualities without additional cost to cover the material. As such, there remains a demand for a structural material that is structurally sound, provides configuration flexibility, and provides aesthetic qualities.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
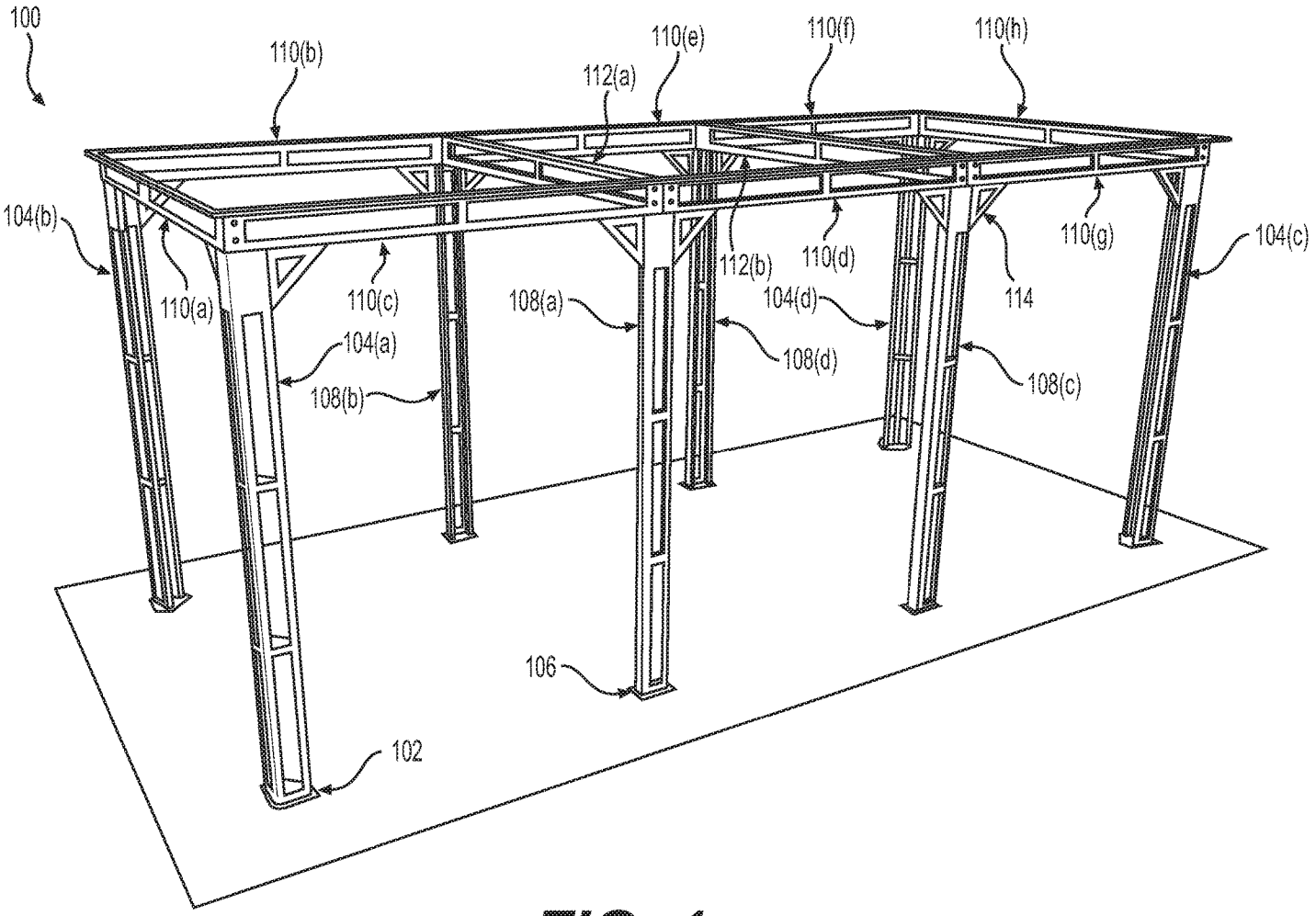
FIG. 1 depicts an example configuration of the post and beam system.

This disclosure describes a beam and post system that may provide a structurally sound building frame assembly. In some examples, the beam and post system may be constructed to create a canopy, an entry structure, an arbor, a sunshade, a pergola, a trellis, or an awning. The disclosure describes that the beam and post system may comprise several uniquely designed elements or components that are attached to one another to create the frame assembly. In some examples, the beam and post system may be able to withstand a load that meets or exceeds the load that typical frames constructed of wood and/or steel I-beams are able to withstand.

The components of the beam and post system may also be configured to allow another item to attach to the frame. For instance, the beams and post may include a slot (vertical and/or horizontal) configured to allow a panel (metal, wood, etc.) to securely attach. In other examples, the system may allow for a plant hanger, light hanger, cable lights, speaker hangers, television hanger, shelfing, rack units (e.g., pot/pan packs), a t-bar system, exercise equipment, irrigation systems (e.g., mist system and/or drip systems), plant support systems, doors, sunshade (i.e., metal or cloth), tables, signs, banners, wind stops/breaks, bungee systems, bird feeders, and/or other brackets (hinge bracket, or slide brackets).

In some instances, the beam and post system may allow for attachment of roofing (structure and other material). For instance, the system can accommodate a shed, a gable, a flat, a cloth, and an open roof design.

In some examples, the post and beam system may include corner posts, inline posts, post top caps (both corner and inline), beams (straight end, single-miter, double-miter), knee bracing to support the attachment of the posts and beams, support gussets (both corner and inline), base plates (both corner and inline). In some examples, each component of the post and beam system may be comprised of at least ¼-inch steel. In other examples, each component of the post and beam system may be comprised of at least ⅜ to about ¾-inch steel. In some examples, each component of the system comprises the same thickness. However, in other examples, the components of the system may comprise varying thicknesses.

The beams and posts of the system may be constructed with standard sizing. For instance, the beams and post may be constructed at eight (8) feet, ten (10) feet, and/or twelve (12) feet. However, in other examples, the beams and posts can be constructed from at least two (2) feet to about fourteen (14) feet.

In some examples, each component of the system may be coated (e.g. painted, power-coated, etc.) to protect and resist weathering. As such, each component may have any possible color as requested by a user. In some examples, each component may be composed of Corten® or other weathering steel. Weathering steel may allow each component to patina naturally to establish a protective coating over the surface without an additional coating finish (e.g. paint, powder-coat, etc)

Example Configuration of the Post and Beam System

FIG. 1 depicts an example configuration of sample components of the post and beam system. As shown in FIG. 1, the components of the beam and post system are attached to one another to create a pergola structure 100.

Figure 14:
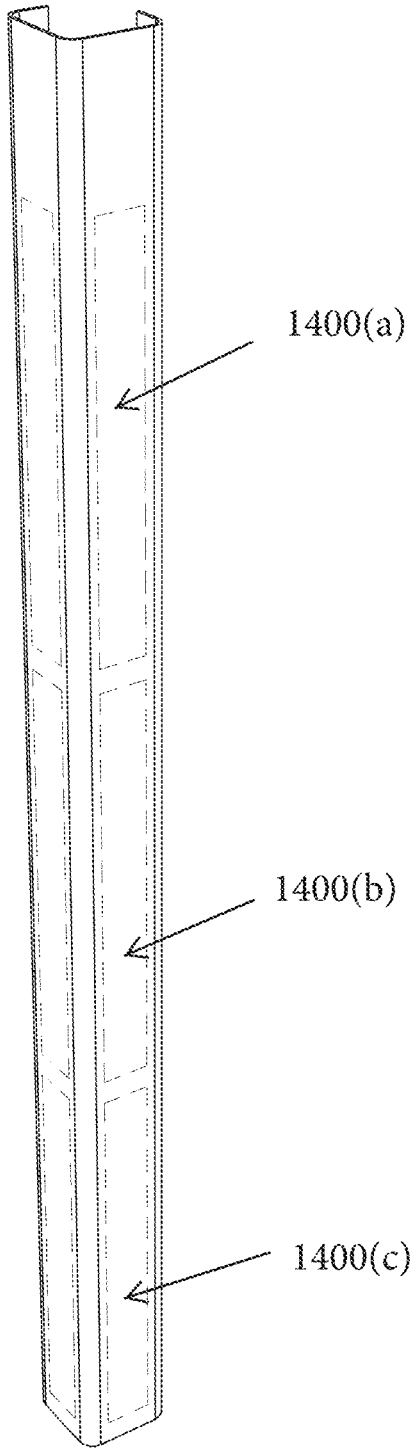
FIGS. 14-21 illustrate example views of a formed corner post of the post and beam system.
Figure 21:
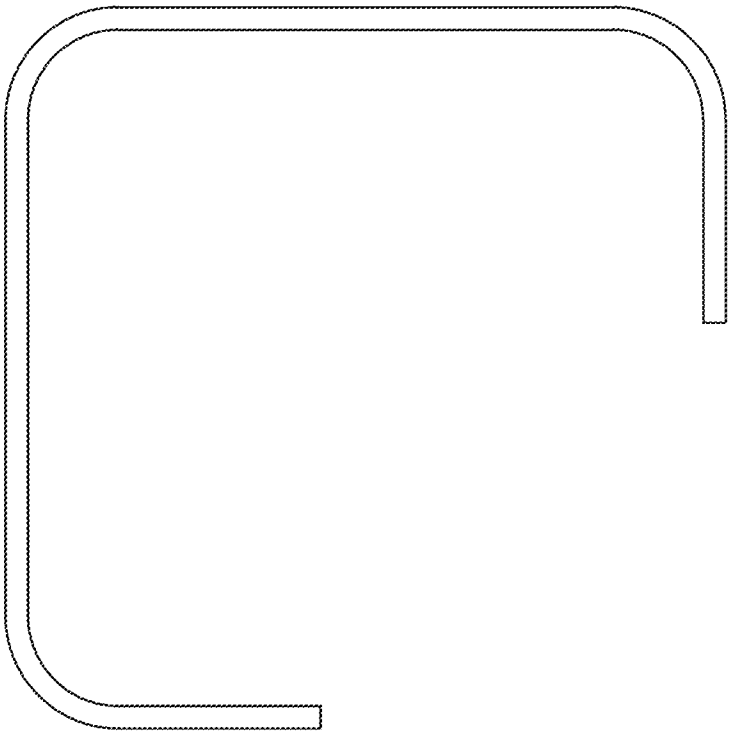
Figure 22:
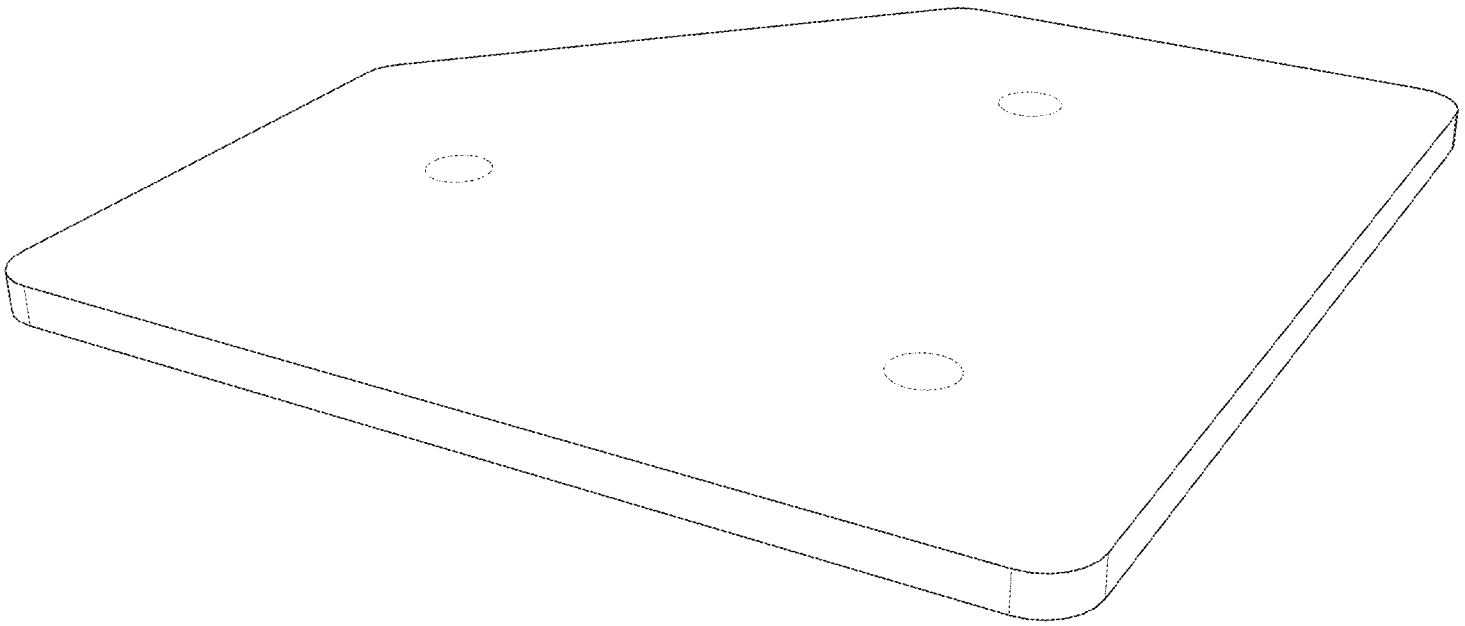
FIGS. 22-29 illustrate example views of a corner post base plate of the post and beam system.
Figure 23:
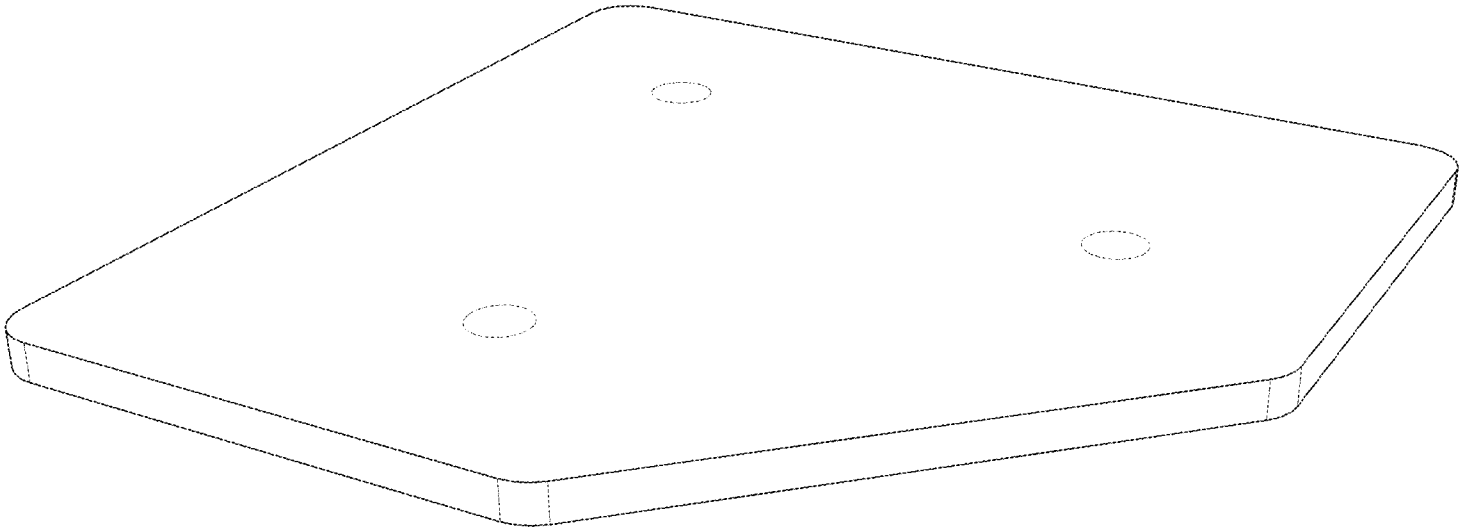
Figure 24:
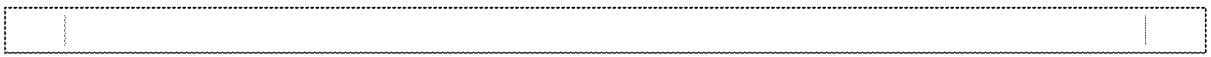
Figure 25:
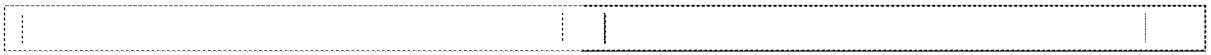
Figure 26:
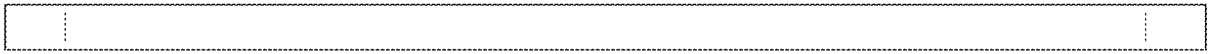
Figure 27:
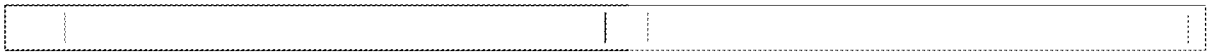
Figure 28:
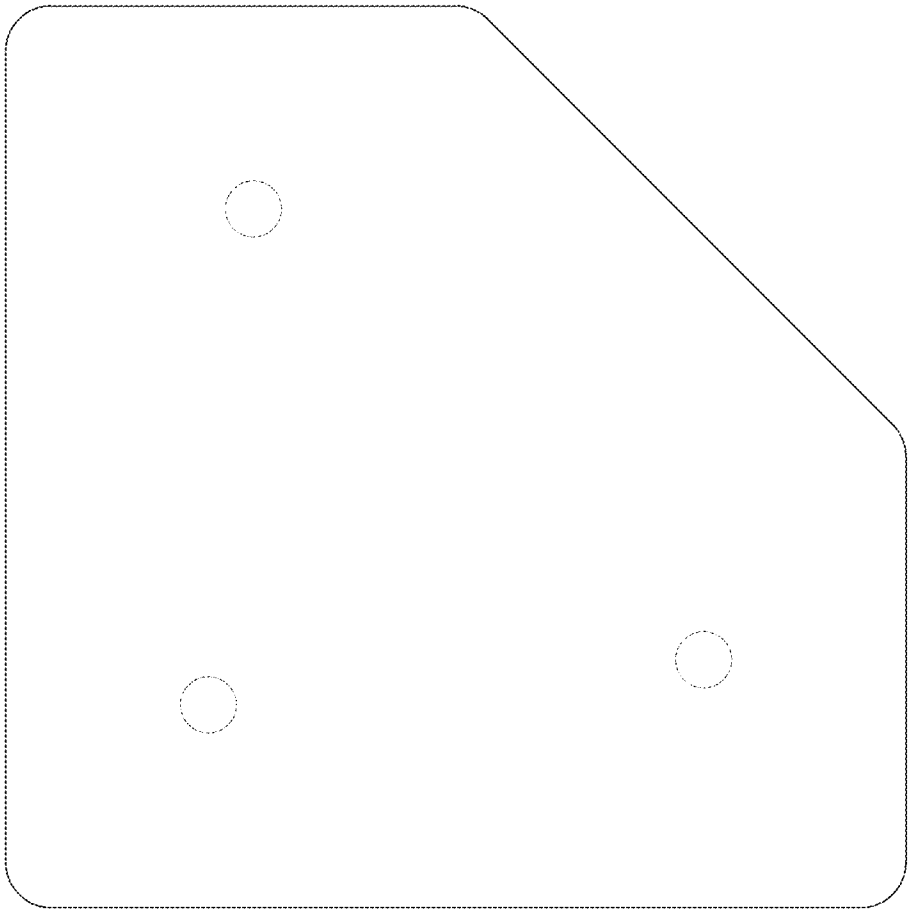
Figure 29:
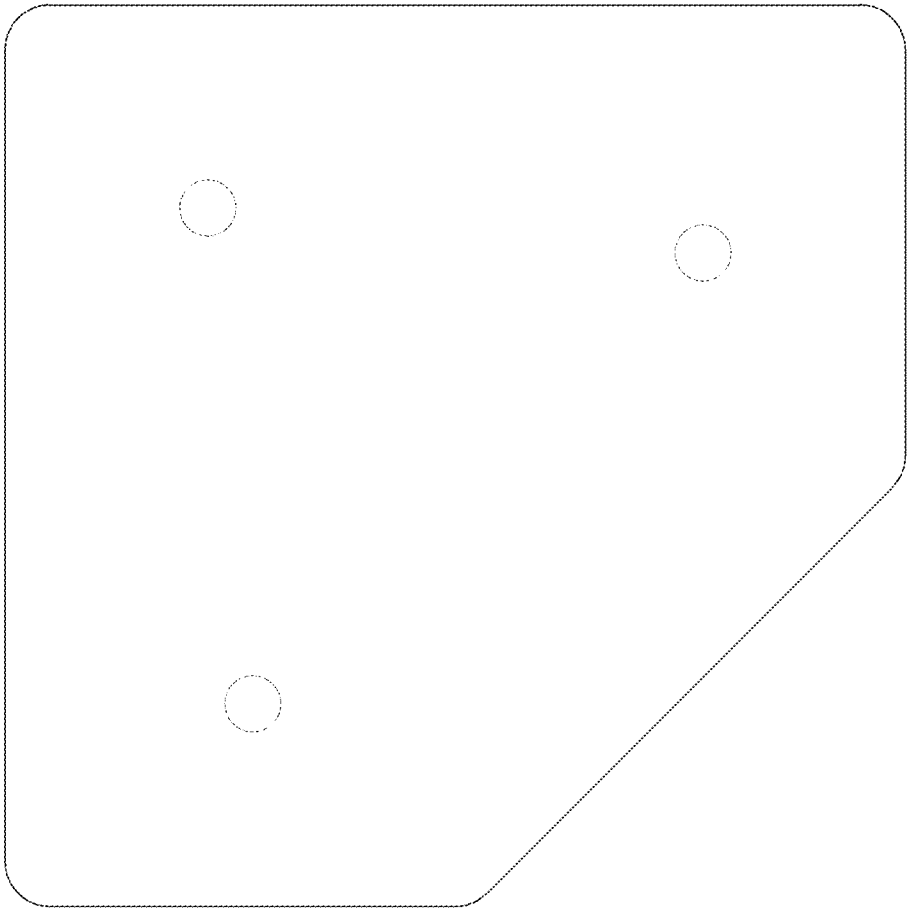
Figure 30:
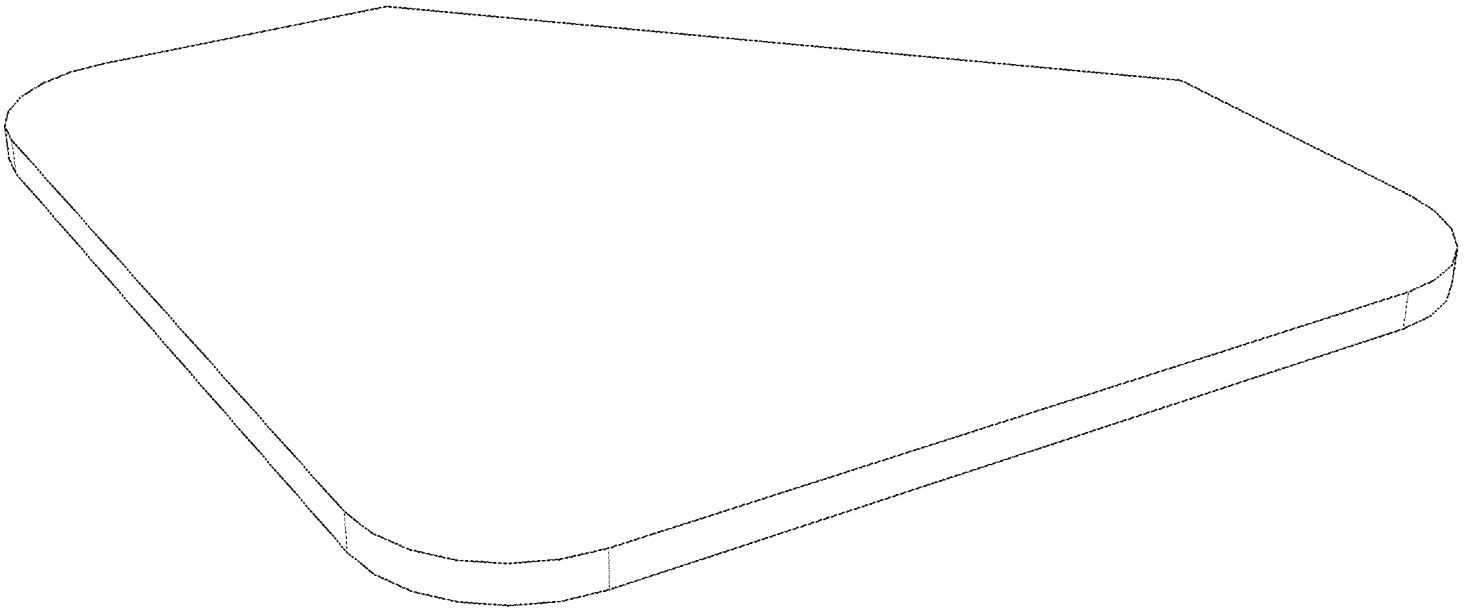
FIGS. 30-37 illustrate example views of a corner post support gusset of the post and beam system.
Figure 31:
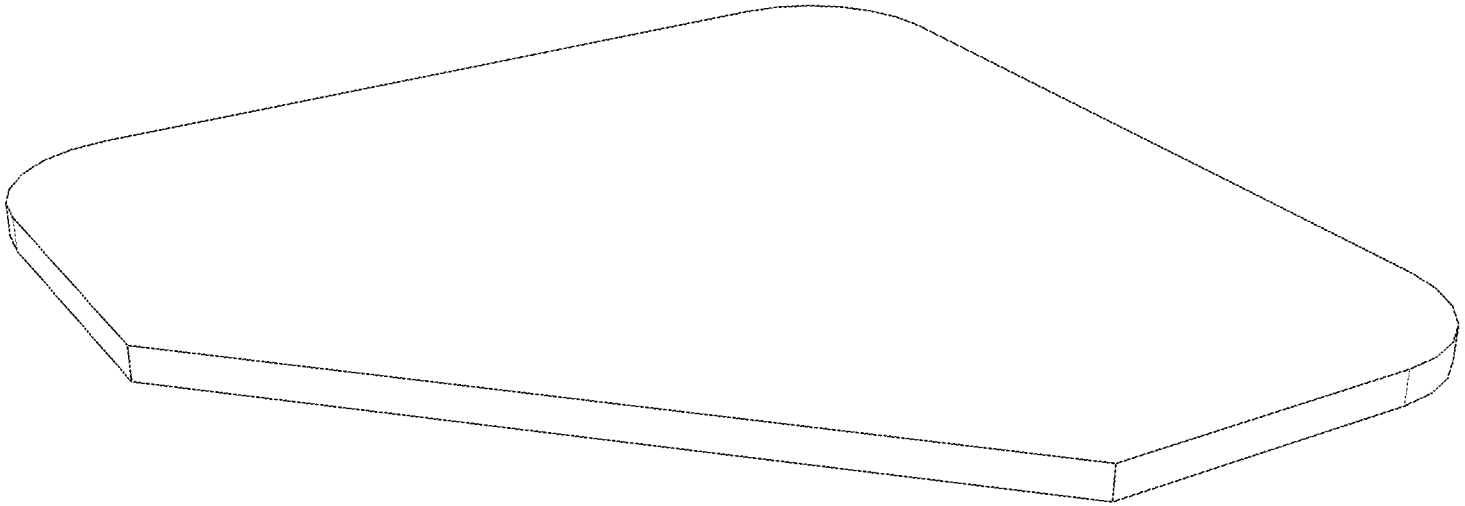
Figure 32:
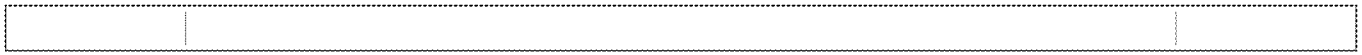
Figure 33:
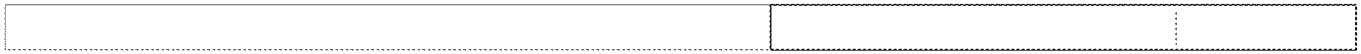
Figure 34:
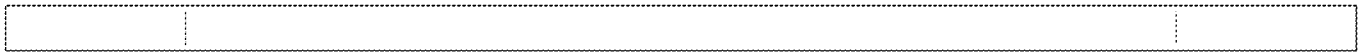
Figure 35:
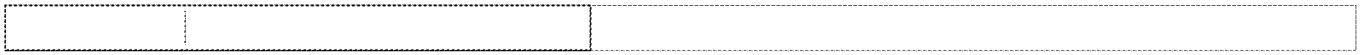
Figure 36:
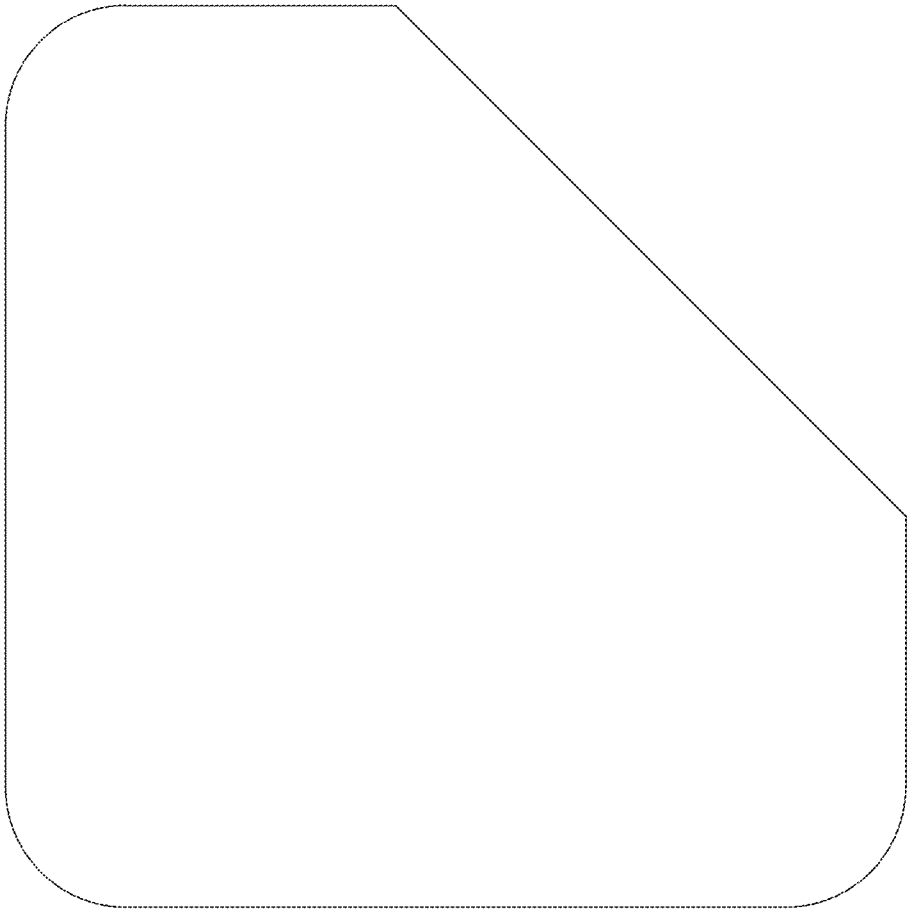
Figure 37:
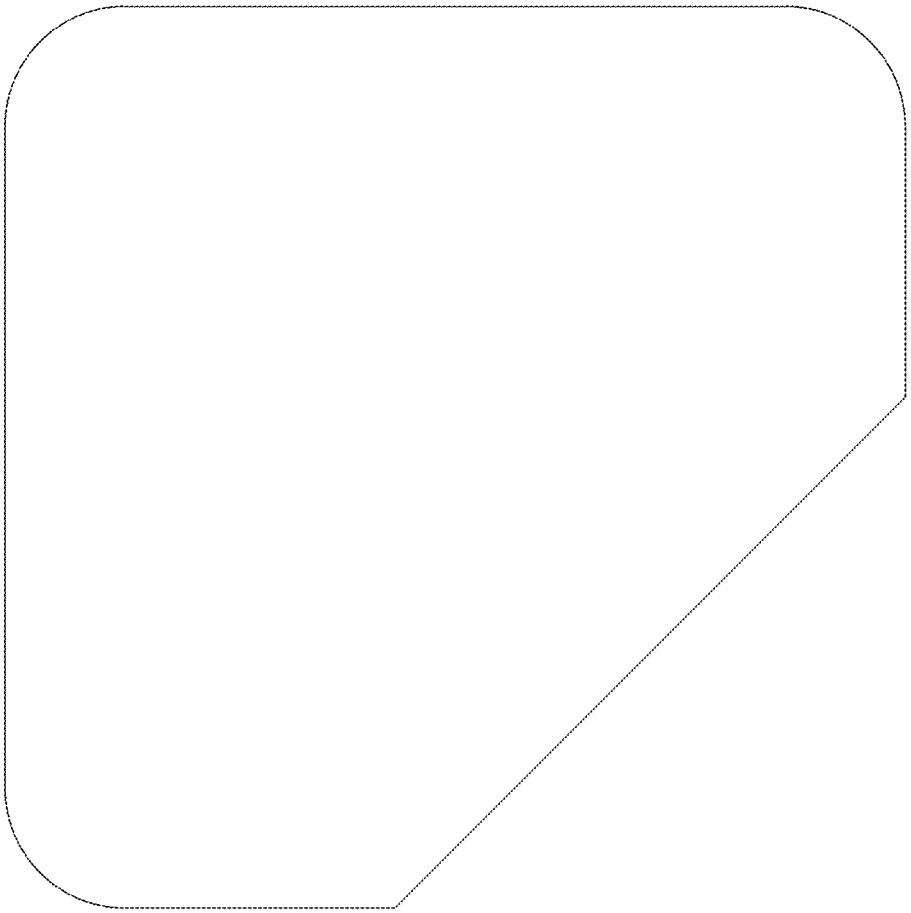
Figure 38:
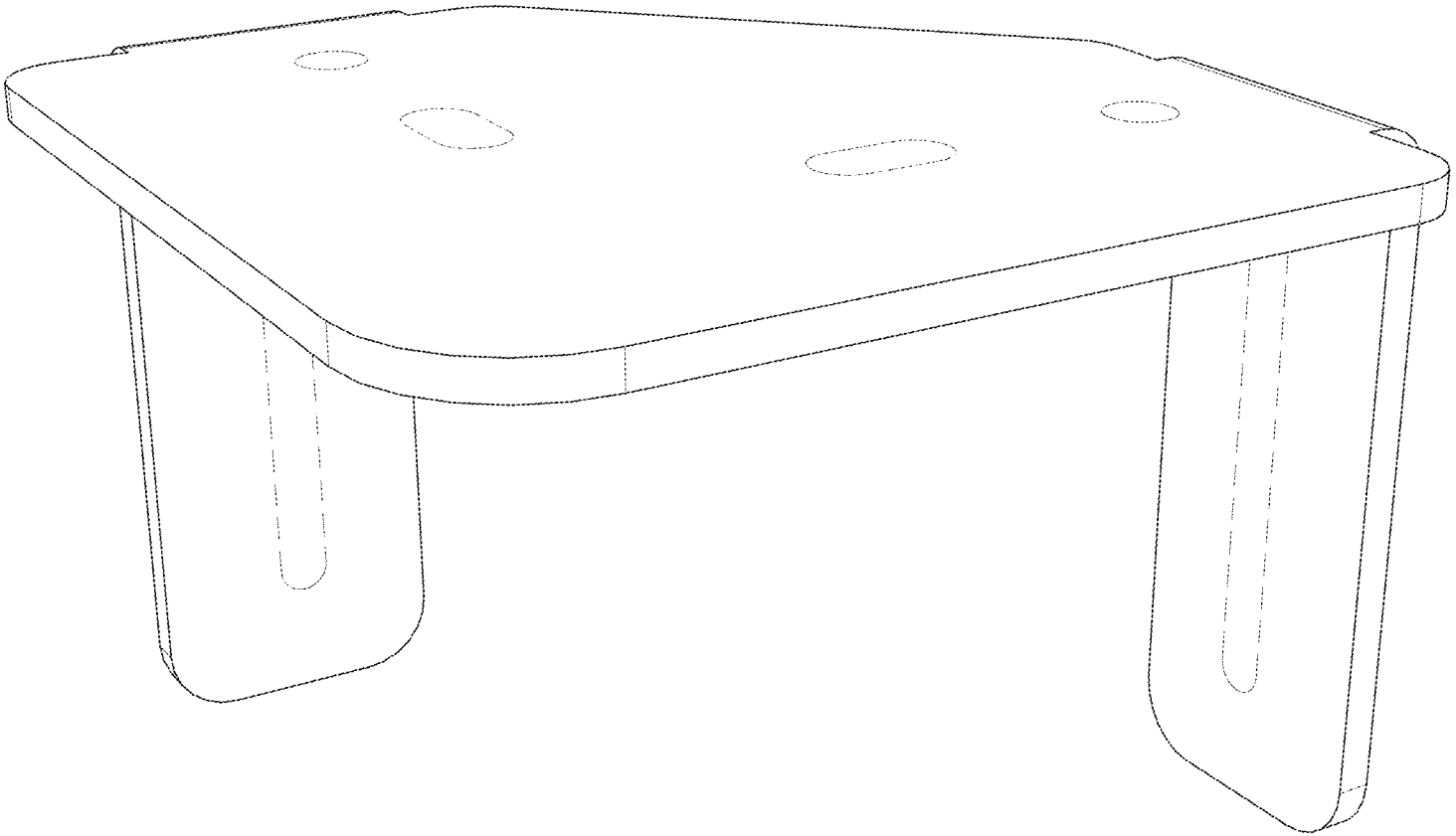
FIGS. 38-45 illustrate example views of a formed corner post top cap of the post and beam system.
Figure 39:
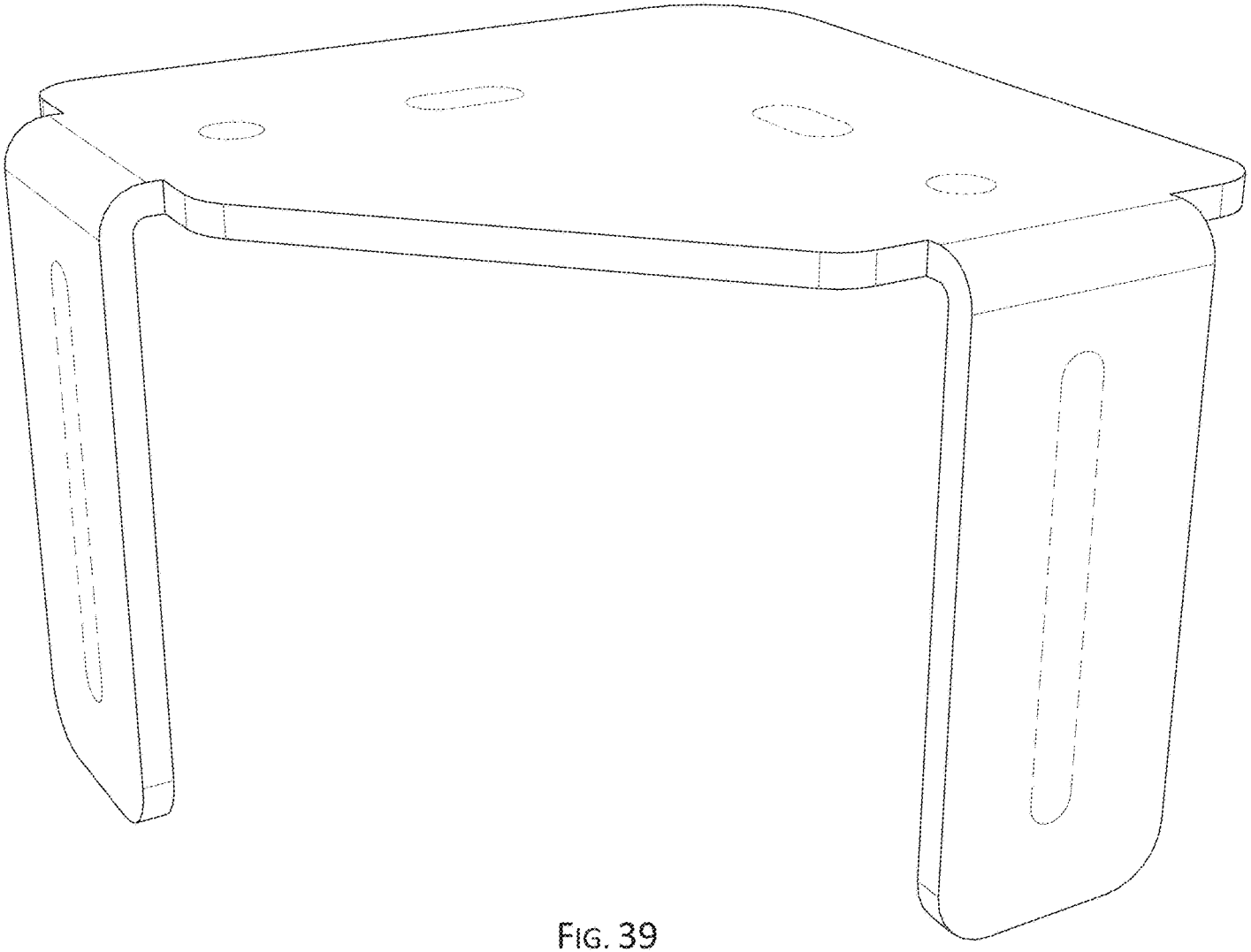
Figure 40:
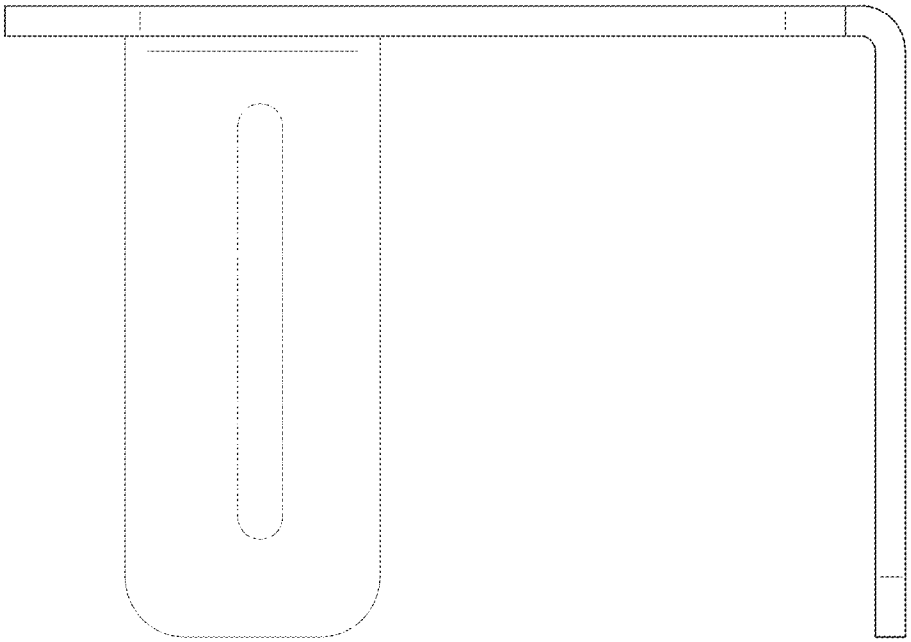
Figure 41:
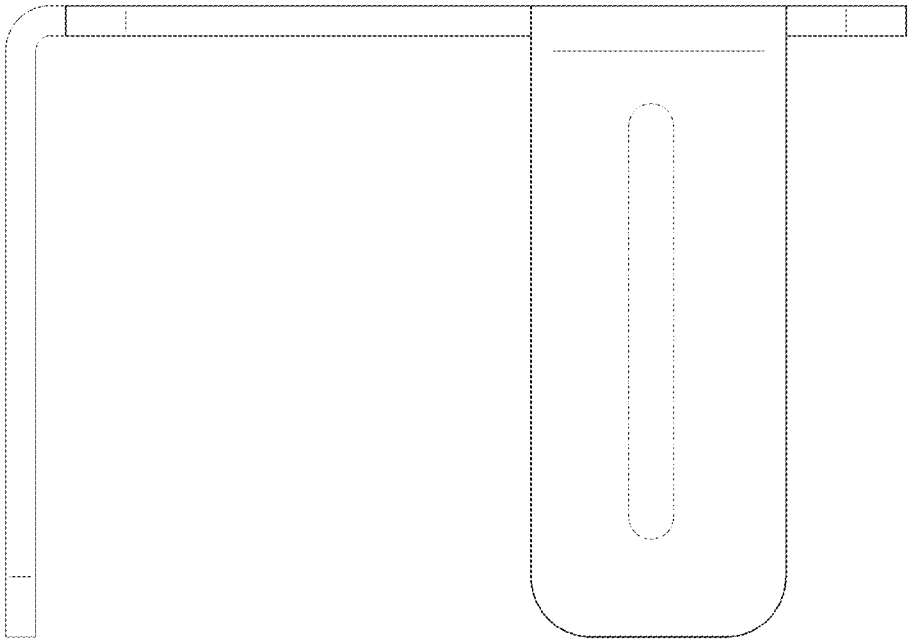
Figure 42:
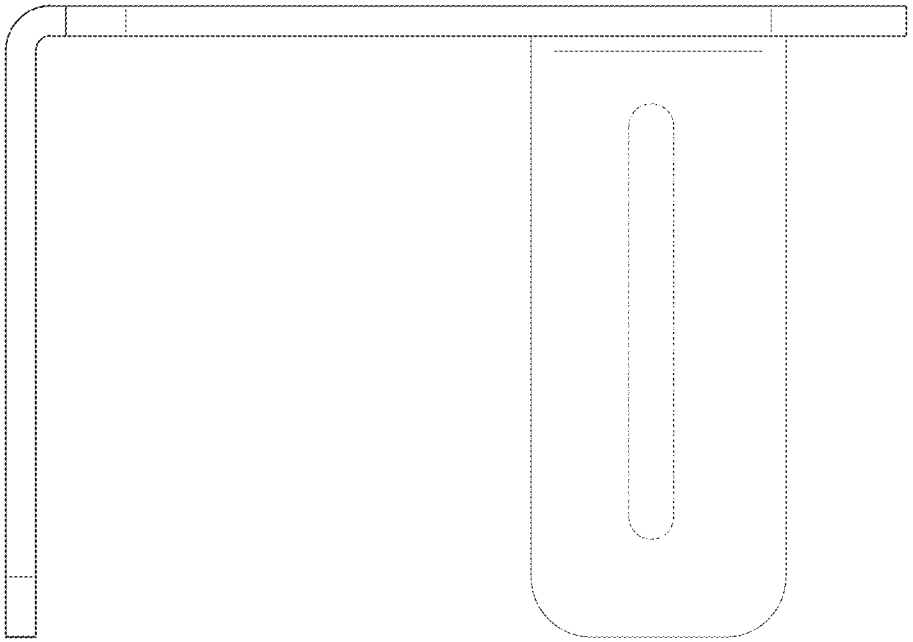
Figure 43:
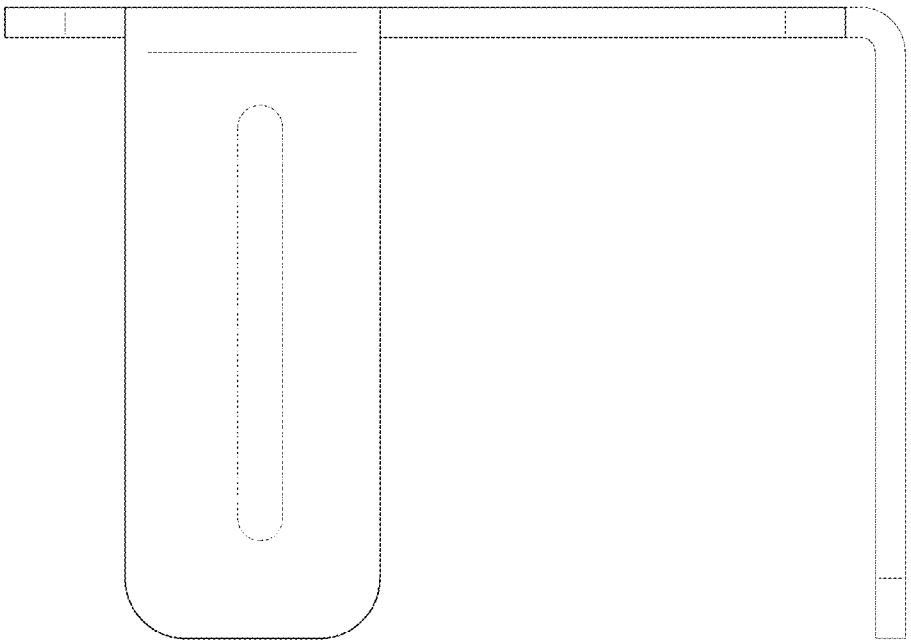
Figure 44:
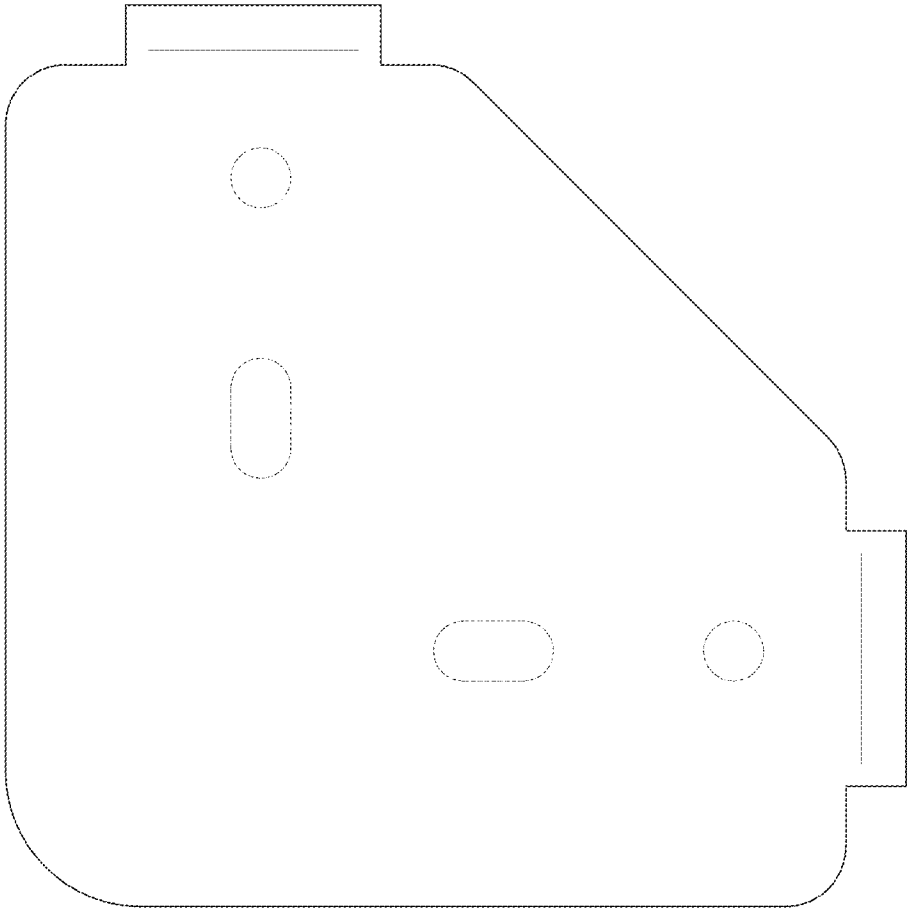
Figure 45:
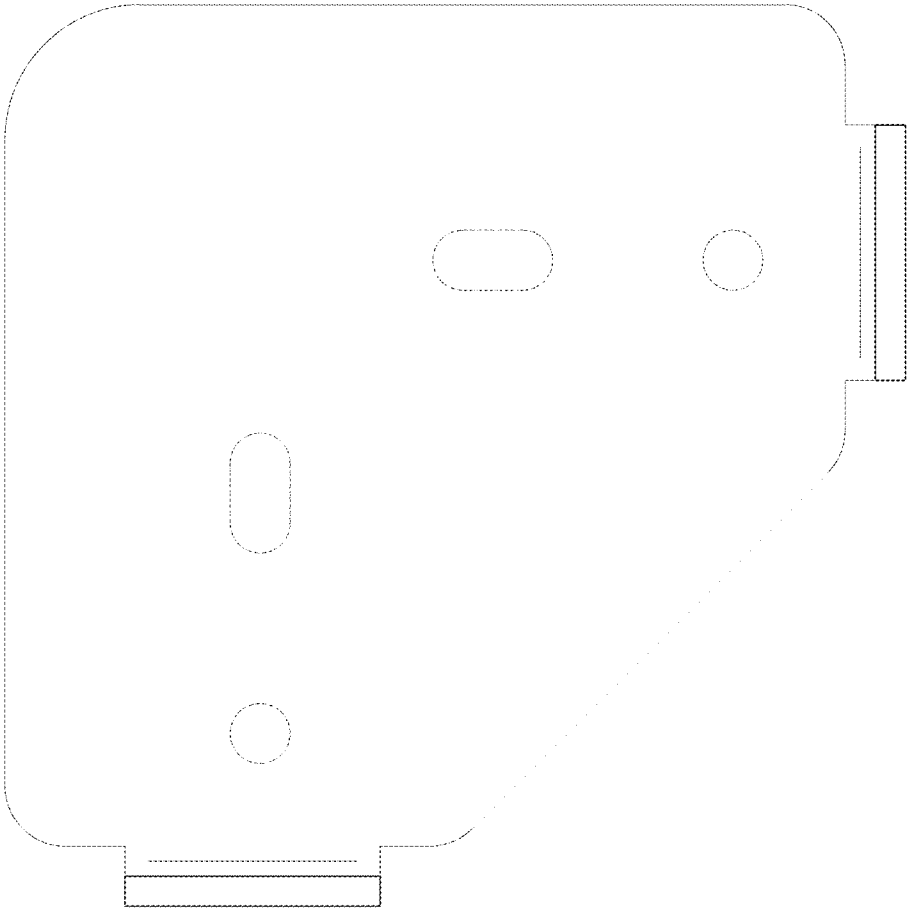
Figure 46:
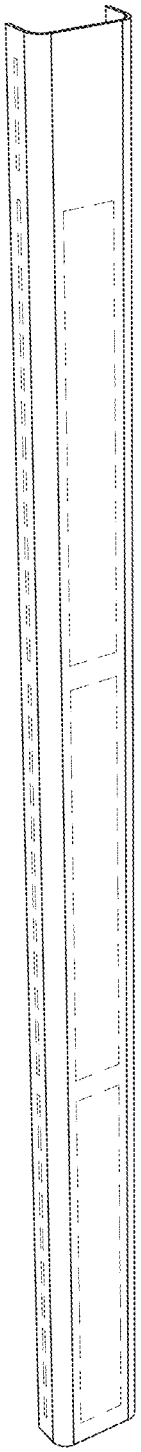
FIGS. 46-53 illustrate example views of a formed inline post of the post and beam system.
Figure 47:
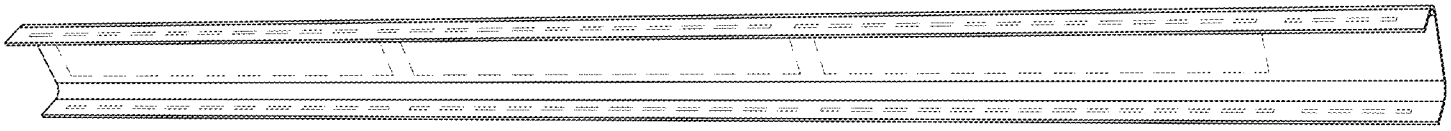
Figure 48:
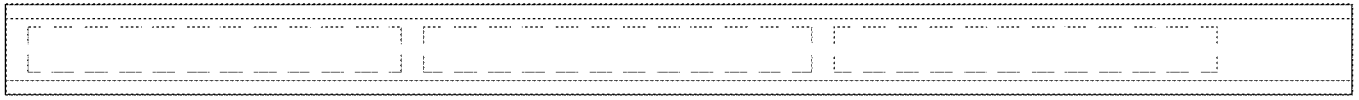
Figure 49:
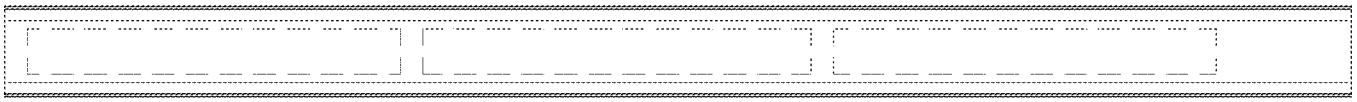
Figure 50:
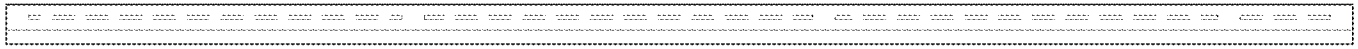
Figure 51:
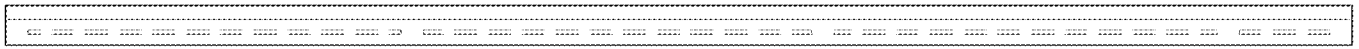
Figure 52:
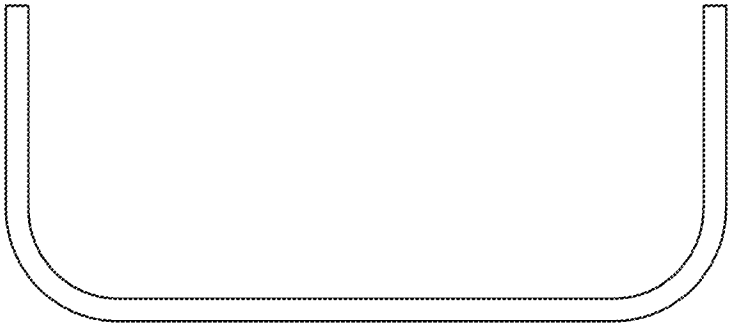
Figure 53:
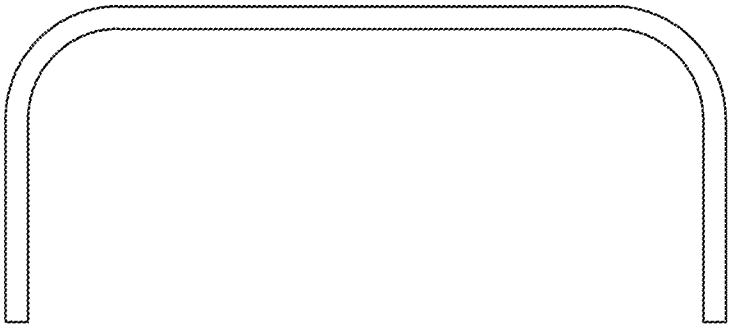
Figure 54:
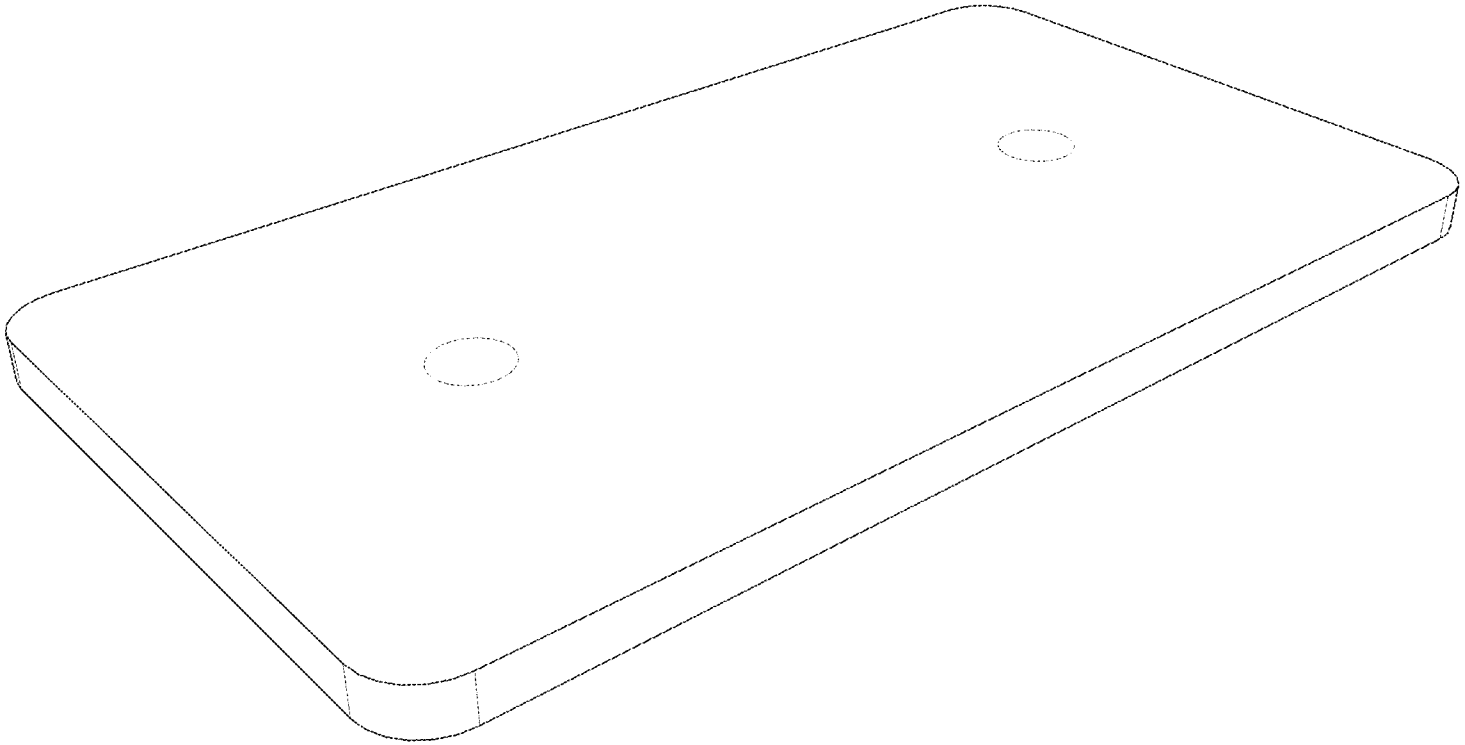
FIGS. 54-61 illustrate example views of an inline post base plate of the post and beam system.
Figure 55:
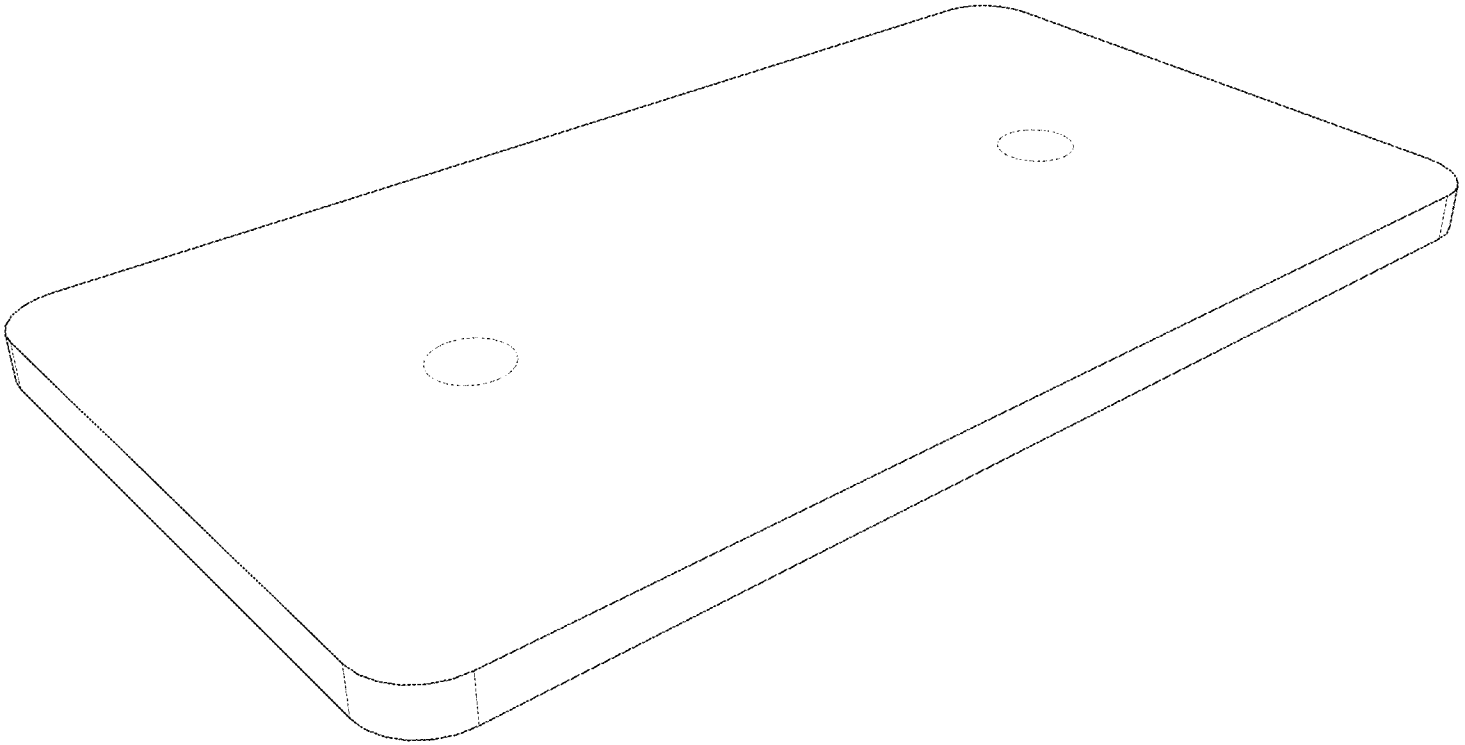
Figure 56:
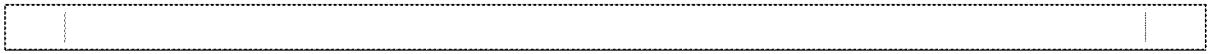
Figure 57:
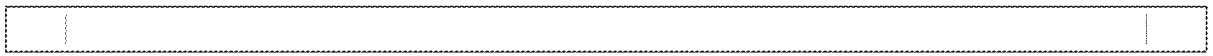
Figure 58:
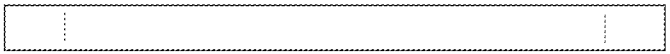
Figure 59:
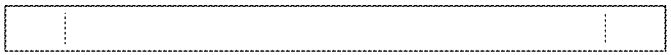
Figure 60:
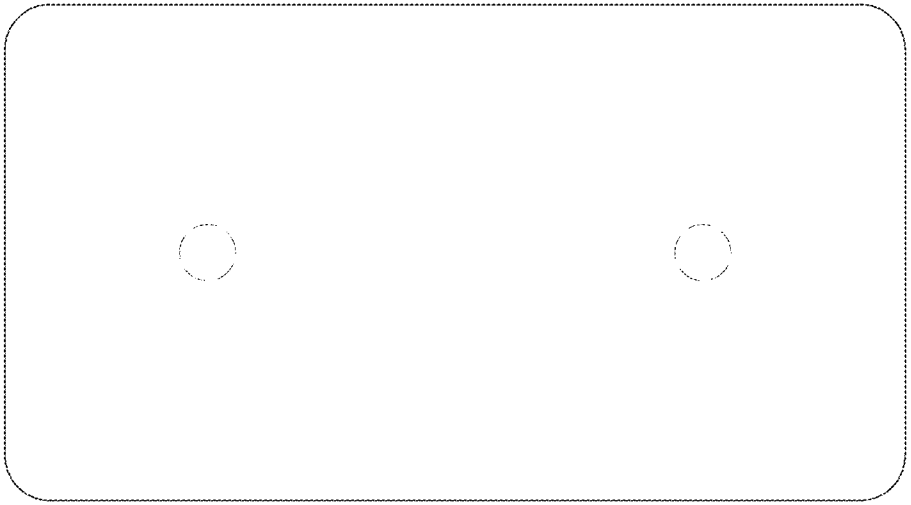
Figure 61:
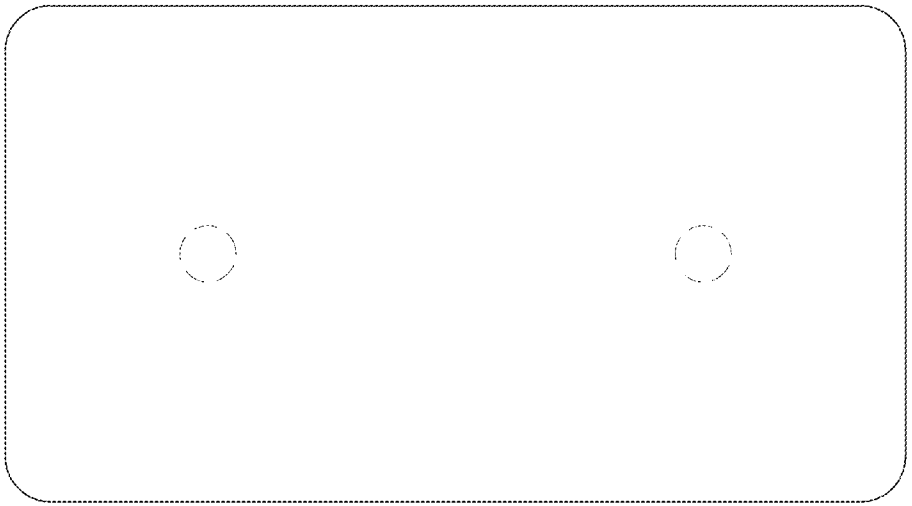
Figure 62:
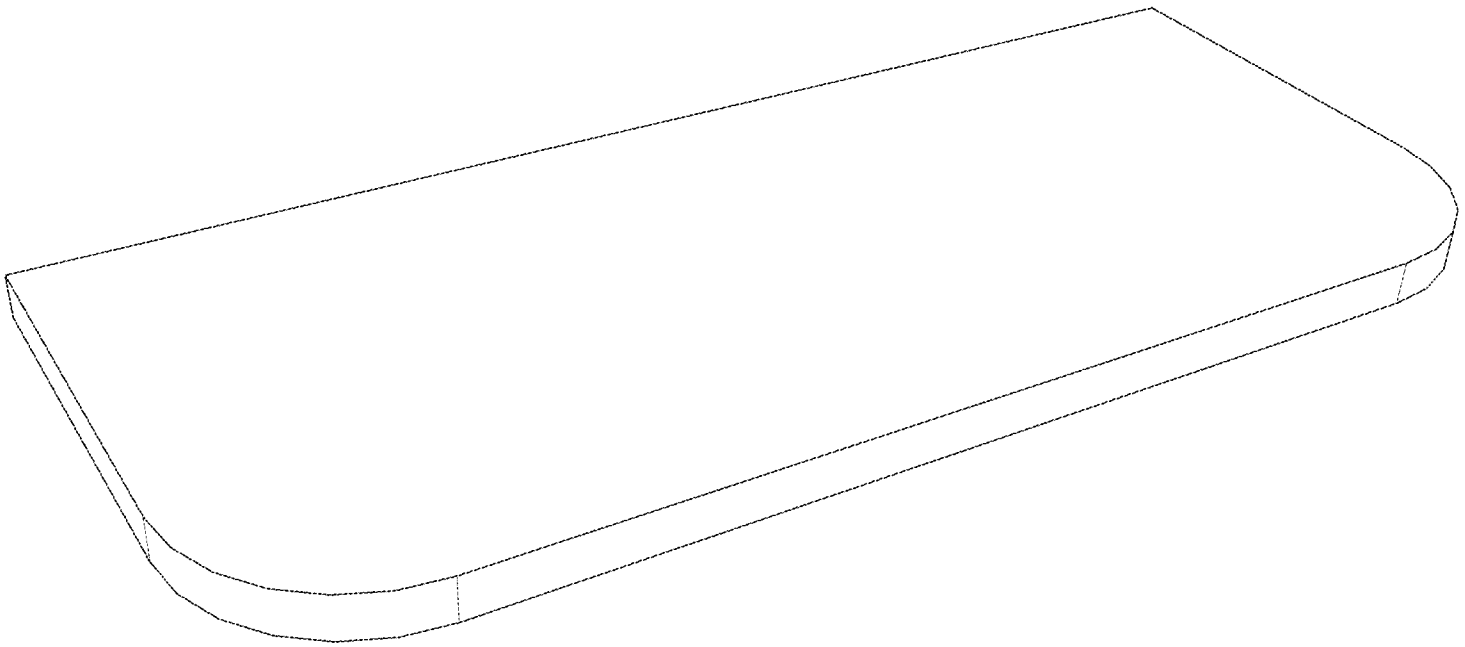
FIGS. 62-69 illustrate example views of an inline post support gusset of the post and beam system.
Figure 63:
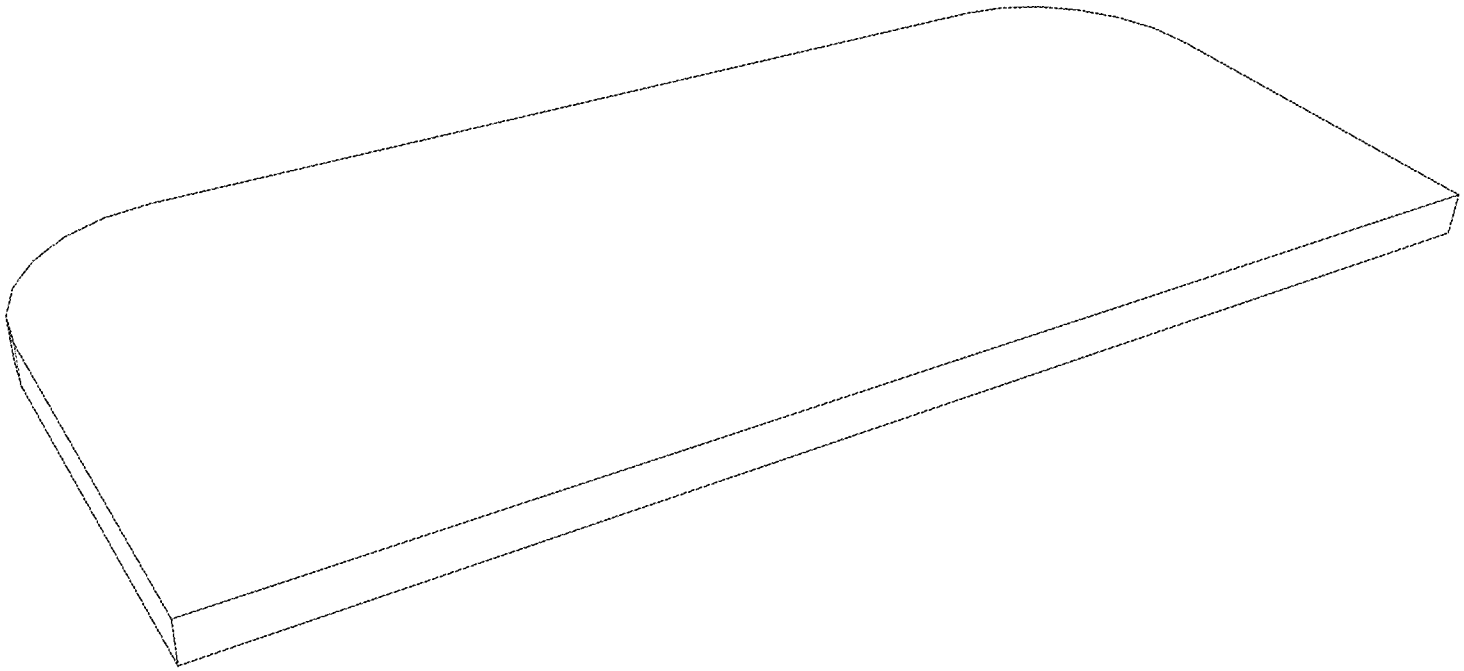
Figure 64:
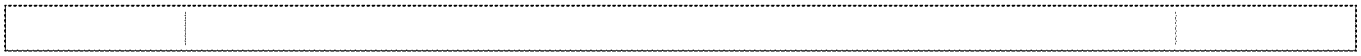
Figure 65:
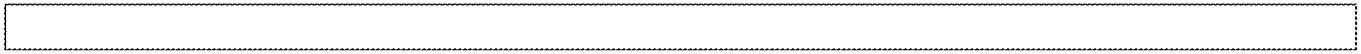
Figure 66:
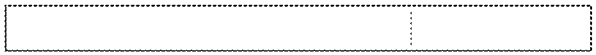
Figure 67:
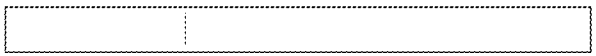
Figure 68:
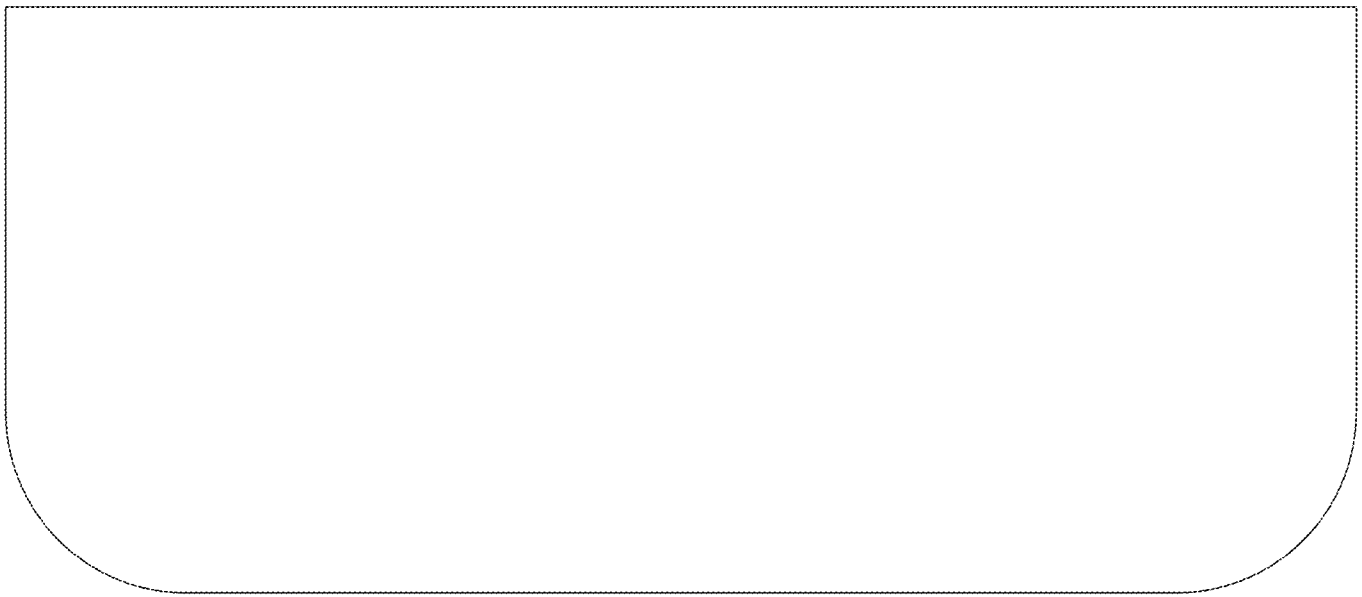
Figure 69:
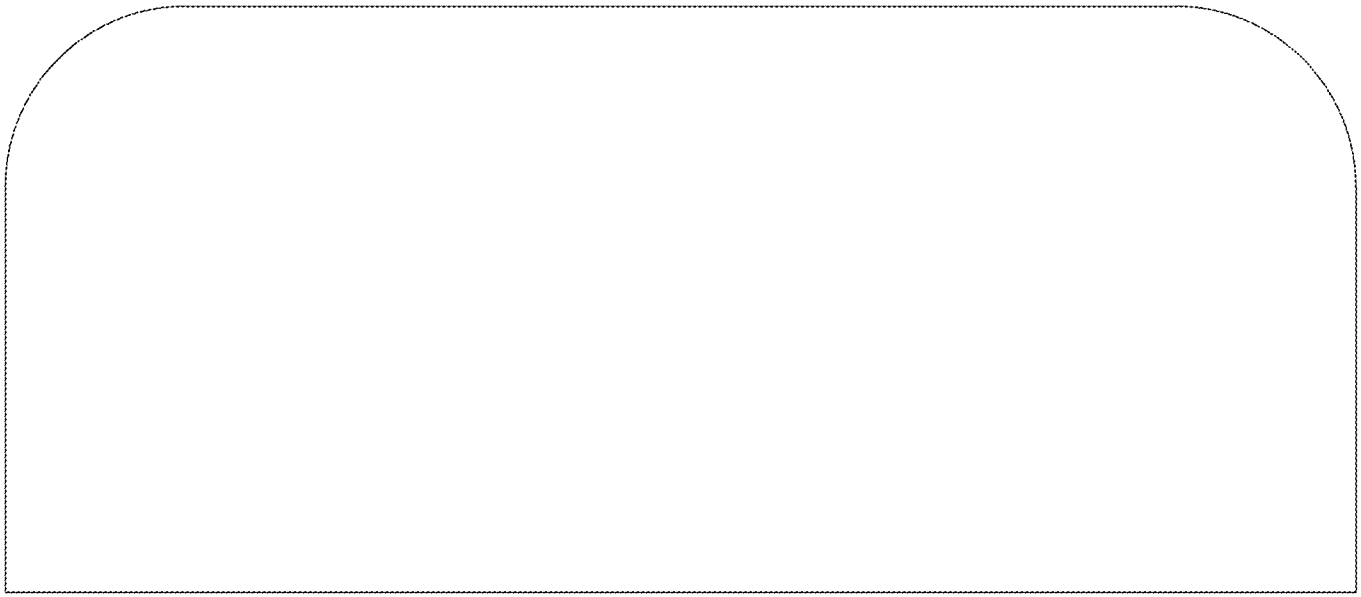
Figure 70:
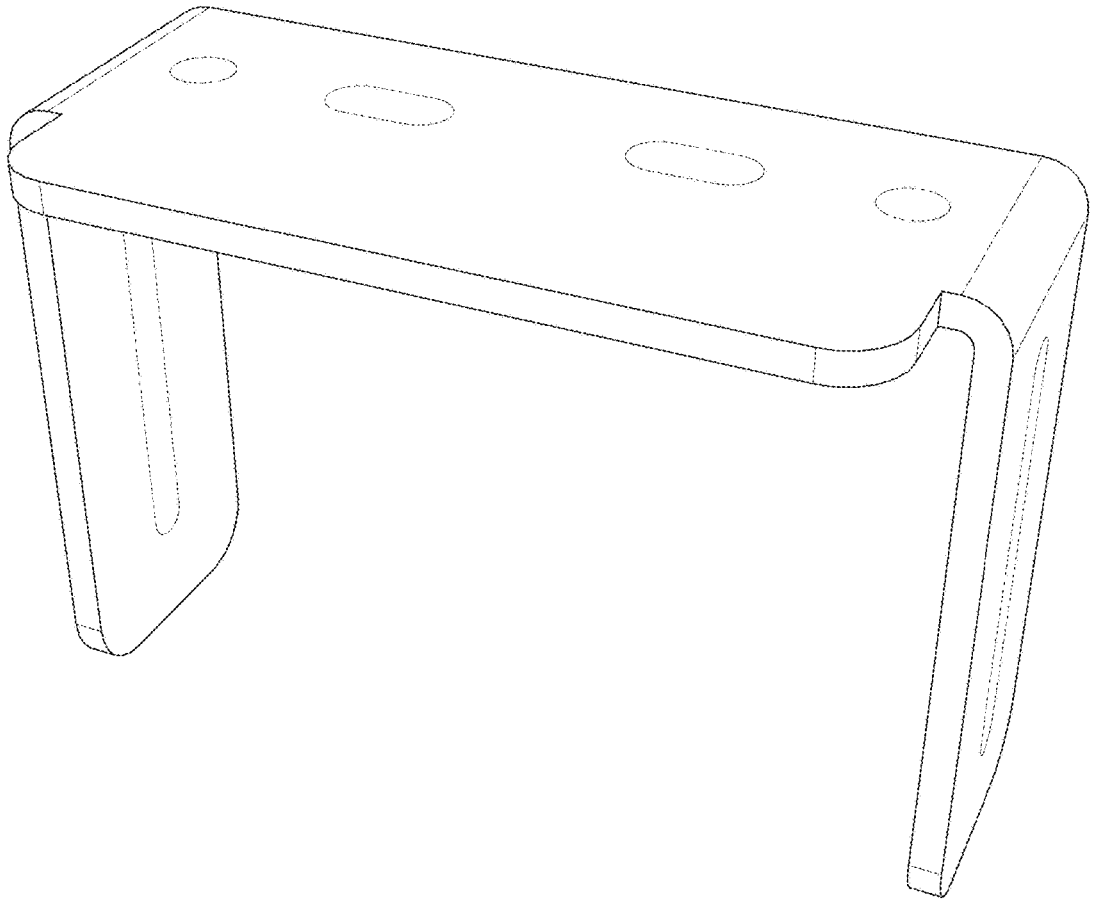
FIGS. 70-77 illustrate example views of a formed inline post top cap of the post and beam system.
Figure 71:
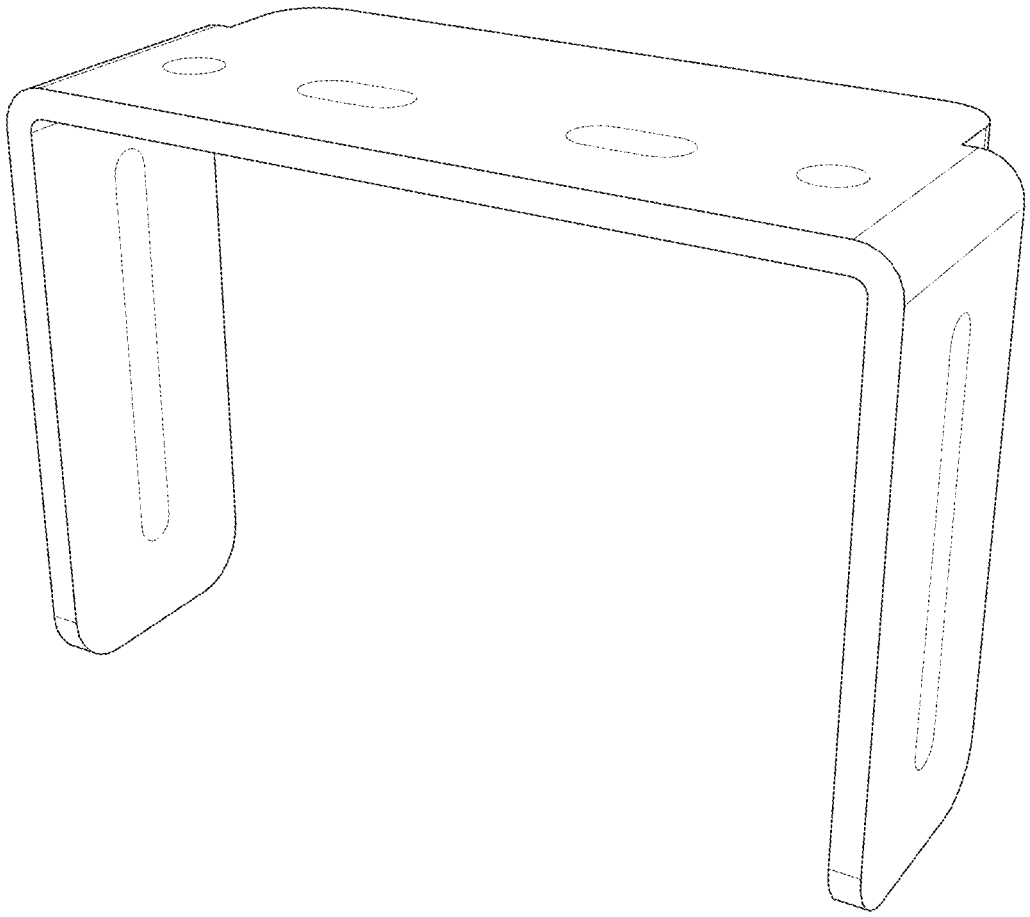
Figure 72:
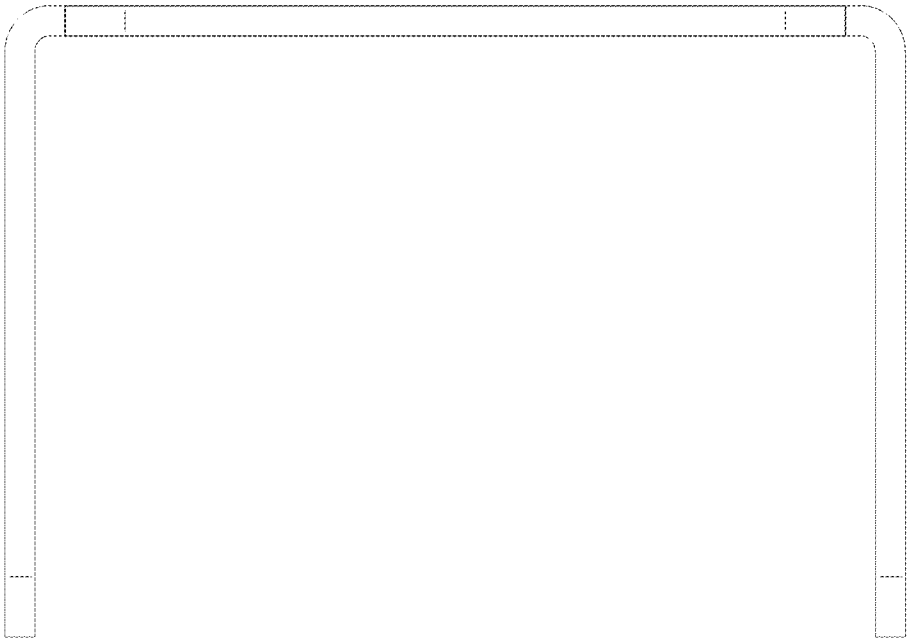
Figure 73:
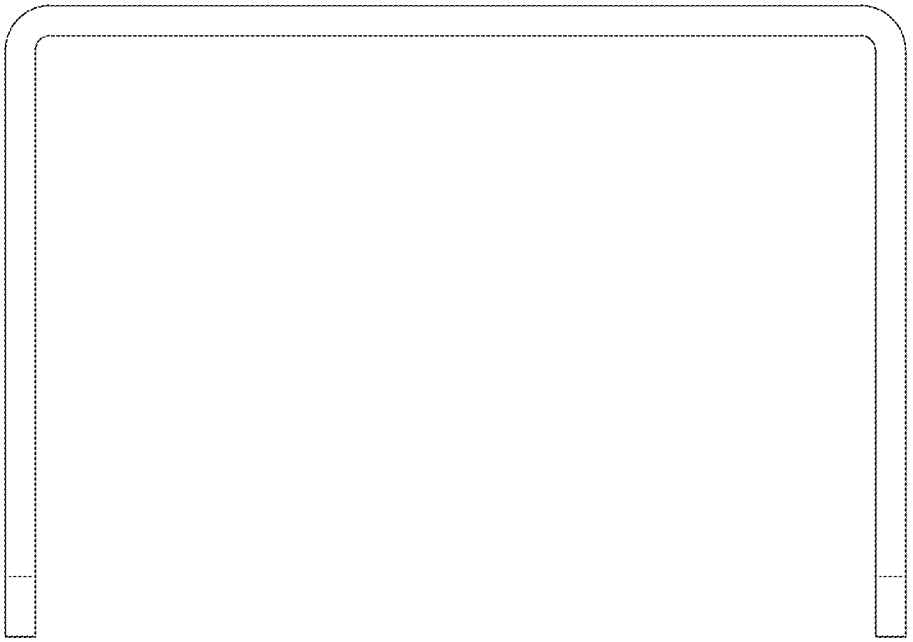
Figure 74:
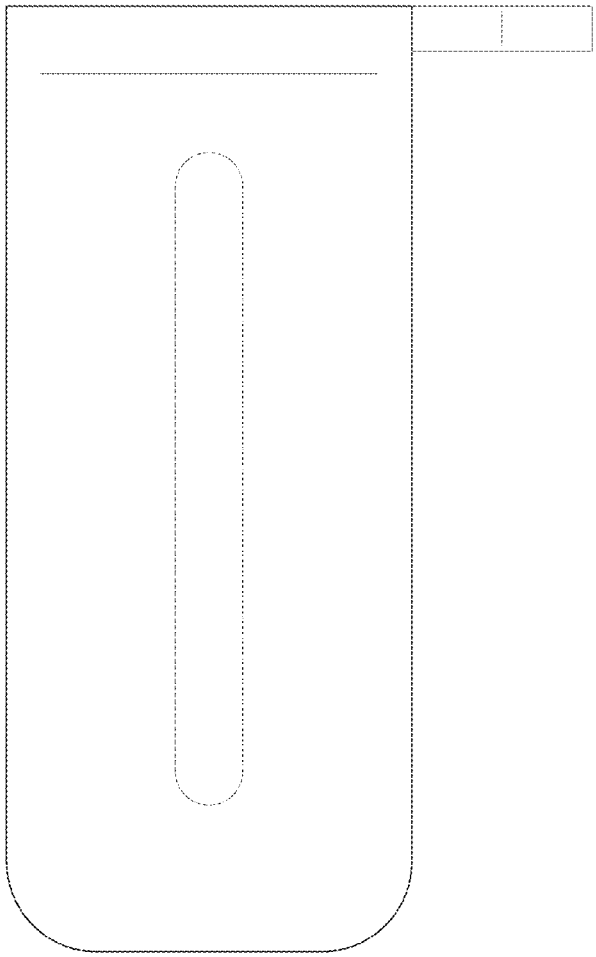
Figure 75:
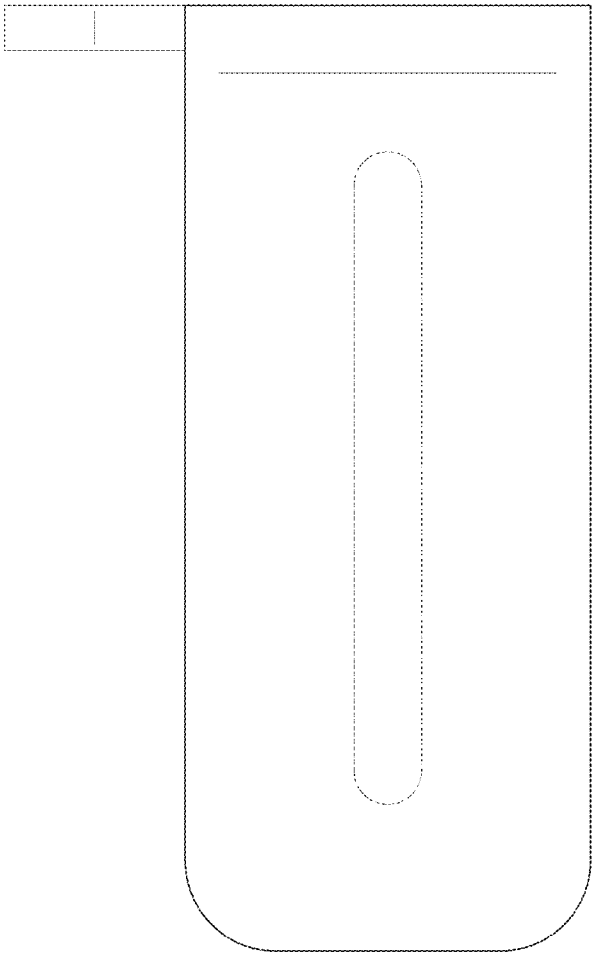
Figure 76:
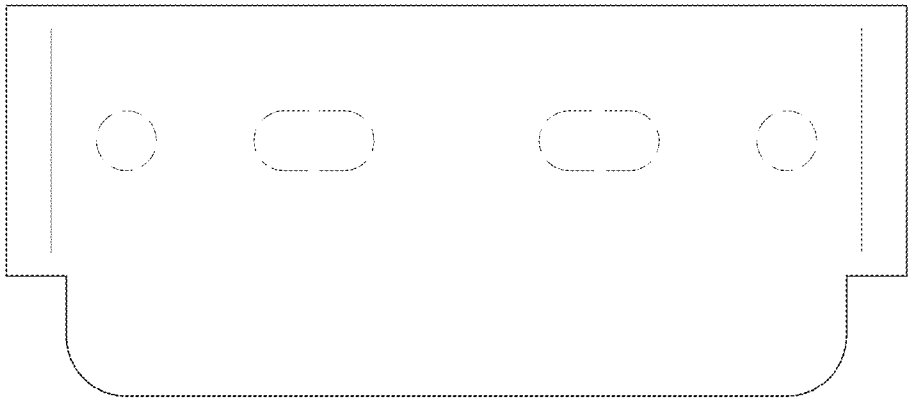
Figure 77:
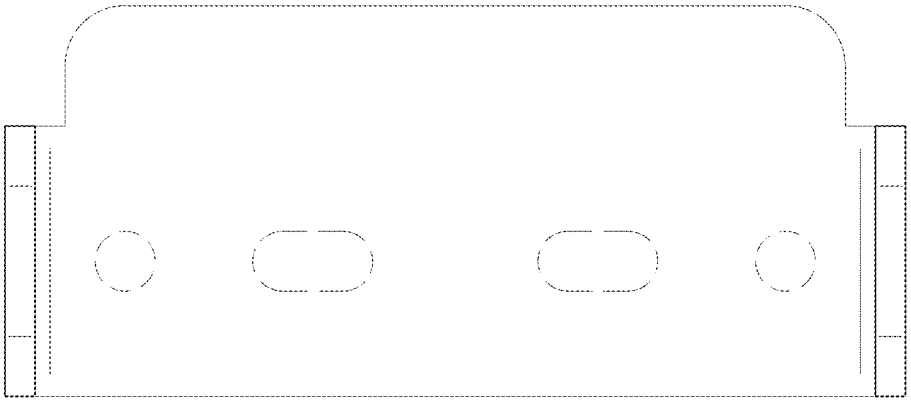
Figure 78:
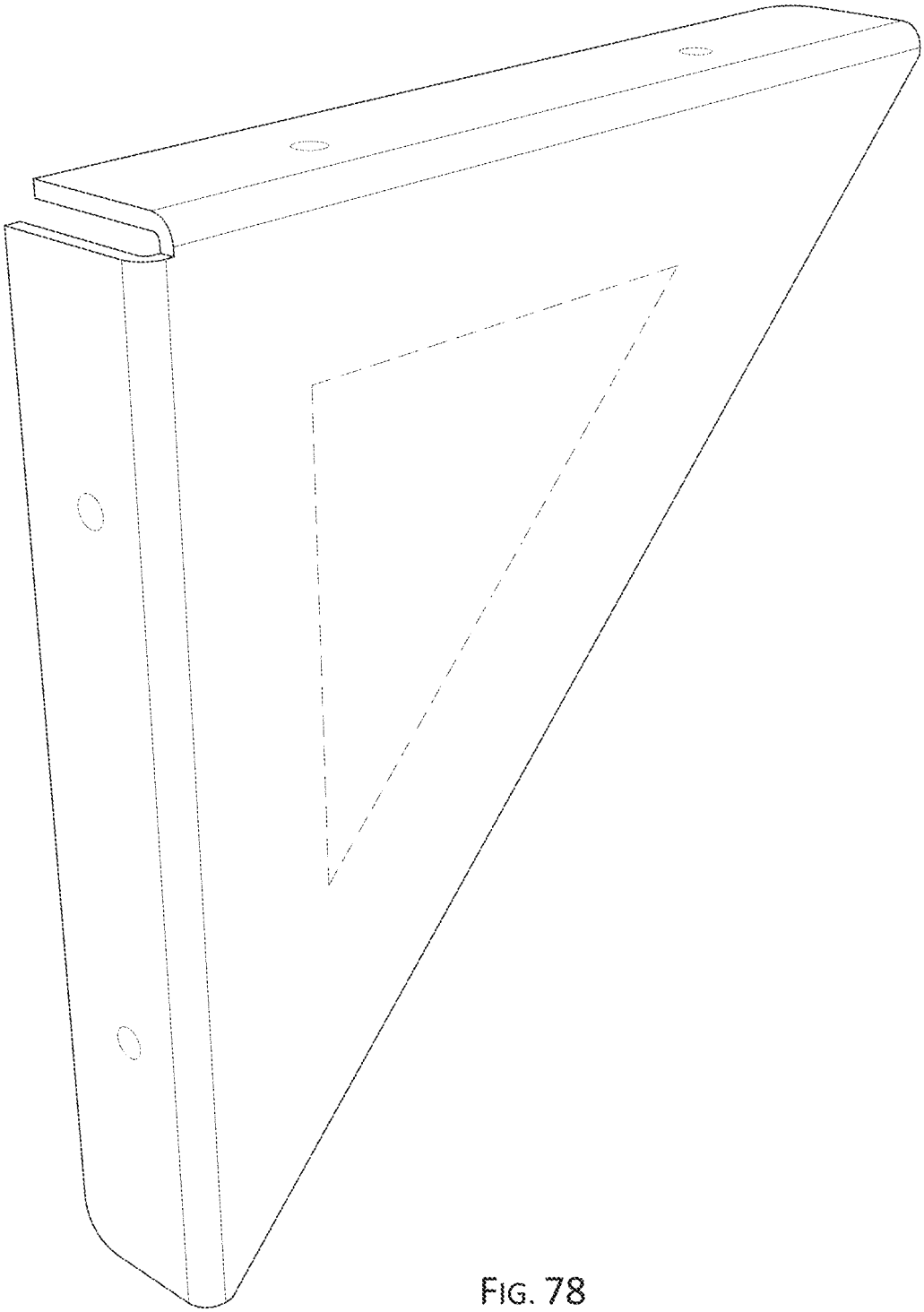
FIGS. 78-85 illustrate example views of a formed knee brace of the post and beam system.
Figure 79:
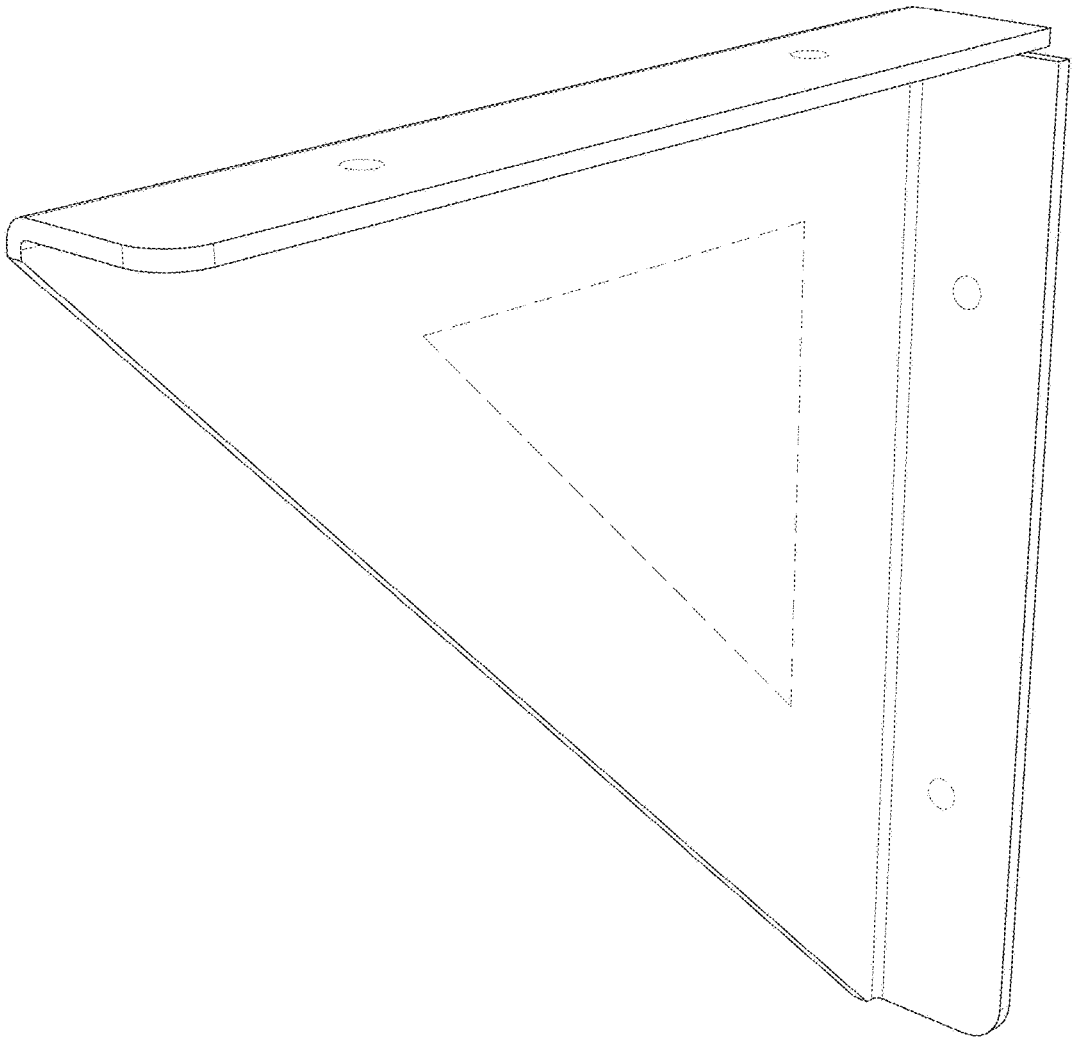
Figure 80:
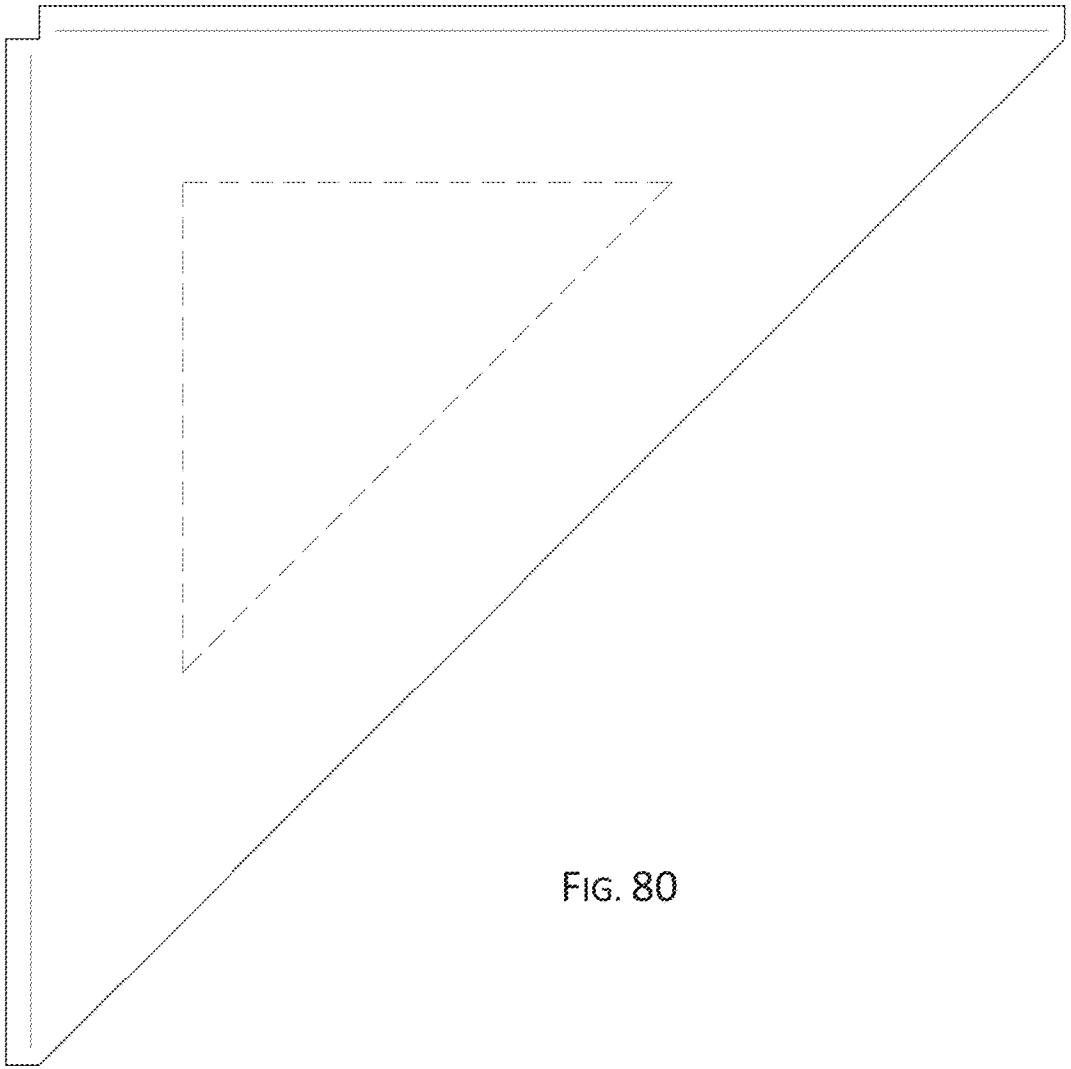
Figure 81:
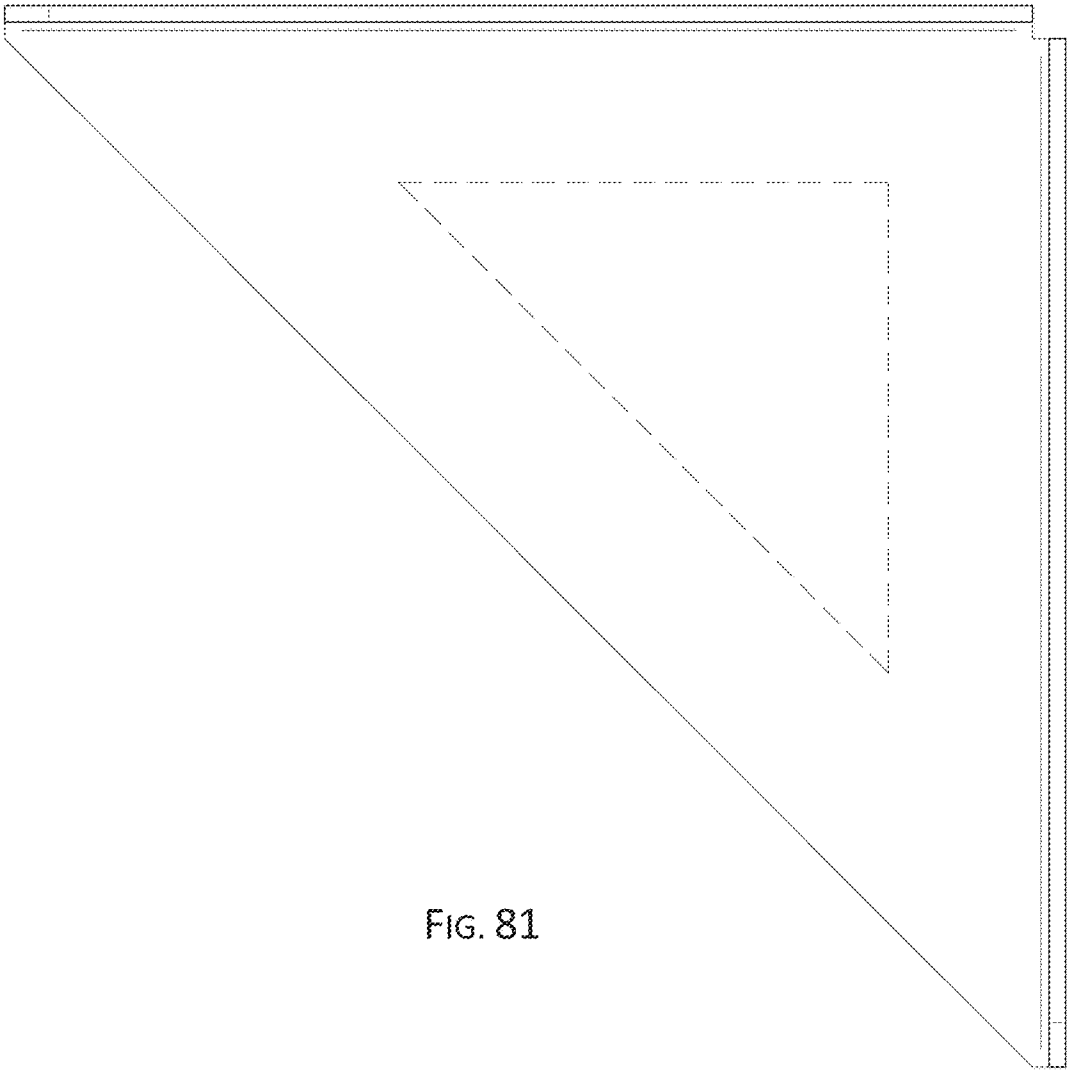
Figure 82:
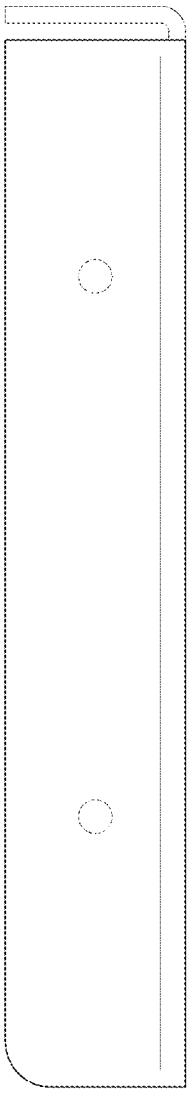
Figure 83:
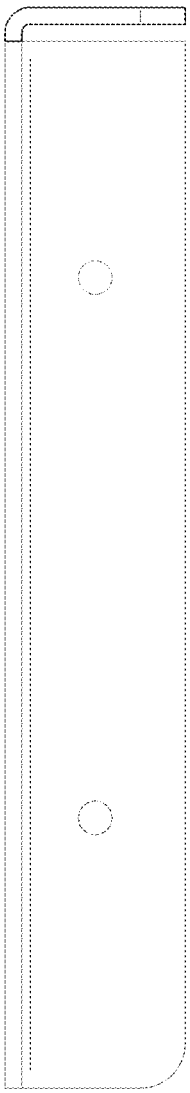
Figure 84:
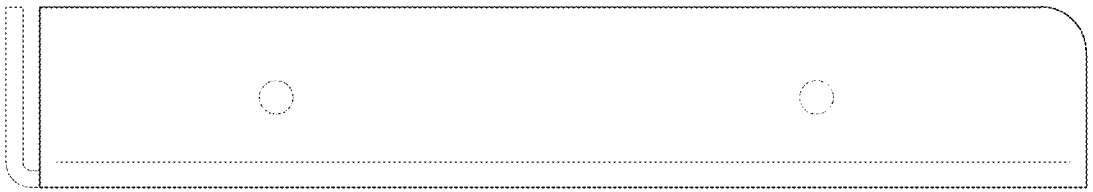

In some instances, a corner post base plate 102 may be secured to a substrate (e.g., an existing floor, earth, concrete, footings, etc). In other instances, the corner post base plate 102 may be placed on the substrate without attachment. The corner post base plate 102 may be secured to one of the formed corner posts 104(*a*)-(*d*) to create the vertical corners of the structure 100. In some implementations, the formed corner posts 104(*a*)-(*d*) may be eight (8) feet, ten (10) feet, or twelve (12) feet long. As described in this disclosure, the formed corner post may be formed of powder-coated ¼ inch steel (unfinished, finished (e.g., painted or powder-coated) and/or weathered) which has a unique squared-off "a" shape. In some implementations, the formed corner post includes large rectangular openings along the long axis of two sides of the post. The unique squared-off "a" shape and the large openings (as shown in FIGS. 14 and 21) allow for minimal bulk while retaining maximum structural load integrity. The unique shape also provides a unique aesthetic appeal.

In some implementations, the large openings of the corner post or any portion thereof (or any other post or beams described herein) may be filled with a decorative pattern. For instance, a decorative pattern, such as the examples shown below, may be formed from or cut directly into the material of corner post.

Each formed corner post 104(*a*)-(*d*) includes vertical slots (as described further below in FIG. 15). The vertical slots also reduce unneeded bulk or weight of each beam. In addition, the vertical slots allow for the attachment of materials to connect two formed corner posts or connect a formed corner post with a formed inline post. For instance, the vertical slots may allow a user easy access to attach a panel (e.g., a metal decorative panel, a fabric sun and/or wind block, etc) or a rail system using standard hardware, thus connecting two formed posts (corner and/or inline).

As shown on structure 100, an inline post base plate 106 may be located between the substrate and one of the formed inline posts 108(*a*)-(*d*). The inline post base plate 106 may have a similar function to the corner post base plate 102. Similar to the formed corner post 104(*a*)-(*d*), each of the formed inline posts 108(*a*)-(*d*) includes large rectangular opening and vertical slots. Each of the formed inline posts 108(*a*)-(*d*) include a squared-off "c" shape. In some implementations, the squared-off "c" shape and the rectangular openings combined to reduce weight of the post without a significant reduction in structural integrity. For instance, the structure 100 may withstand a snow load at or about 50 pounds per square foot. Additionally, the structure 100 would achieve at least a Seismic Design Category D, which corresponds to buildings and structures in areas expected to experience severe and destructive ground shaking.

Structure 100 may include multiple formed beams 110(*a*)-(*h*). Each formed beam 110(*a*)-(*h*) may be constructed of ¼ steel in any form described above. As shown, each formed beam 110(*a*)-(*h*) includes a unique "s" shape when viewed from each end. The "s" shape allows for structural strength and also positions the long slots to be facing the substrate or ground. In some instances, the position of the long slots would allow a user to easily attach hardware and any of the afore-mentioned attachments.

The formed steel beams 110(*a*)-(*h*) may have one of multiple end configurations. For instance, both ends of formed beam 110(*a*) are mitered to create the top corner of structure 100. Formed beam 110(*c*) has a single mitered end and a straight-cut end. The straight-cut end of formed beam 110(*c*) allows for a clean transition to formed beam 110(*d*). Formed beam 110(*d*) includes a straight-cut end on both side of the beam.

In some implementations, the system may include one or more formed horizontal or cross beams 112(*a*)-(*b*). As shown on structure 100, the cross beams 112(*a*)-(*b*) may connect multiple formed beams 110(*a*)-(*h*) at one of the formed inline posts 108(*a*)-(*d*). The cross beams 112(*a*)-(*b*) may be constructed in a "t" shape and provide rigidity to the structure 100. As with other beams and post described in this system, the cross beams 112(*a*)-(*b*) may be eight (8) feet, ten (10) feet, or twelve (12) feet long. In other implementations, each cross beam may be from at least two (2) feet to about fourteen (14) feet long. In some implementations, one or more of the cross-beams 112(*a*)-(*b*) may be a formed cross beam assembly including two or more formed members. For example, one or more of the cross-beams 112(*a*)-(*b*) may be formed of a first formed member attached to a second formed member. For example, the first formed member may be constructed in a first "L" shape and the second formed member may be constructed in a second "L" shape, and when constructed the attached first and second "L" shaped members form a "t" shape providing rigidity to the structure 100.

In some implementations, the structure 100 may also include one or more formed knee brace 114. Each formed knee brace may be located at a confluence of an inline beam 108(*a*)-(*d*) and a formed steel beams 110(*a*)-(*h*) to provide additional structural support. In addition, each formed knee brace 114 may also help square the attachment of the inline beam 108(*a*)-(*d*) and a formed steel beams 110(*a*)-(*h*).

Figure 2:
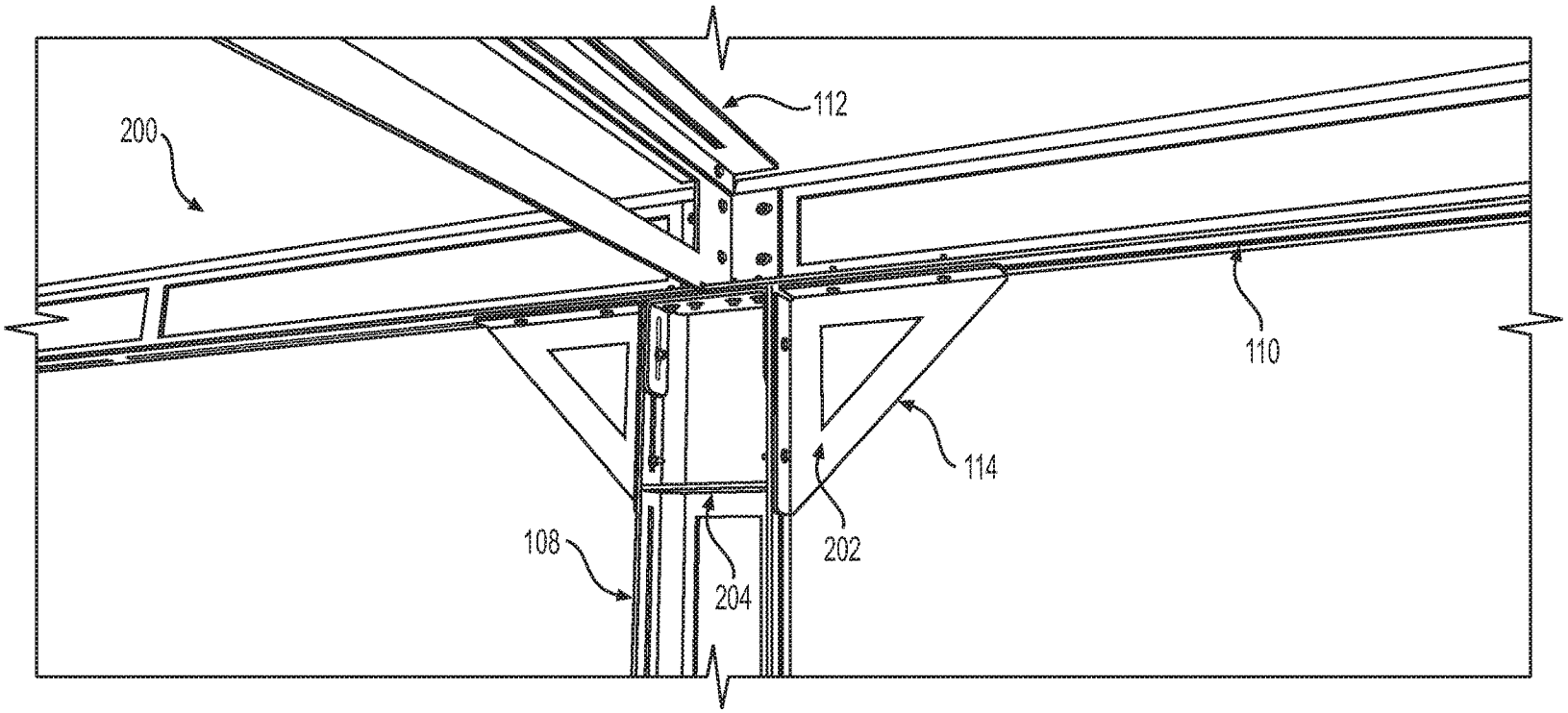
FIG. 2 depicts an example configuration of an inline convergence of the multiple components of the post and beam system.

FIG. 2 shows an expanded view 200 of the area of the structure 100 where the knee brace 114 is attached to the formed inline post 108 and formed beam 110. FIG. 2 also shows the formed cross beams 112 as attached to the formed beam 110.

In addition, FIG. 2 shows a formed inline post top cap 202. In some implementations, the inline post top cap 202 may secure two formed beams 110. In some instances, the formed beams 110 may be any configuration (i.e., straight-end, single-miter, or double-miter). The inline post top cap 202 may also secure the two formed beams 110 to the formed inline post 108.

An inline post support gusset 204 is also shown within the formed inline post 108. In some instance, inline post support gusset 204 may be welded into the formed inline post 108. In other instances, the formed inline post 108 may be constructed with groove and/or other support to hold the inline post support gusset 204 in place without hardware. However, in other implementations, the inline post support gusset 204 may be held in place with a clip or other hardware. The inline post support gusset 204 may strengthen the rigidity of the formed inline post 108. For instance, the inline post support gusset 204 may help the inline post 108 from rotational forces such as torsion.

As shown in FIG. 2, the attachment of select components of the system may be attached with known hardware (e.g., bolts, washers, and nuts). However, the components may be attached with any known methods, such as rivets, welds, and/or clips.

FIG. 2 also illustrates that several components, such as the inline post top cap 202, include a long groove for placement of the hardware. In some implementations, the long groove may allow for easier assembly of the structure 100.

Figure 3:
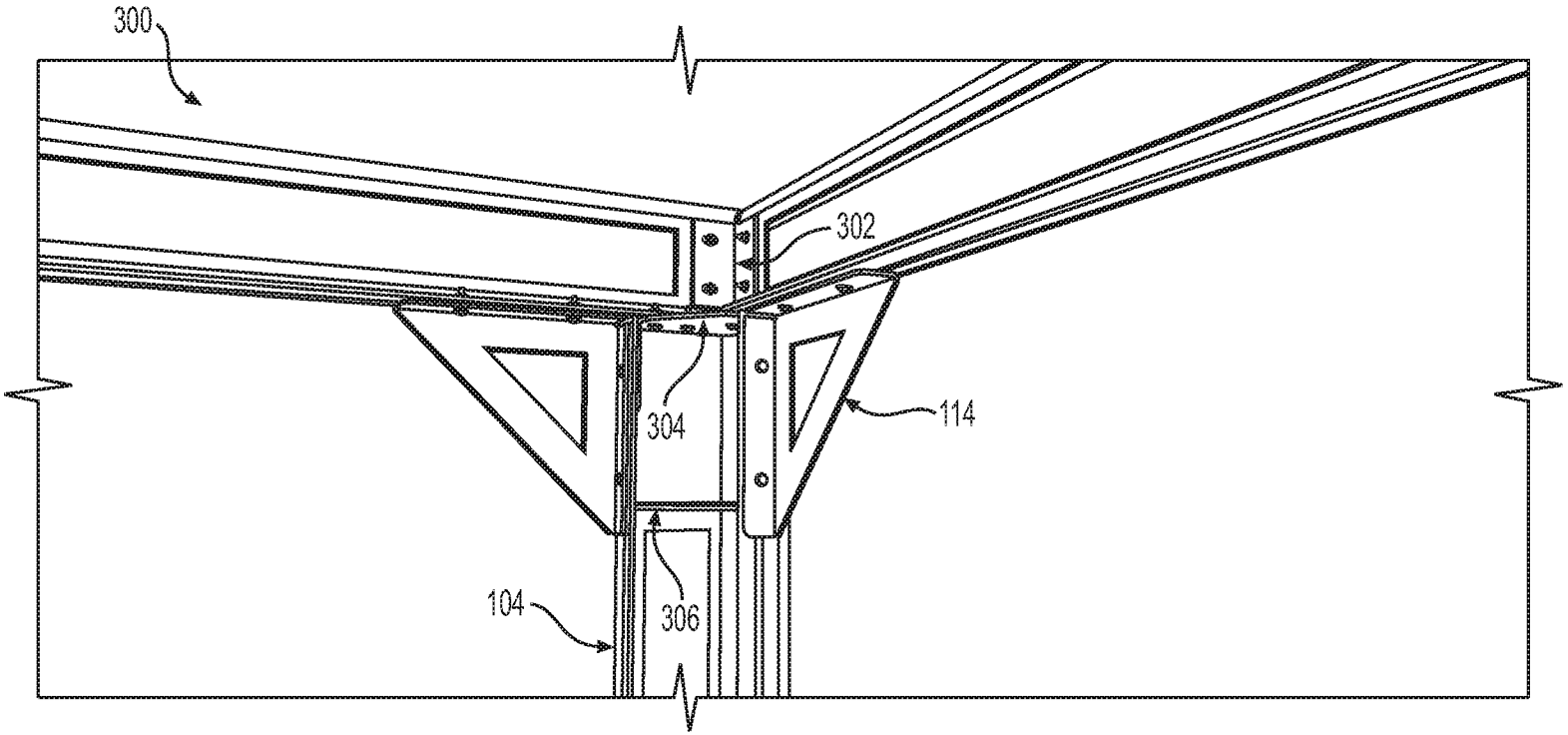
FIG. 3 depicts an example configuration of a corner convergence of the multiple components of the post and beam system.

FIG. 3 shows an expanded inner view 300 of the component of a corner of structure 100. As shown, the knee braces 114 attached the corner post 104 to the formed beams 110. FIG. 3 shows a formed bracket 302 to attach the mitered end of the formed beams 110 to form a corner of structure 100.

In addition, FIG. 3 shows a formed corner post top cap 304. The formed corner post top cap 304 may be configured to match the shape of the corner post. In some implementations, the corner post top cap 304 may secure two formed beams 110. In some instances, the formed beams 110 may be any mitered configuration (i.e., single-miter, or double-miter). The corner post top cap 304 may also secure the two formed beams 110 to the formed corner post 104.

A corner post support gusset 306 is also shown within the formed corner post 104. In some instance, corner post support gusset 306 may be welded into the formed corner post 104 at predetermined locations. In other instances, the formed corner post 104 may be constructed with groove and/or other support to hold the corner post support gusset 306 in place without hardware. However, in other implementations, the corner post support gusset 306 may be held in place with a clip or other hardware. The corner post support gusset 306 may strengthen the rigidity of the formed corner post 104. For instance, the corner post support gusset 306 may help the corner post 104 from rotational forces such as torsion. The number of corner post support gussets 306 placed with the corner post 104 may be directly proportional to the length of the corner post 104. For instance, a longer corner post 104 may have more support gussets than a shorter corner post 104. As described below, a support gusset (either inline or corner) may be located on the inner portion of a post (either inline or corner) at an area between the large rectangular openings. In this instance, the support gusset may not be completely visible from outside a structure.

Figure 4:
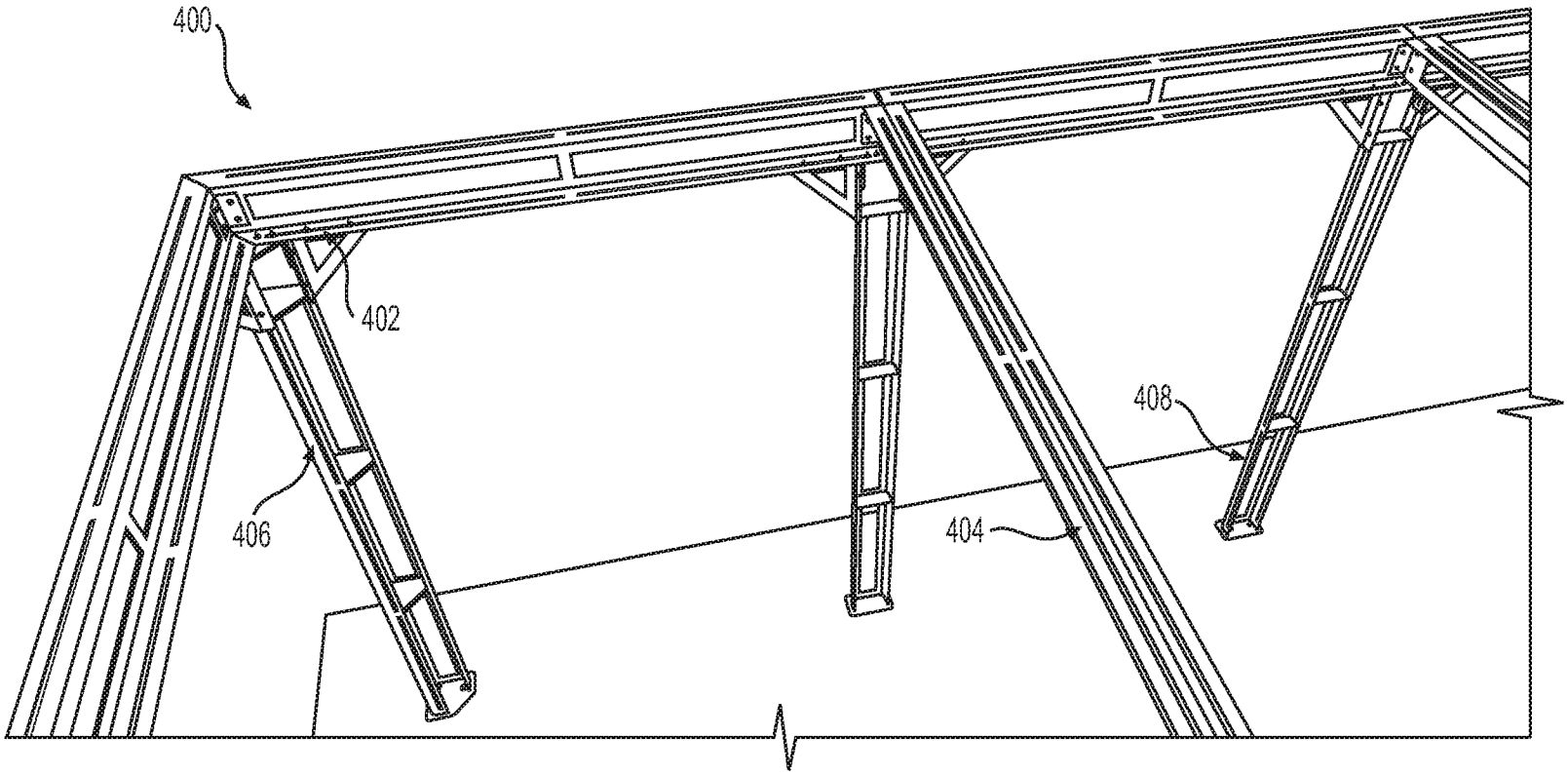
FIG. 4 depicts an example configuration of the post and beam system from above.

FIG. 4 shows a top perspective view 400 of a portion of structure 100. FIG. 4 illustrates the slots 402, 404, 406, and 408 on each of the formed beam 110, cross beam 112, formed corner post 104, and inline post 108.

As described above, the slots provide may benefits to the structure 100. For instance, they reduce structural weight and bulk without compromising strength of the structure. As show in slot 402, the slot allows for easy attachment of the components (e.g., a knee brace, and/or post top cap (inline or corner)) of the system. In some instances, the slots 406 on a corner post and slot 408 on an inline post (and/or slot 402 of beam 110) allow for attachment of a panel to create a wall, barrier, or enclosure feature of structure 100. In some instances, slots 402 of the formed beam 110 and/or slot 404 of the cross beam 112 may allow for attachment of any number of system accessories such as those described above. Since the slots 402 and 404 are parallel to the substrate they allow one or more accessories to be easily hung from the structure 100. In some instances, an accessory may be secured to any combination of the slots of the post and beam described as part of this system.

Figure 5:
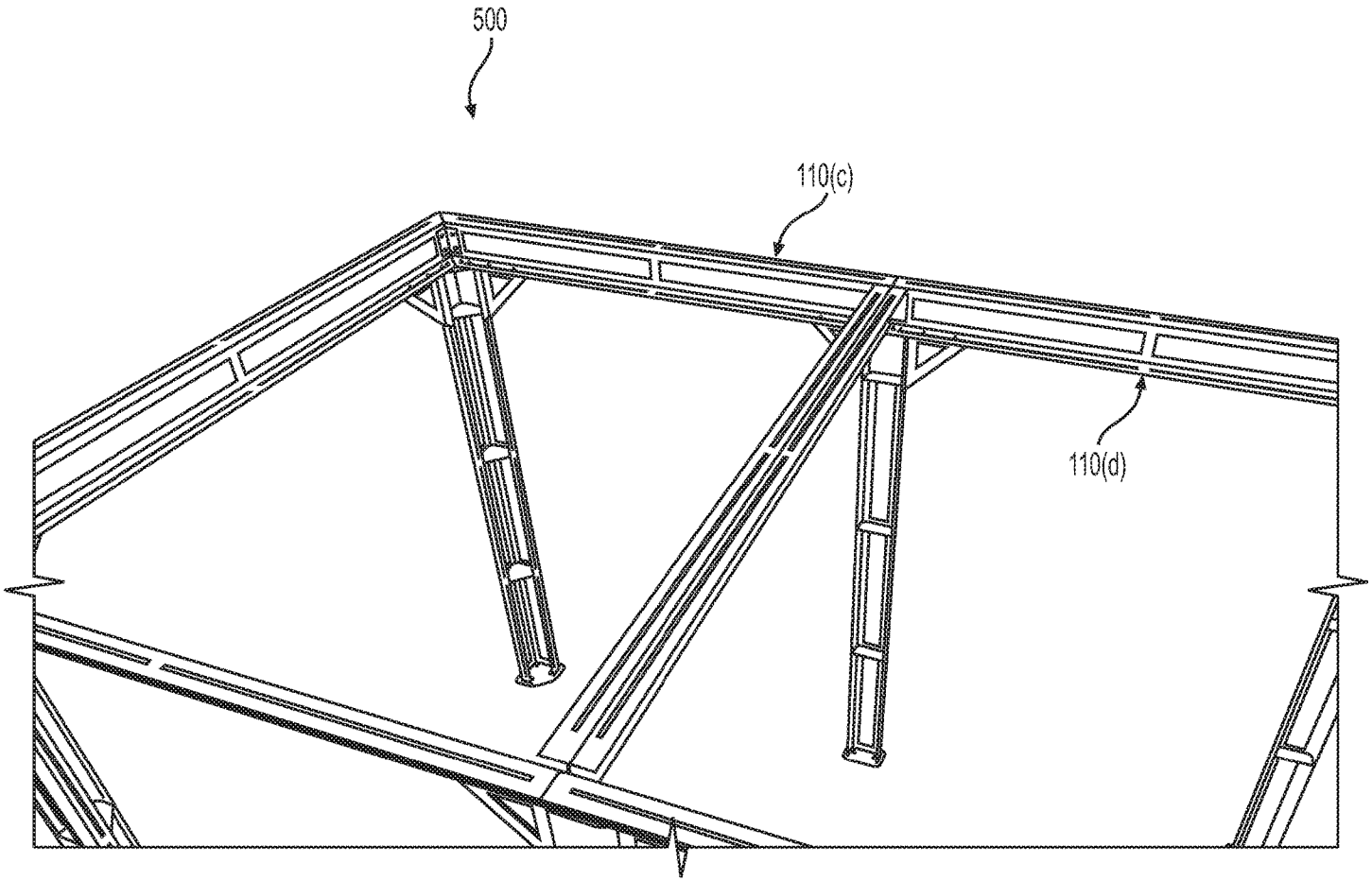
FIG. 5 depicts an example configuration of the post and beam system from above.

FIG. 5 shows another top perspective view 500 of a portion of structure 100. FIG. 5 illustrates the single-miter beam 110(*c*) and a—straight—cut beam 110(*d*) of the system.

The system may also include a post extender component or vertical post coupler (not shown) to attach to an end of a first post (e.g., corner post or inline post) and an end of a second post. In some instance, the post extender component may provide a solution when the height of a structure requires longer posts. For instance, the post extender component may be used to attach a first eight (8) foot post with a second eight (8) foot post to create a structure that has an overall post length of sixteen (16) feet.

In some implementations, a post extender component or a horizontal beam coupler may secure a cross beam to provide structural support of the structure. In addition, the cross beam can be used to attach one or more accessories to the structure as described above.

In some implementations, the post extender components may be used where the system or structure has an asymmetrical shape. For instance, one or more post extender component may be applied to a corner post on a first side of the structure when a sloped roof configuration is desired.

Example Components of the Post and Beam System

Figure 6:
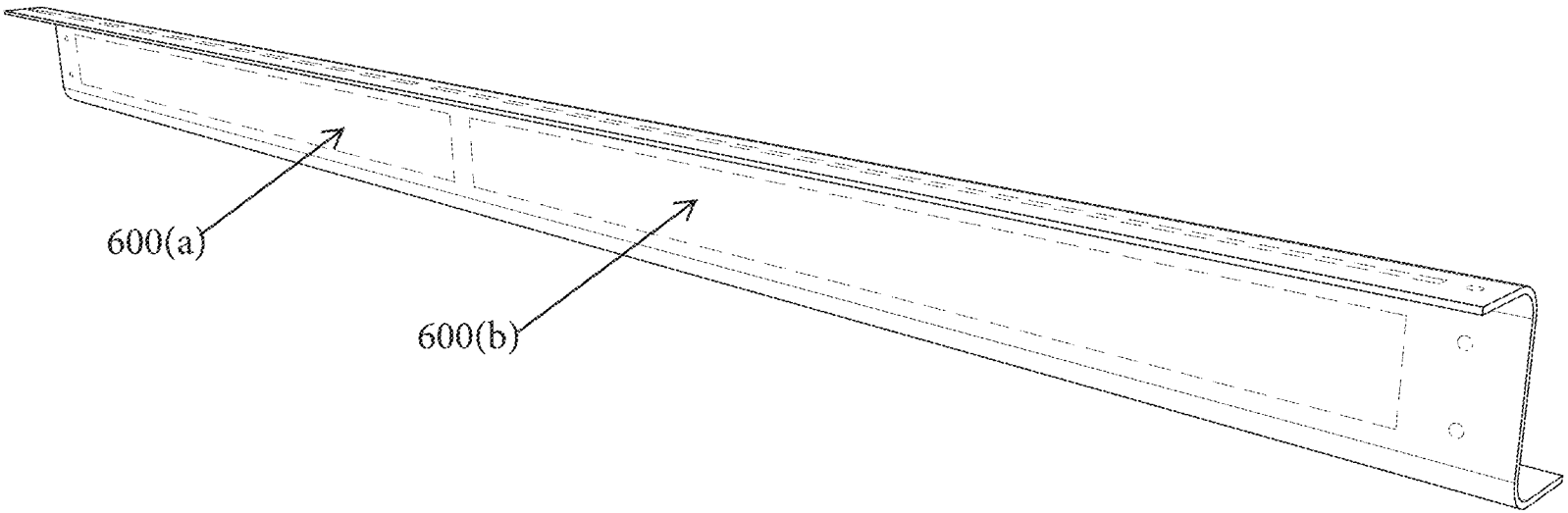
FIGS. 6-13 illustrate example views of a formed beam of the post and beam system.
Figure 85:
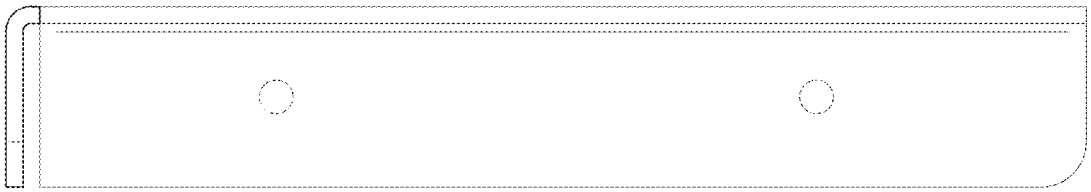

FIGS. 6-85 illustrate example views of non-limiting components of the beam and post system. The figures shown select features of each component in broken or dashed lines. The broken lines represent features of each components which may or may not form part of any claimed design.

Each component of the system is constructed on a single piece of material (e.g., 1-4-inch steel) which is bent, formed, and/or cut into the particular shape of the component. Therefore, each component does not have any extra locations for stress failure, tearing, shearing, ripping, etc.

In some implementations, the system of this disclosure may include all of the components described herein. In some instances, the system may include only a sub-set of components described herein. Further, in other instances, the system may include other components (e.g., the post extender) not shown in this disclosure.

In some implementations, the system of this disclosure may withstand at least 5 pounds per square foot (PSF) dead load for an additional structure (e.g., a wood or other material roof structure) on top of the structure.

FIGS. 6-13 illustrate example views of a formed beam of the post and beam system. As described above, the formed beam may have a "s" shape to provide strength and rigidity to the beam. Furthermore, in some instances, the beam may have a straight end (as illustrated), a single-mitered end and a straight end, or two mitered ends.

As shown in FIG. 6, the beam may have multiple large opened areas 600(*a*)-(*b*). As shown, the opened areas are a rectangle. However, other shapes are envisioned. For instance, each opened area may be an oval, a triangle, a rectangle with rounded corners, etc. In some embodiments, the dimensions of each opened area may be 42½ inches by 4 inches for an eight (8) foot beam, from about 31¼ inches to about 43¼ inches by 4 inches for a ten (10) foot beam, or from about 43¼ inches to about 45¼ inches by 4 inches for a twelve (12) foot beam.

Figure 7:
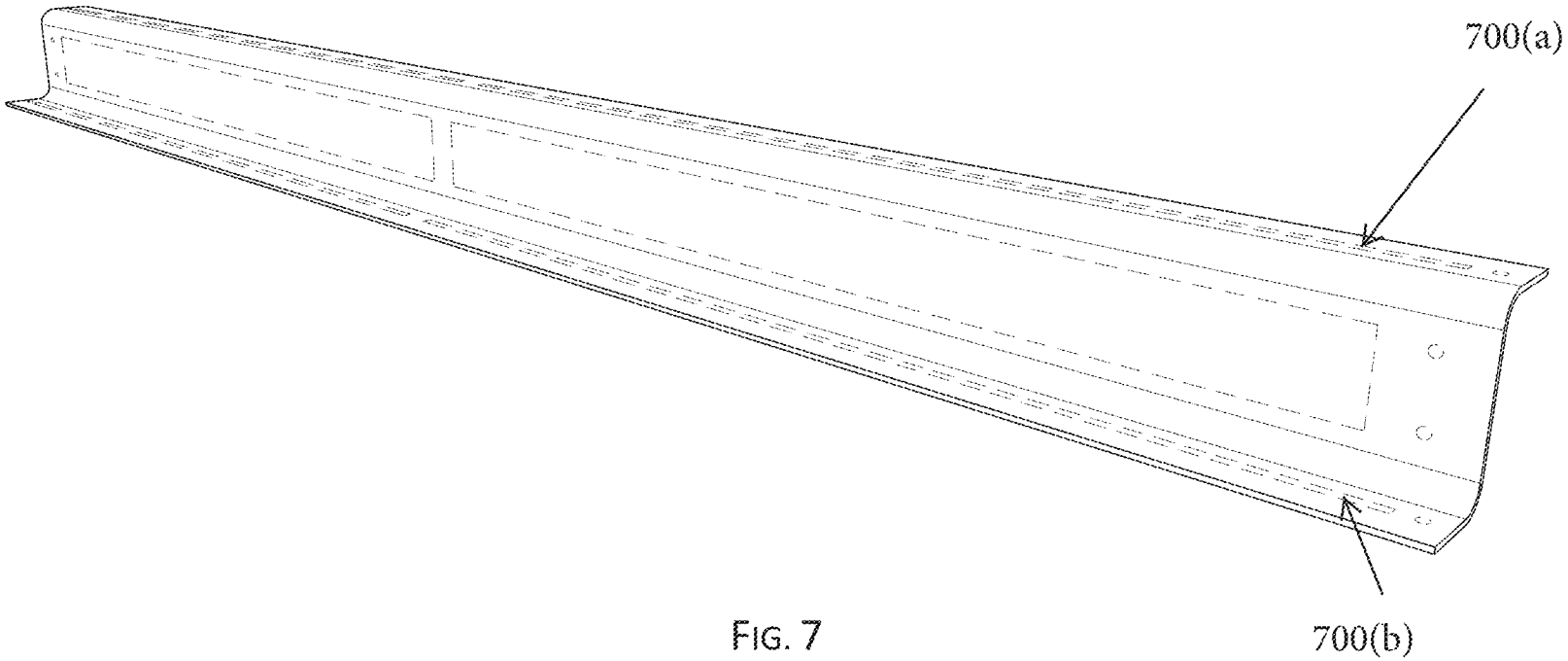
Figure 8:
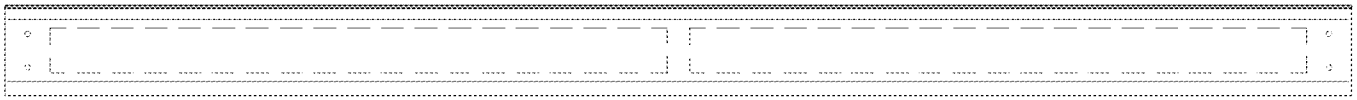
Figure 9:
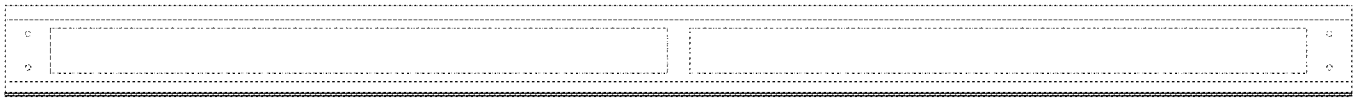
Figure 10:
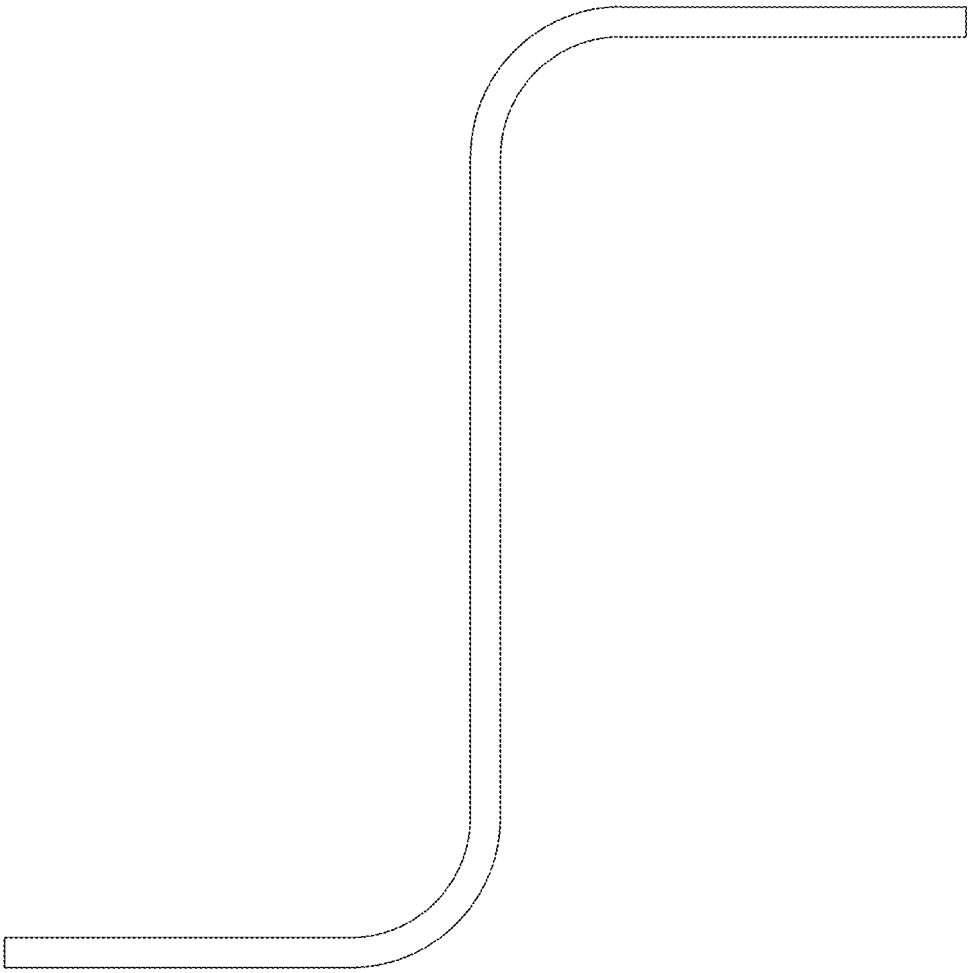
Figure 11:
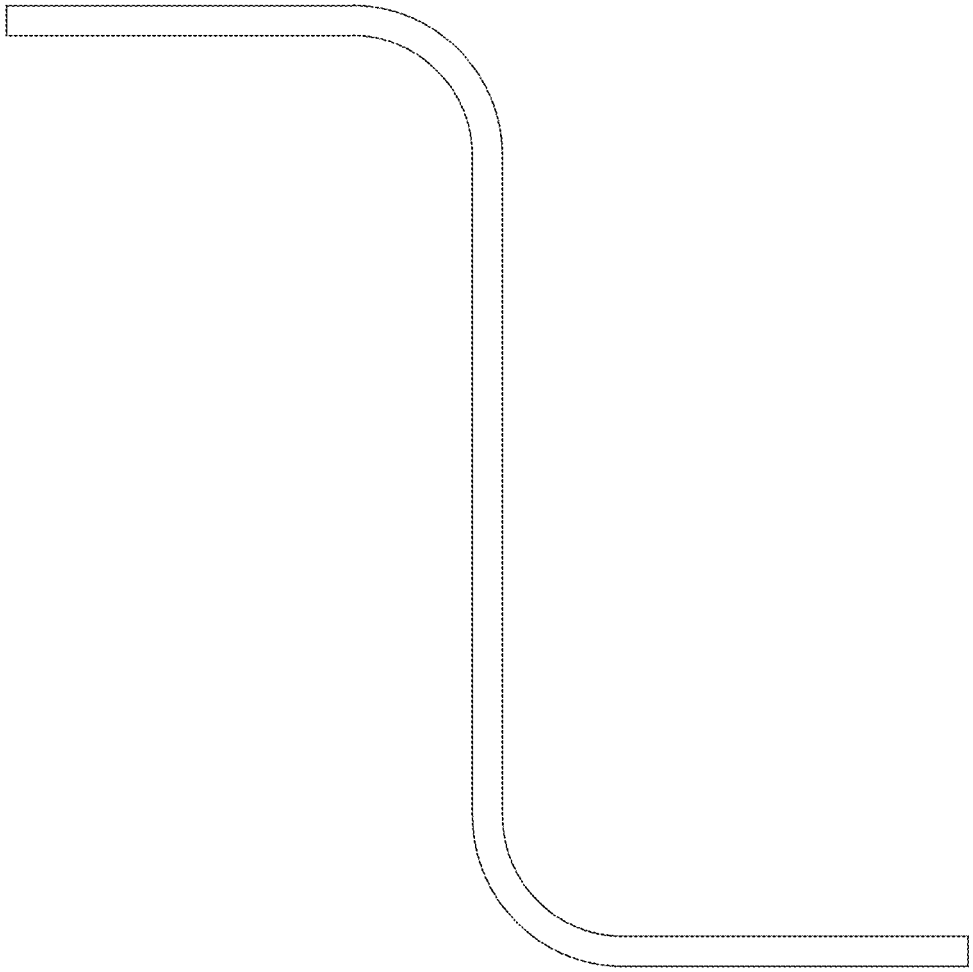
Figure 12:
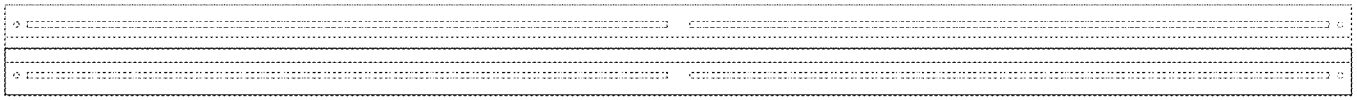
Figure 13:
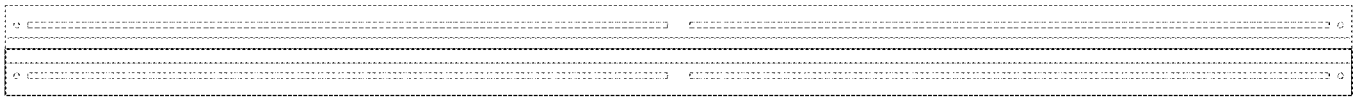

FIG. 7 illustrates the slots 700(*a*)-(*b*) which may substantially run the length of the beam. The dimensions of each slot may be 44½ inches by ½ inch for an eight (8) foot beam, from about 33¼ inches to about 43¼ inches by ½ inch for a ten (10) foot beam, or from about 45¼ inches to about 43¼ inches by ½ inch for a twelve (12) foot beam. As described above, the slots 700(*a*)-(*b*) may allow for attachment hardware, braces, brackets, system accessories, panels, etc. In some embodiments the slots 700(*a*)-(*b*) may be smaller slotted holes each having smaller dimensions than the dimensions described above.

FIGS. 14-21 illustrate example views of a formed corner post of the post and beam system. Similar to the beams, the corner post includes several large opened areas 1400(*a*)-(*b*). These opened areas may reduce the bulk and weight of the system without sacrificing strength. In some embodiments, the dimensions of each opened area may be 25⅛ inches, 26½ inches, and 26 inches by 4 inches for an eight (8) foot post, 33⅛ inches, 34½ inches, and 34 inches by 4 inches for a ten (10) foot post, or 41⅛ inches, 42½ inches, and 42 inches by 4 inches for a twelve (12) foot post.

Figure 15:
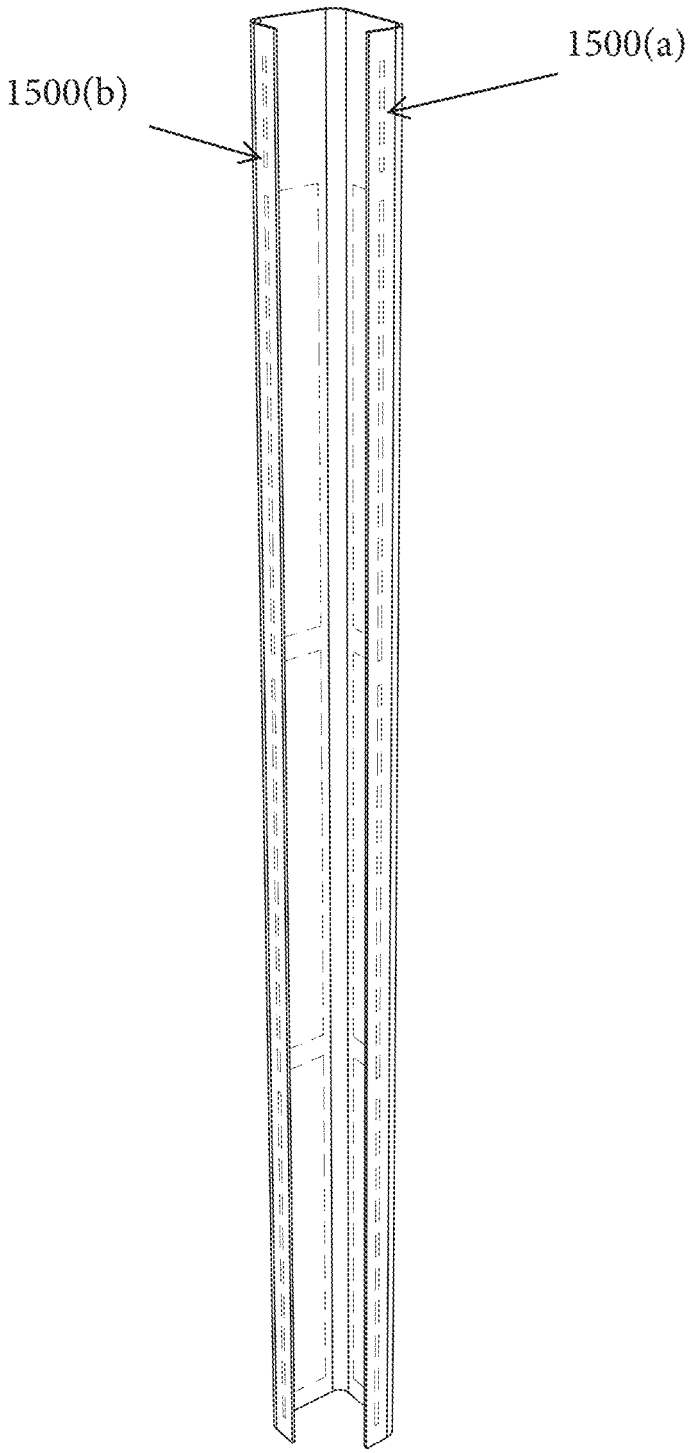
Figure 16:
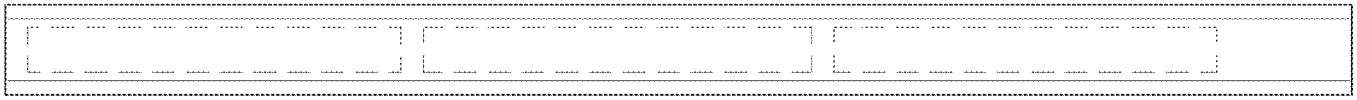
Figure 17:
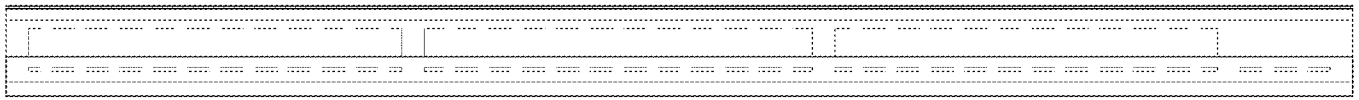
Figure 18:
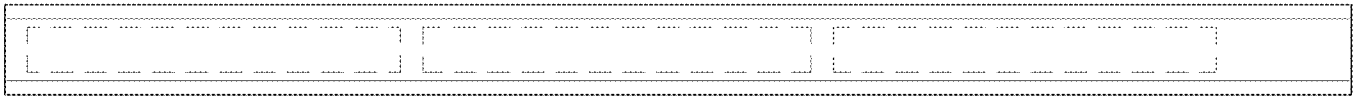
Figure 19:
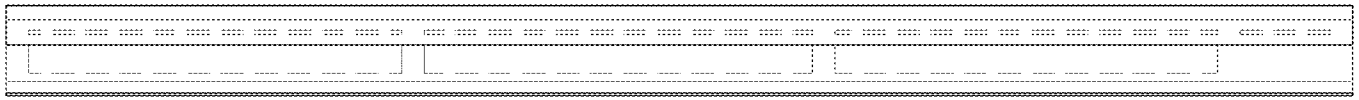
Figure 20:
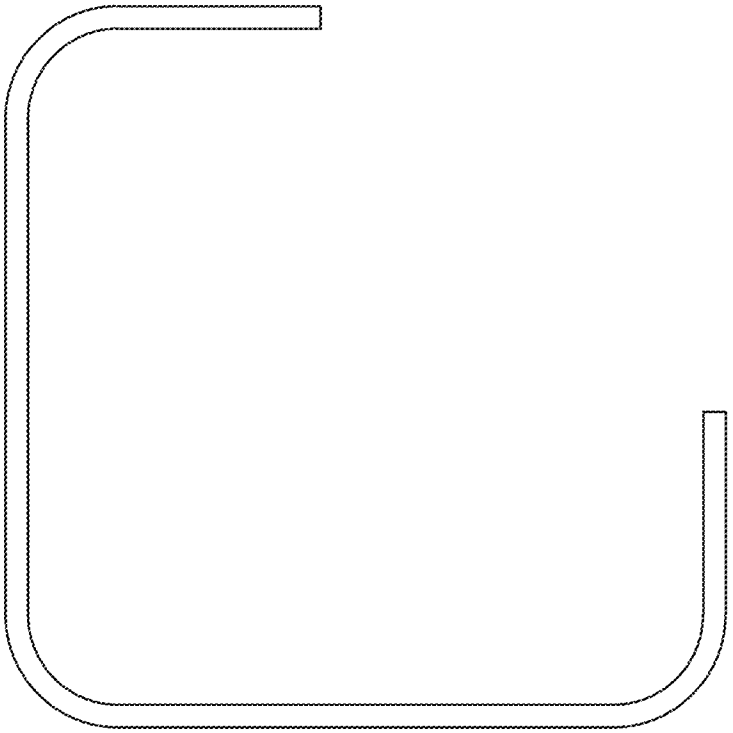

FIG. 15 illustrates the slots 1500(*a*)-(*b*) on the example corner post. As described above, the slots may allow for attachments of hardware, braces, brackets, system accessories, panels, railing, etc.

FIG. 21 illustrates a top view of the example corner post. As shown, the corner post has a squared off "A" shape. In some implementations, the shape of the corner post (and inline post) may allow for efficient thru fastener connection. For instance, there may be no need to worry about drilling and tapping holes into tube steel or stripped threads. For instance, there may be no need to worry about drilling holes through wood posts. As described, herein a fastener may be located along the slotted opening in post flanges with ease of access at front and reverse side of flange. In addition, the shapes of the posts reduce weight while maintaining structural ability to support system, as well as provide an aesthetic value to component unique from common steel shapes and wood posts.

FIGS. 22-29 illustrate example views of a corner post base plate of the post and beam system. As with other components of the beam and post system, the corner post base plate may be constructed of ⅜ inch steel that has been powder-coated to resist weather. In other implementation, the corner post base plate (or any other component of the beam and post system) may be constructed of materials other than steel. For instance, the components may be constructed of laminated wood products, composite laminates (e.g. carbon fiber), plastic, or other metals.

FIGS. 30-37 illustrate example views of a corner post support gusset of the post and beam system. As described above, the corner post support gusset may be located on an inner portion of each corner post between the location of the large opened areas. Each corner post support gusset may have a shape corresponding to the inner portion of the corner post.

FIGS. 38-45 illustrate example views of a formed corner post top cap of the post and beam system. As shown, the corner post top cap includes four openings on the top surface. These openings may allow for the hardware to be placed thought the top cap to secure the beams to the top cap.

In some instances, the corner top cap includes two flanges that extend perpendicular to the top surface. Each flange may include a groove to allow hardware (e.g., a mechanical fastener) to secure the top cap, corner post, beam, and knee brace together.

FIGS. 46-53 illustrate example views of a formed inline post of the post and beam system. Similar to the beams and corner posts described above, the inline post includes the large opened areas. These opened areas may reduce the bulk and weight of the system without sacrificing strength. In some embodiments, the dimensions of each opened areas may be 25⅛ inches, 26½ inches, and 26 inches by 4 inches for an eight (8) foot post, 25⅛ inches, 26½ inches, and 26 inches by 4 inches for a ten (10) foot post, or 41⅛ inches, 42½ inches, and 42 inches by 4 inches for a twelve (12) foot post.

FIGS. 54-61 illustrate example views of an inline post base plate of the post and beam system. As shown, the base plate may have multiple openings to allow for hardware to secure the base plate and inline post to a substrate.

FIGS. 62-69 illustrate example views of an inline post support gusset of the post and beam system. As described above, the inline post support gusset may be located on an inner portion of each inline post between the location of the large opened areas. Each inline post support gusset may have a shape corresponding to the inner portion of the inline post.

FIGS. 70-77 illustrate example views of a formed inline post top cap of the post and beam system. As shown, the inline post top cap includes four openings on the top surface. These openings may allow for the hardware to be placed through the inline top cap to secure the straight end of the formed beams to the top cap.

In some instances, the inline top cap includes two flanges that extend perpendicular to the top surface. Each flange may include a groove to allow hardware to secure the top cap, inline post, and one or more knee braces together.

FIGS. 78-85 illustrate example views of a formed knee brace of the post and beam system. The knee brace includes a triangular opening. However, in other implementations, the opening may include a different shape. In other implementations, the opening on the knee brace may include a decorative pattern as described above.

FIGS. 86-91 illustrate example views of another embodiment of a formed beam of the post and beam system. As described above, the formed beam may have a "s" shape to provide strength and rigidity to the beam. Furthermore, in some instances, the beam may have a straight end (as illustrated), a single-mitered end and a straight end, or two mitered ends.

Figure 86:
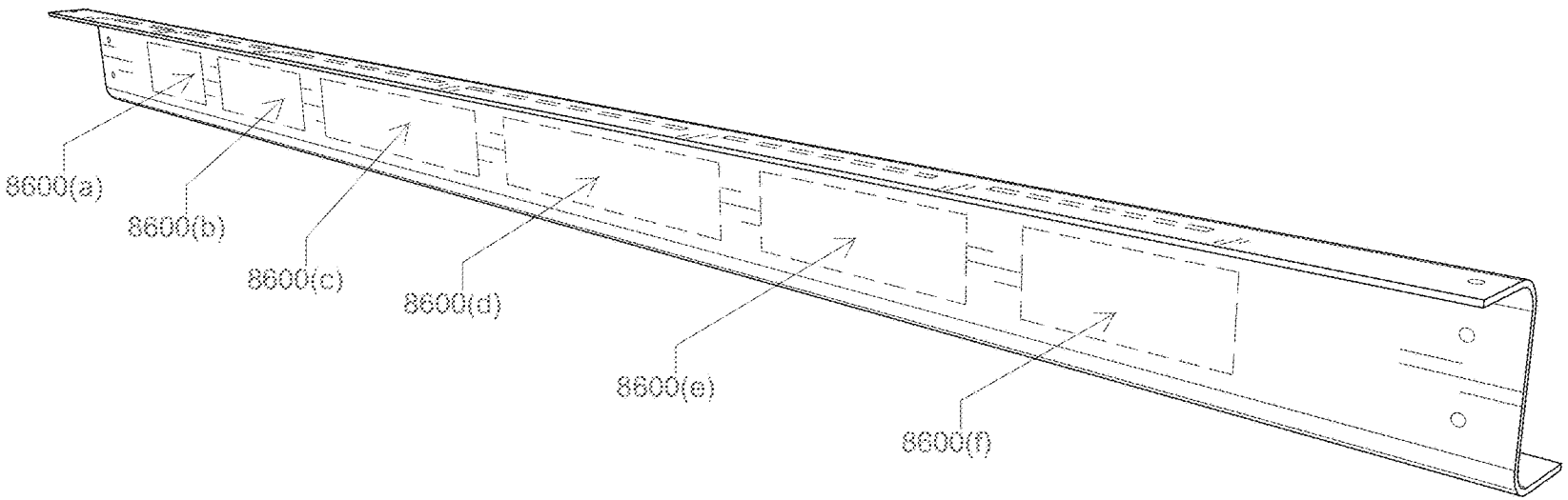
FIGS. 86-91 illustrate example views of another embodiment of a formed beam of the post and beam system.

As shown in FIG. 86, the beam may have multiple large opened areas 8600(*a*)-(*f*). As shown, the opened areas are a rectangle. However, other shapes are envisioned. For instance, each opened area may be an oval, a triangle, a rectangle with rounded corners, etc. In some embodiments, the dimensions of each opened area may vary in length. For example, the dimensions of each opened area may range from a shortest length at the ends of the beam to a longest length at the middle of the beam.

Figure 87:
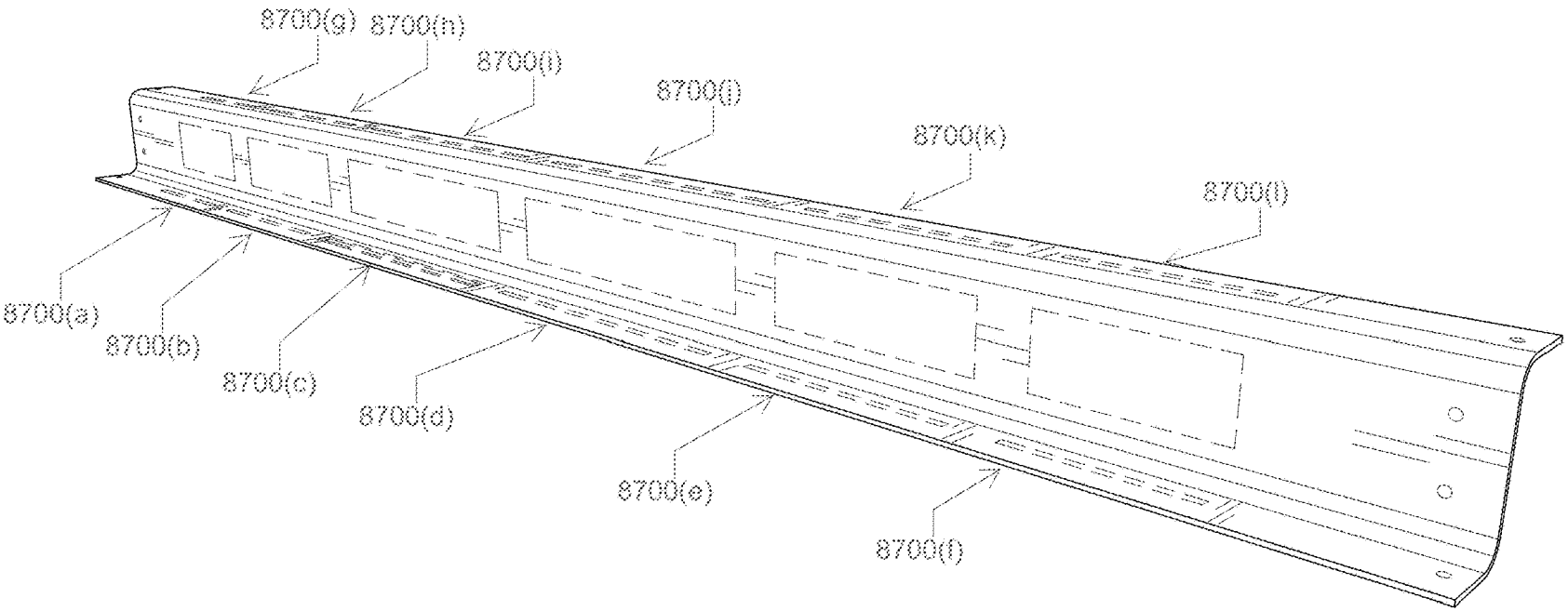
Figure 88:
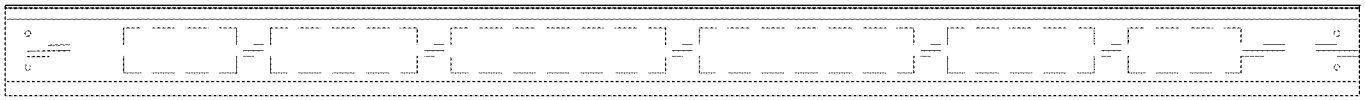
Figure 89:
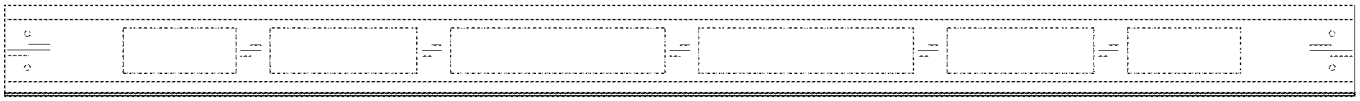
Figure 90:
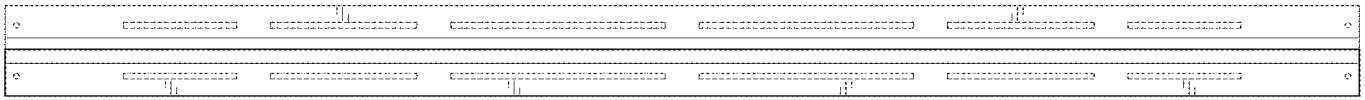
Figure 91:
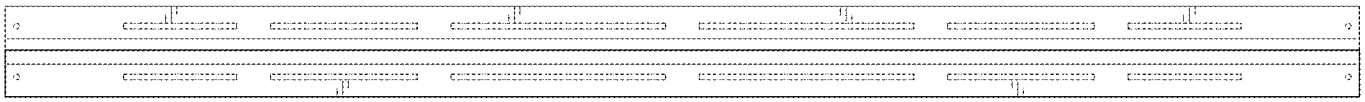

FIG. 87 illustrates the slots 8700(*a*)-(*f*) which may substantially run the length of the beam in a first flange, and the slots 8700(*g*)-(*l*) which may substantially run the length of the beam in a second flange. Similar to the open areas 8600(*a*)-8600(*f*), the dimensions of each slot may vary in length. For example, the dimensions of each slot may range from a shortest length at the ends of the beam to a longest length at the middle of the beam. As described above, the slots 8600(*a*)-(*l*) may allow for attachment hardware, braces, brackets, system accessories, panels, etc.

FIGS. 92-99 illustrate example views of a first formed member of a formed cross beam assembly of the post and beam system. As illustrated, the first formed member may have a "L" shape to provide strength and rigidity to the beam. Furthermore, in some instances, the beam may have a straight end (as illustrated), a single-mitered end and a straight end, or two mitered ends.

Figure 92:
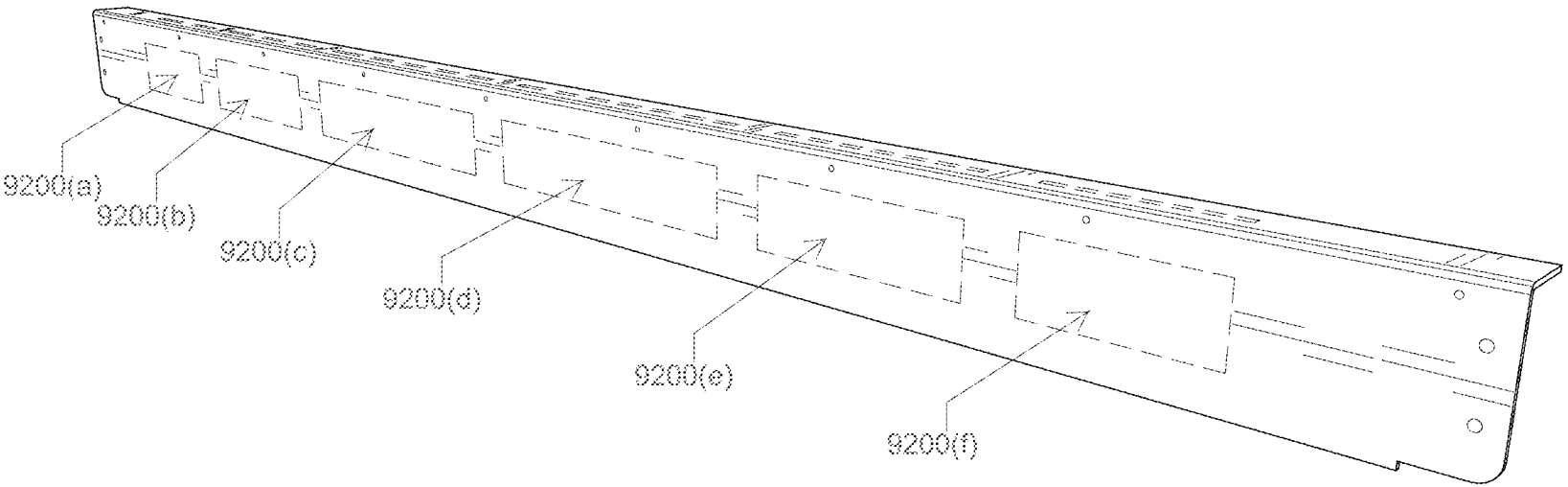
FIGS. 92-99 illustrate example views of a first formed member of a formed cross beam assembly of the post and beam system.
Figure 93:
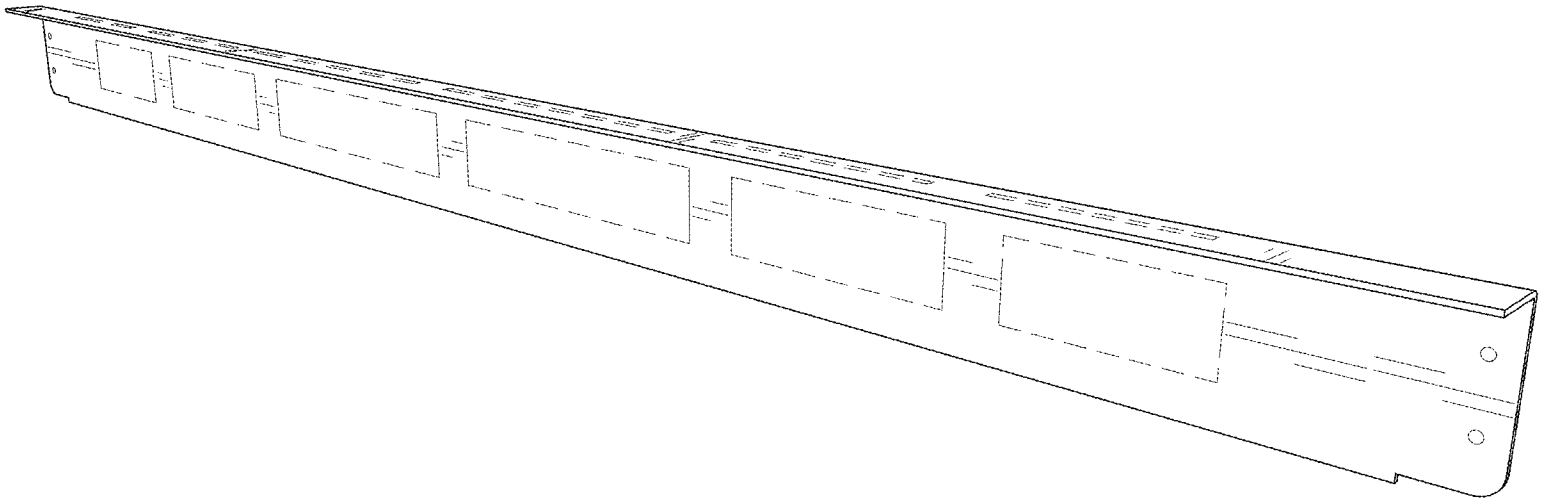
Figure 94:
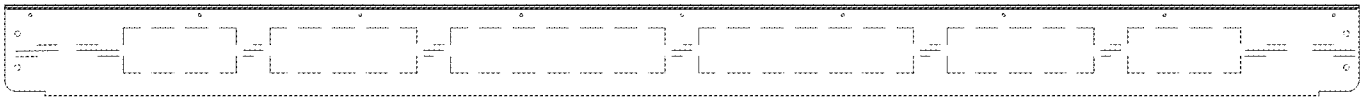
Figure 95:
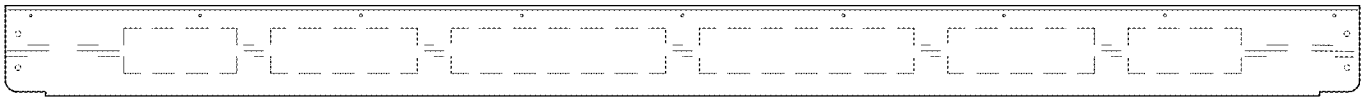

As shown in FIG. 92, the beam may have multiple large opened areas 9200(*a*)-(*f*). As shown, the opened areas are a rectangle. However, other shapes are envisioned. For instance, each opened area may be an oval, a triangle, a rectangle with rounded corners, etc. In some embodiments, the dimensions of each opened area may vary in length. For example, the dimensions of each opened area may range from a shortest length at the ends of the beam to a longest length at the middle of the beam.

Figure 96:
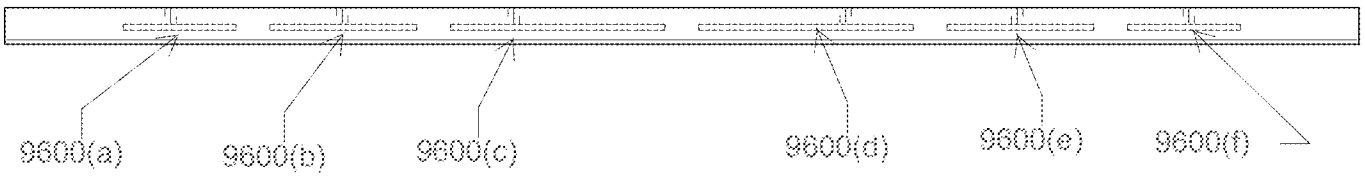
Figure 97:
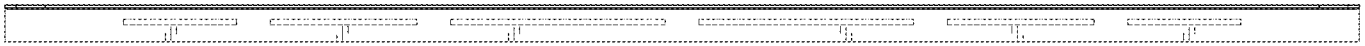
Figure 98:
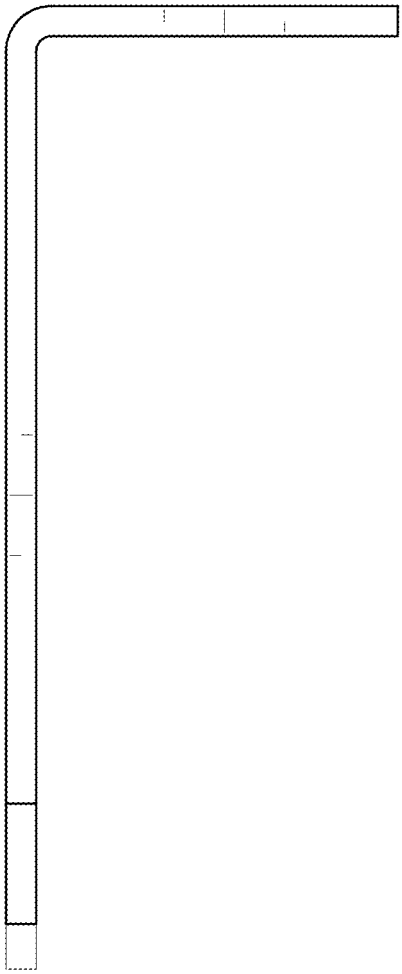
Figure 99:
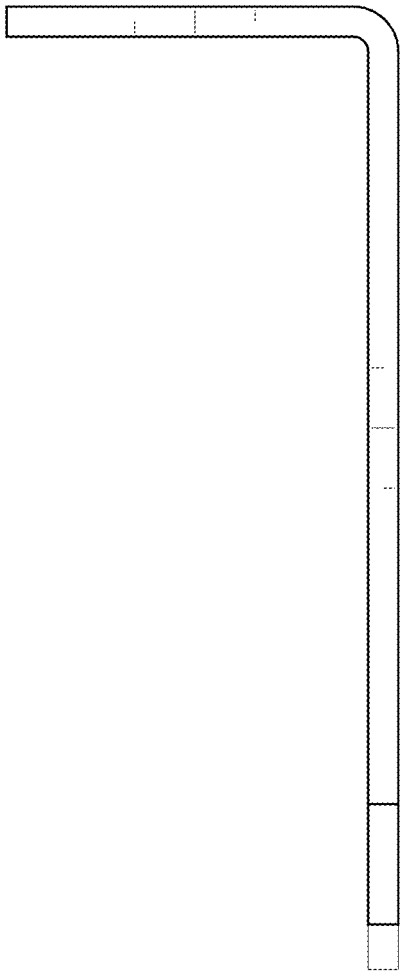

FIG. 96 illustrates the slots 9600(*a*)-(*f*) which may substantially run the length of the beam. Similar to the open areas 8600(*a*)-8600(*f*), the dimensions of each slot may vary in length. For example, the dimensions of each slot may range from a shortest length at the ends of the beam to a longest length at the middle of the beam. As described above, the slots 9600(*a*)-(*f*) may allow for attachment hardware, braces, brackets, system accessories, panels, etc.

FIGS. 100-107 illustrate example views of a second formed member of the formed cross beam assembly of the post and beam system. As illustrated, the second formed member may have a "L" shape to provide strength and rigidity to the member. Furthermore, in some instances, the member may have a straight end (as illustrated), a single-mitered end and a straight end, or two mitered ends. When the first formed member is attached to the second formed member, the assembled first and second formed members construct the formed cross beam assembly having a "t" shape providing rigidity to the structure 100.

Figure 100:
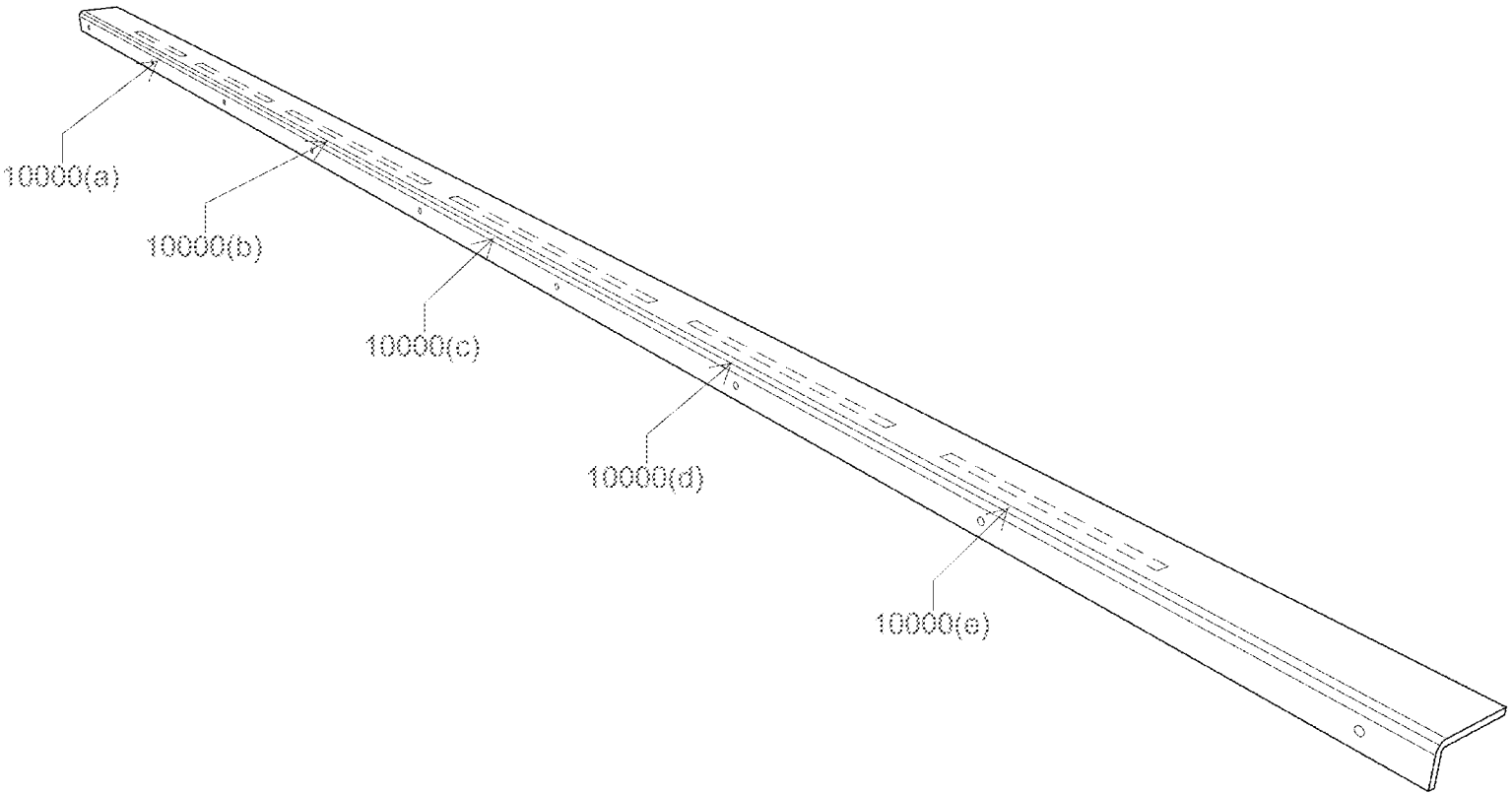
FIGS. 100-107 illustrate example views of a second formed member of the formed cross beam assembly of the post and beam system.
Figure 101:
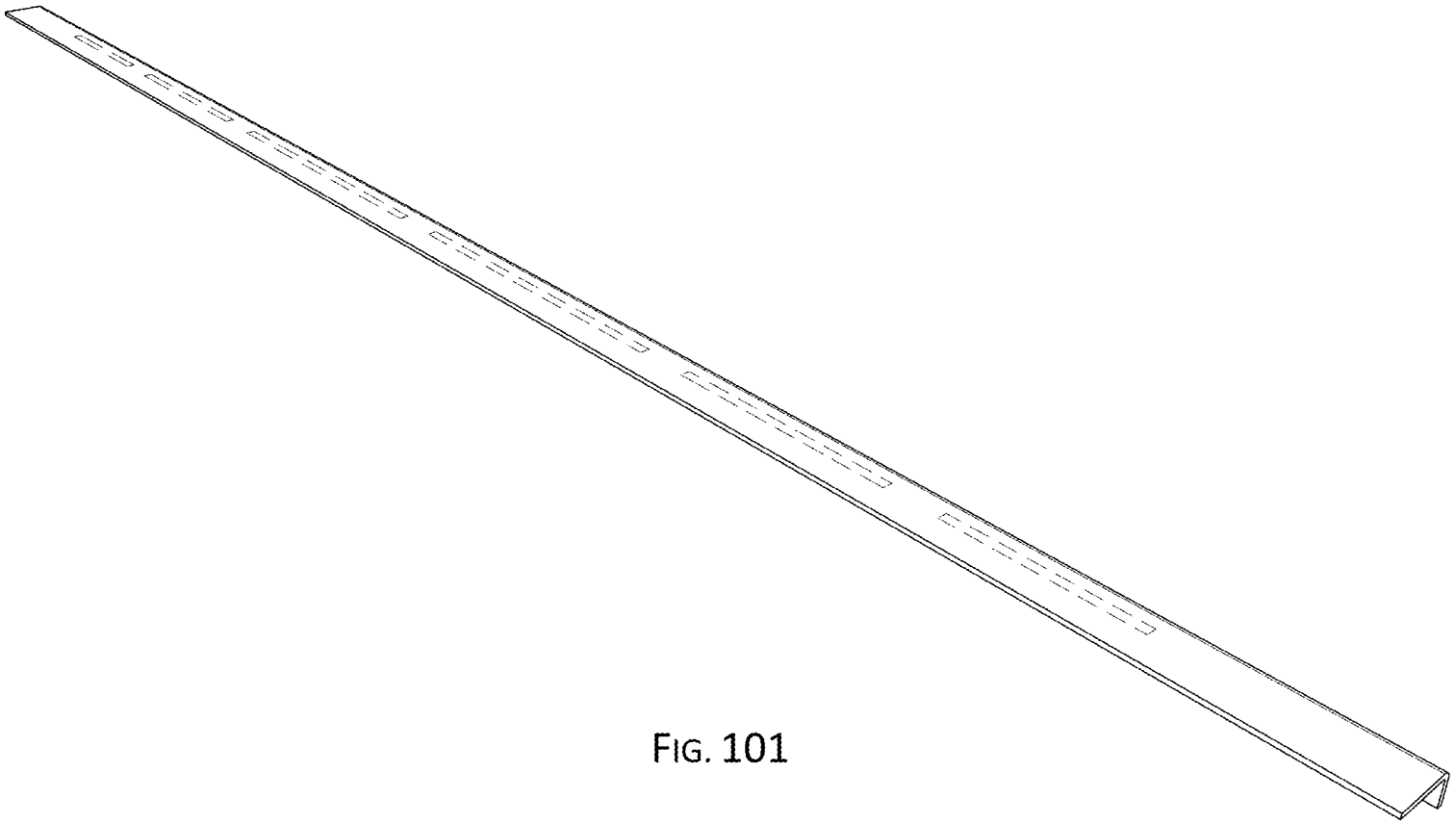
Figure 102:
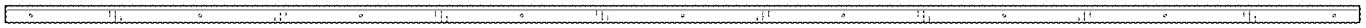
Figure 103:
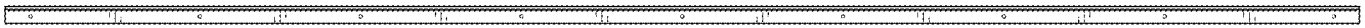

FIG. 100 illustrates the slots 10000(*a*)-(*e*) which may substantially run the length of the member. As described above, the slots 10000(*a*)-(*e*) may allow for attachment hardware, braces, brackets, system accessories, panels, etc.

Figure 104:
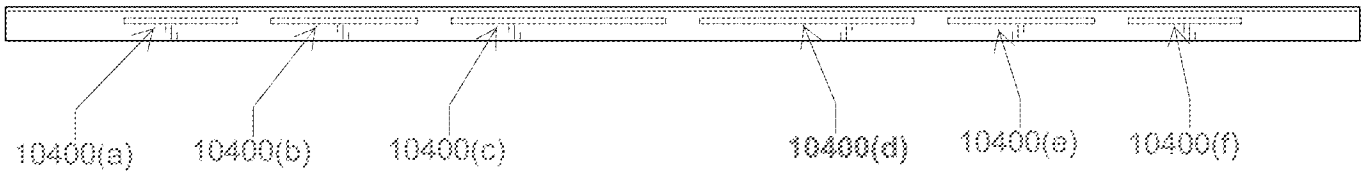
Figure 105:
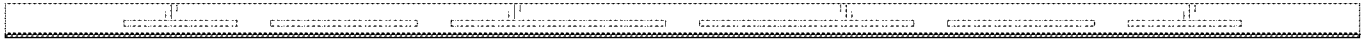
Figure 106:
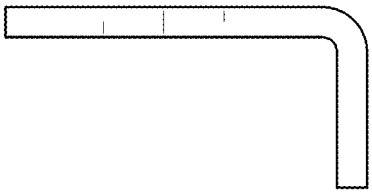
Figure 107:
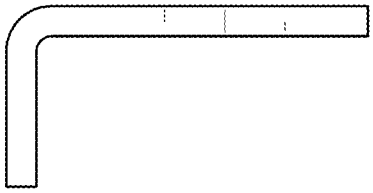

FIG. 104 illustrates the slots 10400(*a*)-(*f*) which may substantially run the length of the member. As shown, the dimensions of each slot may range from a shortest length at the ends of the beam to a longest length at the middle of the beam. As described above, the slots 10400(*a*)-(*f*) may allow for attachment hardware, braces, brackets, system accessories, panels, etc.

Figure 108:
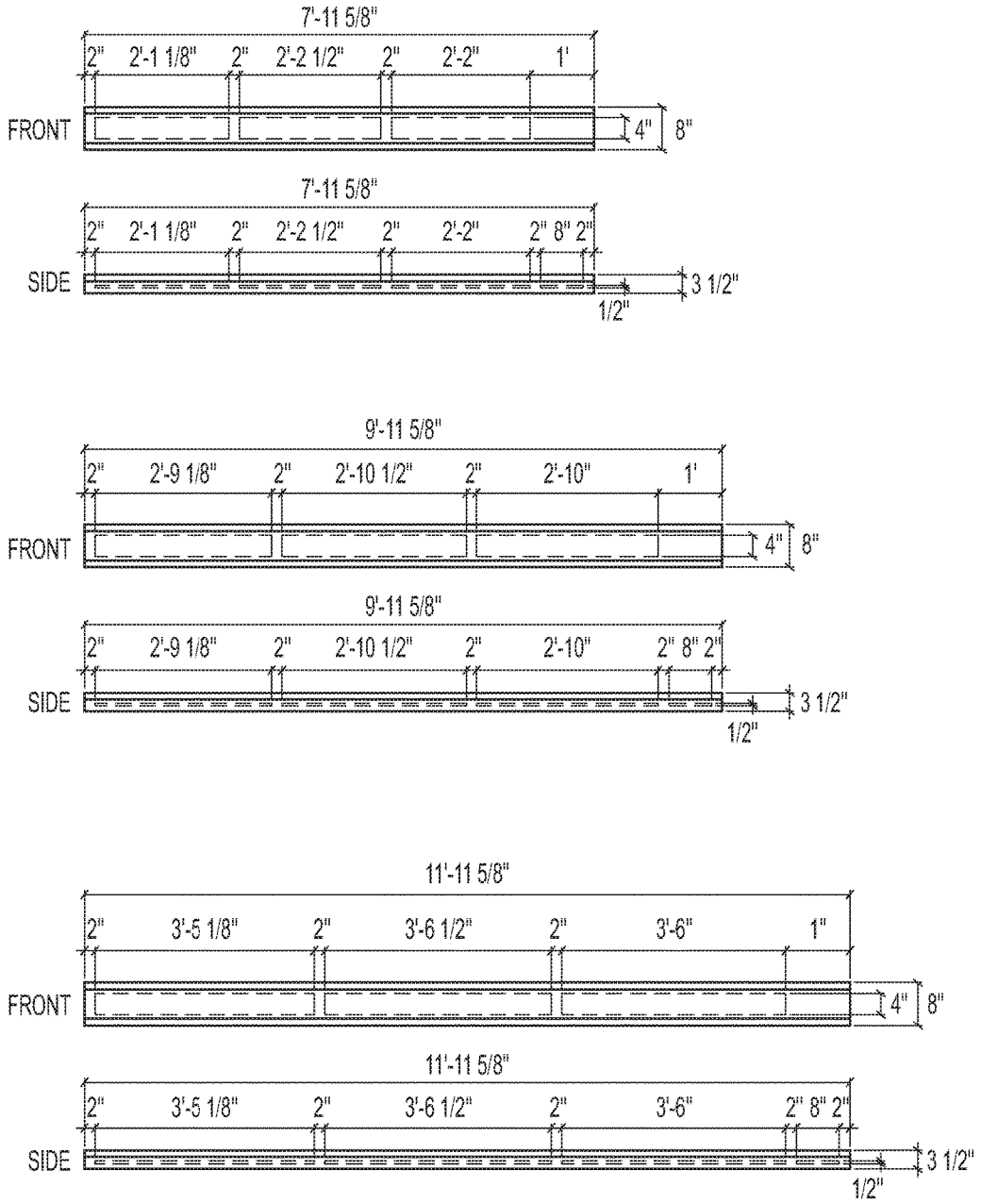
FIG. 108 illustrates example dimensions of an example formed inline post of the post and beam system.

FIG. 108 illustrates example dimensions of embodiments of formed inline posts of the post and beam system. As shown, the formed inline posts may have a length ranging from about 8 feet to about 12 feet. However, in other examples, the posts can be constructed from at least two (2) feet to about fourteen (14) feet.

Figure 109:
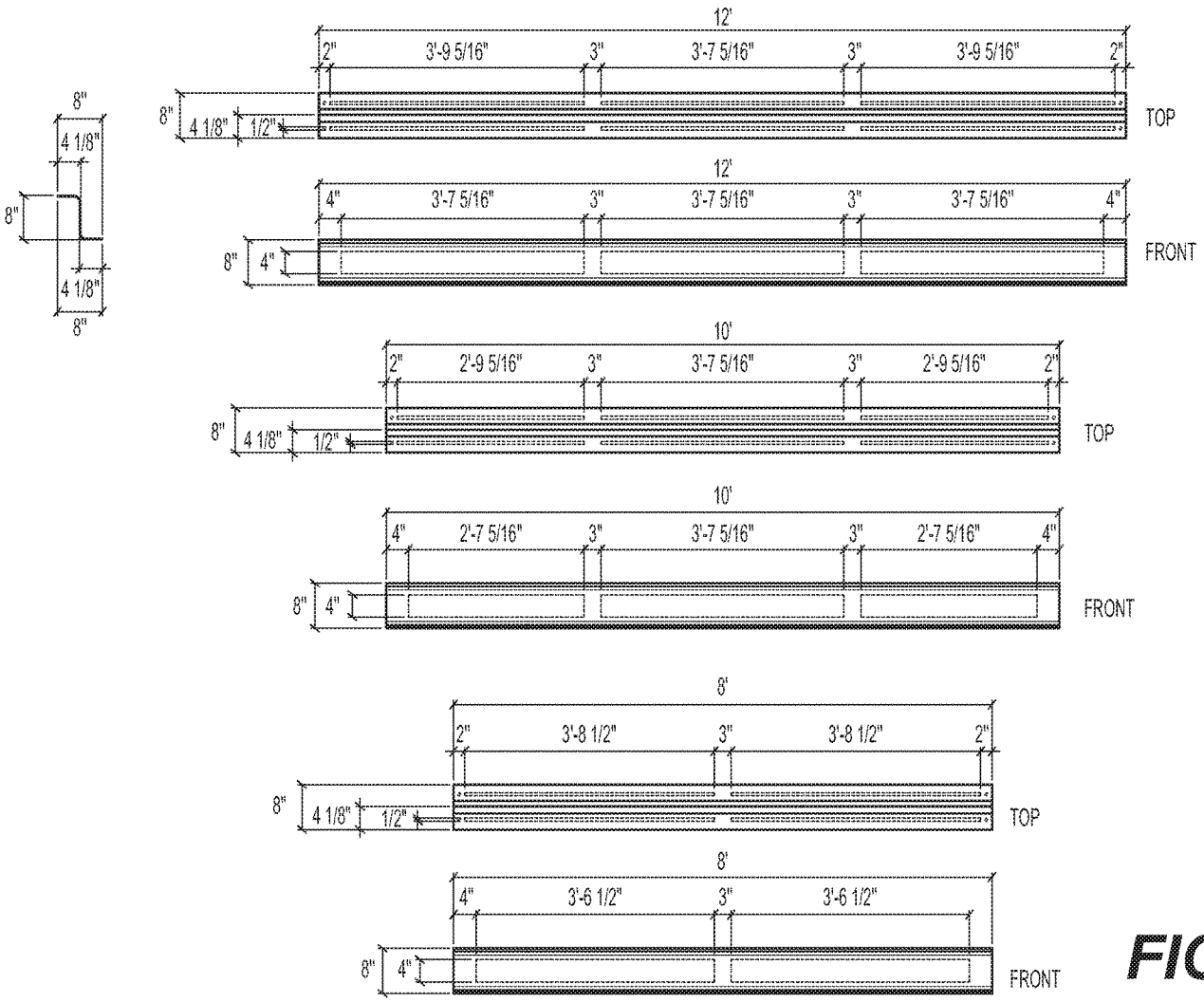
FIG. 109 illustrates example dimensions of an example formed beam of the post and beam system.

FIG. 109 illustrates example dimensions of embodiments of formed beams of the post and beam system. As shown, the formed beams may have a length ranging from about 8 feet to about 12 feet. However, in other examples, the beams can be constructed from at least two (2) feet to about fourteen (14) feet.

Figure 110:
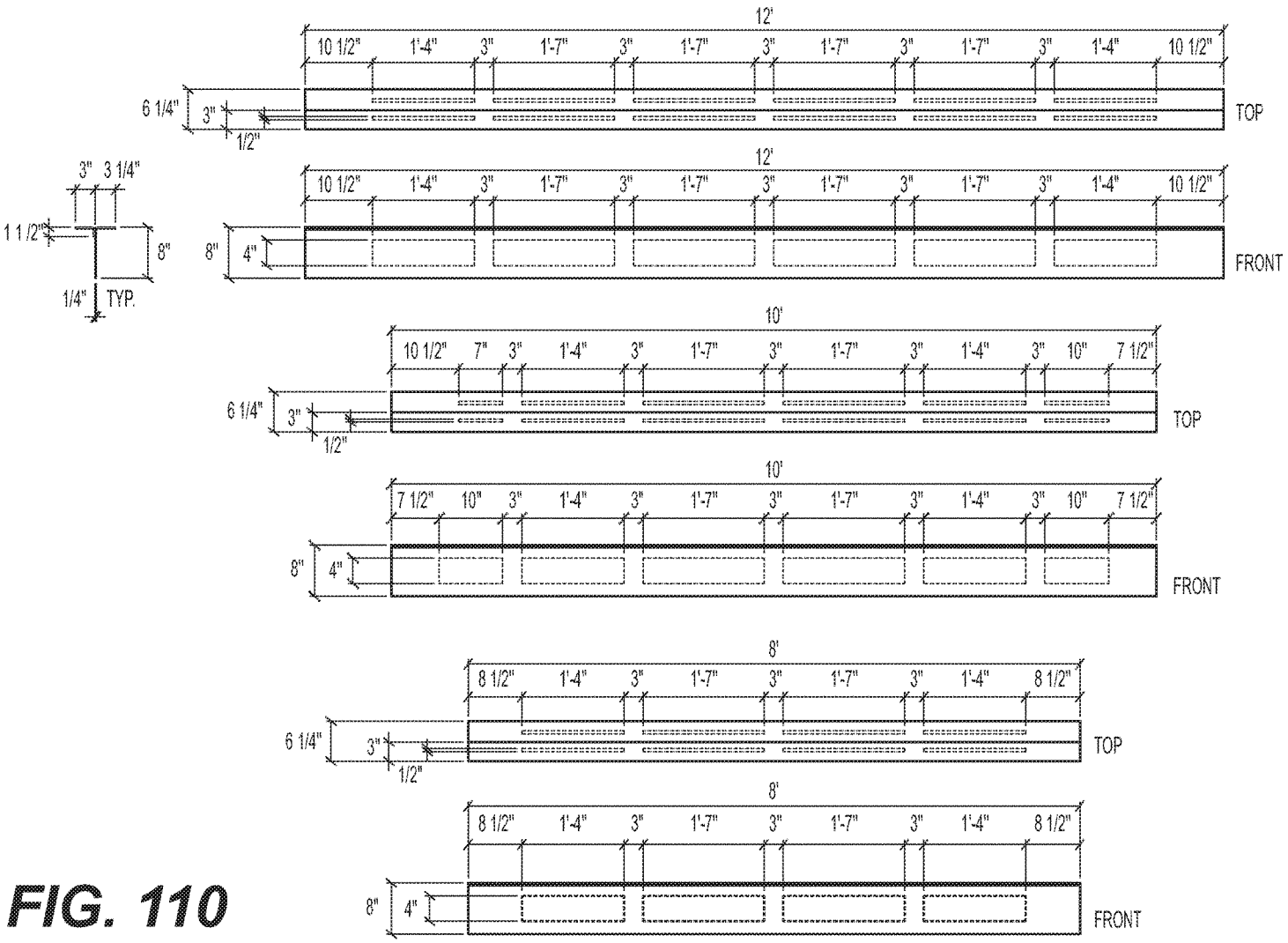
FIG. 110 illustrates example dimensions of an example formed cross beam of the post and beam system.

FIG. 110 illustrates example dimensions of embodiments of formed horizontal or cross beams of the post and beam system. As shown, the formed cross beams may have a length ranging from about 8 feet to about 12 feet. However, in other examples, the beams can be constructed from at least two (2) feet to about fourteen (14) feet.

Figure 111:
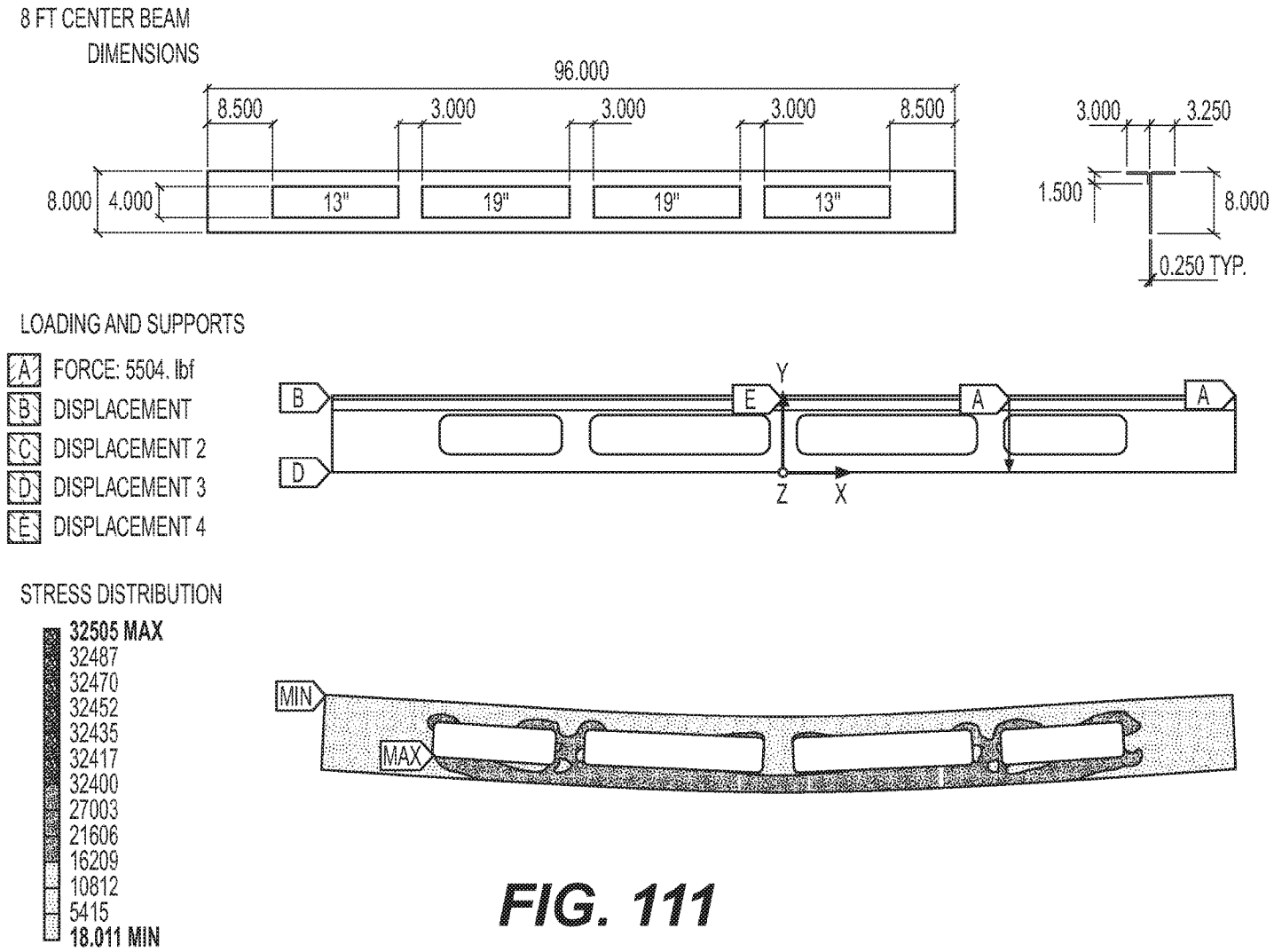
FIGS. 111-113 illustrate example stress distributions of embodiments of formed cross beams of the post and beam system.
Figure 112:
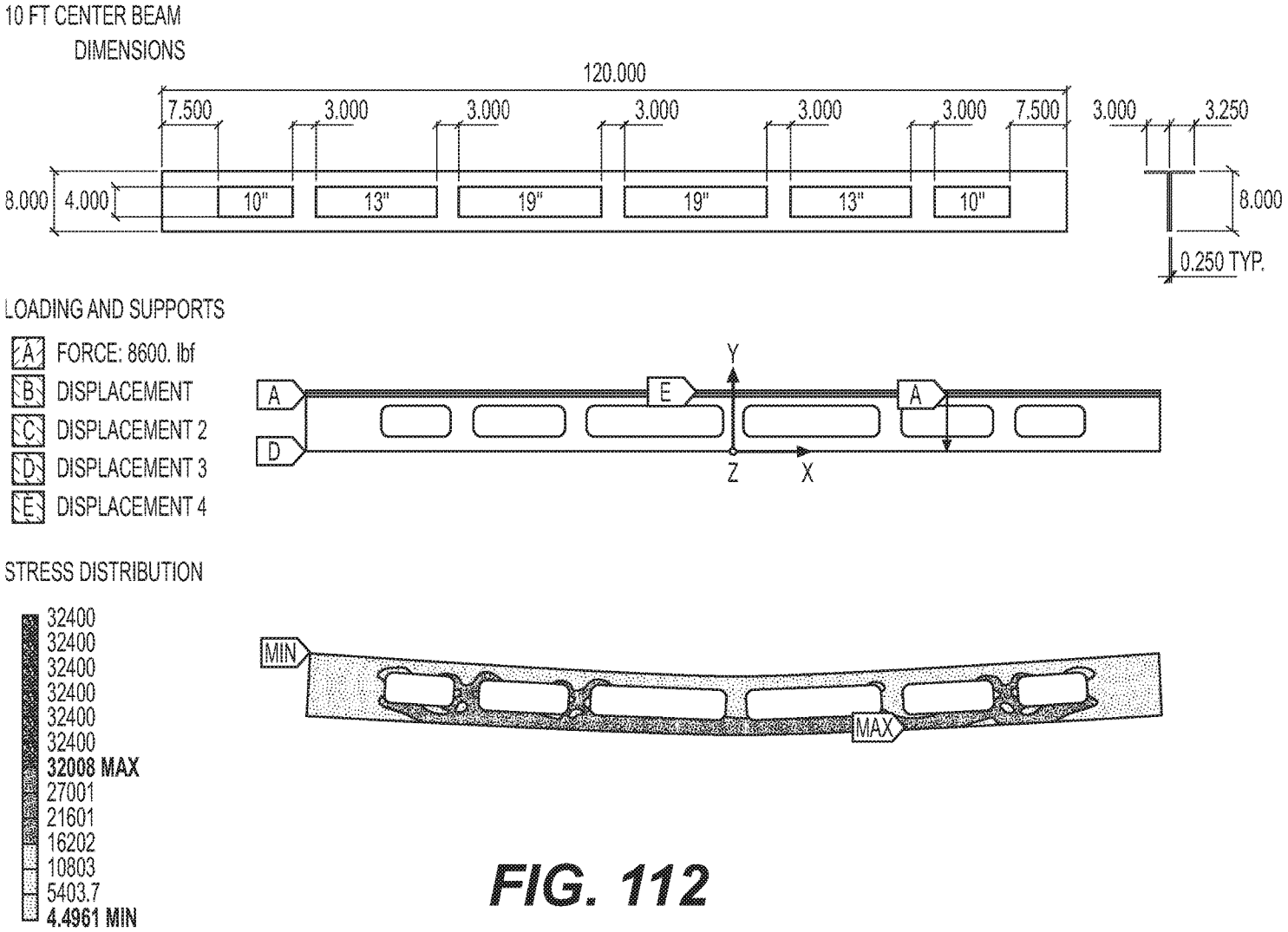
Figure 113:
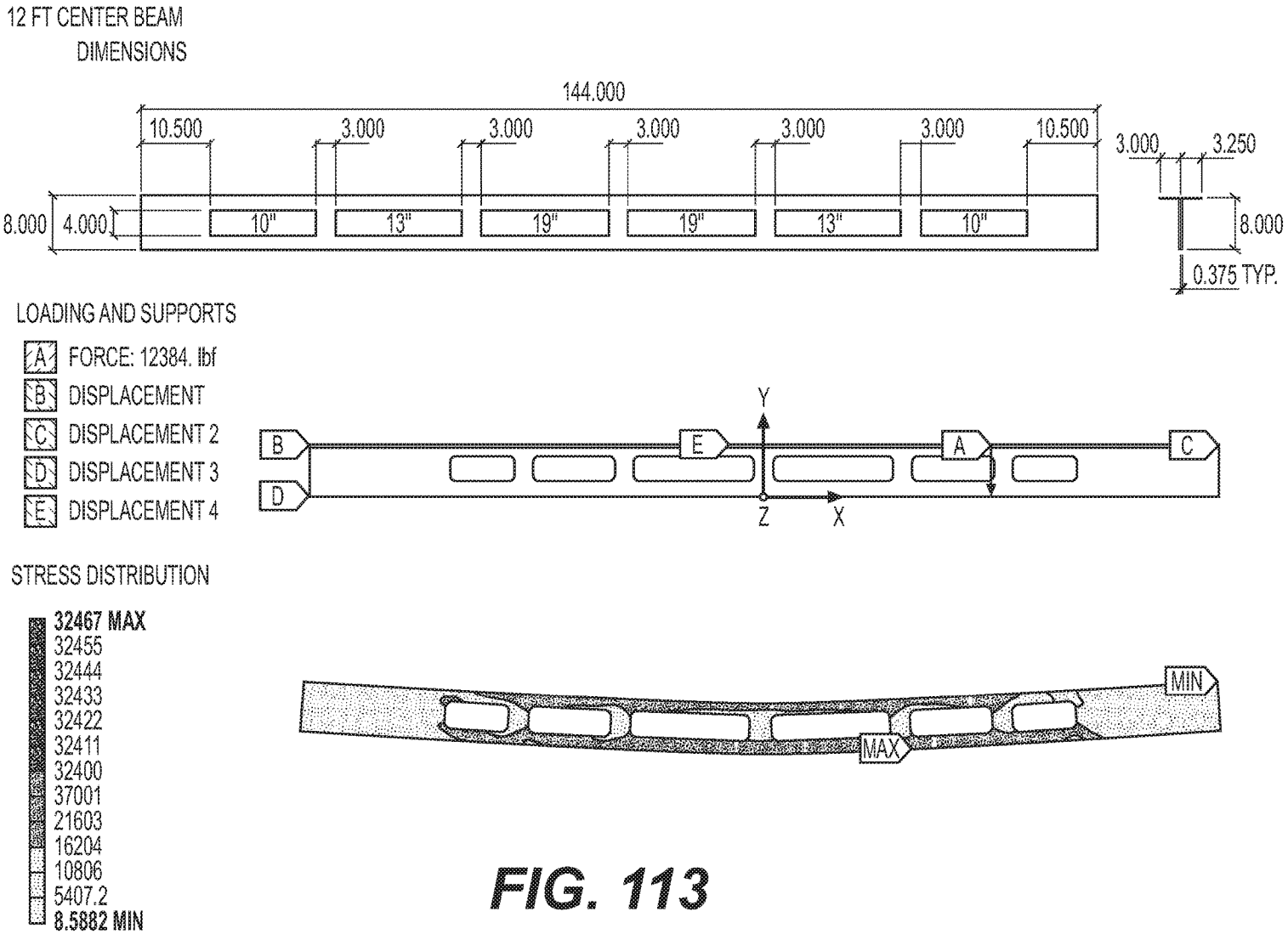

FIGS. 111-113 illustrate example stress distributions of embodiments of formed cross beams of the post and beam system. FIG. 111 illustrates a force "A" of about 5504 lbf applied on a formed cross beam having a length of about 8 feet. As shown, the max stress distribution on the formed cross beam ranges from about 18 to about 32000.

FIG. 112 illustrates a force "A" of about 8600 lbf applied on a formed cross beam having a length of about 10 feet. As shown, the max stress distribution on the formed cross beam ranges from about 4 to about 32000.

FIG. 113 illustrates a force "A" of about 12384 lbf applied on a formed cross beam having a length of about 12 feet. As shown, the max stress distribution on the formed cross beam ranges from about 8 to about 32000.

Figure 114:
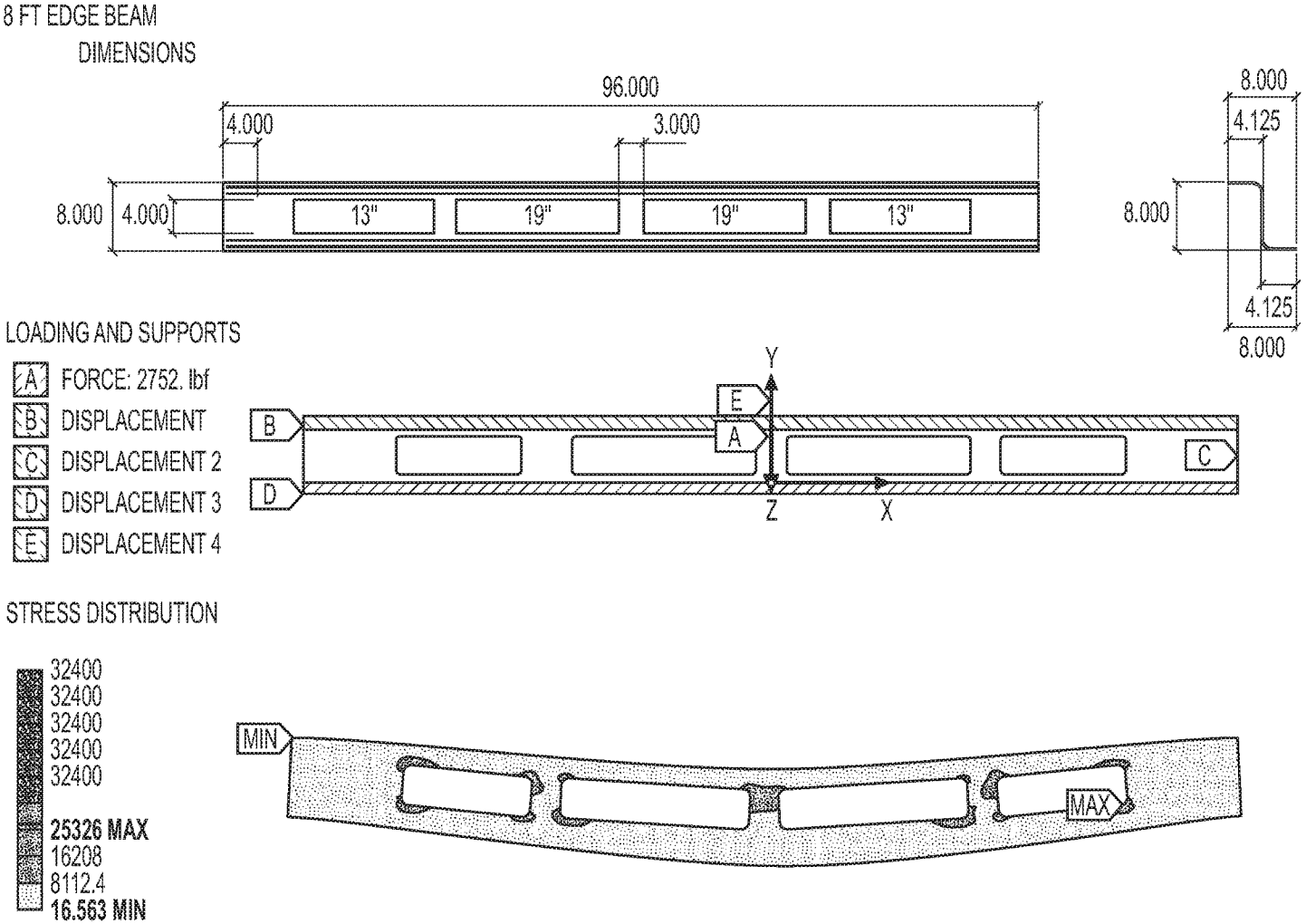
FIGS. 114-116 illustrate example stress distributions of embodiments of formed beams of the post and beam system.

FIG. 114 illustrate example stress distributions of embodiments of formed beams of the post and beam system. FIG. 114 illustrates a force "A" of about 2752 lbf applied on a formed beam having a length of about 8 feet. As shown, the max stress distribution on the formed beam ranges from about 16 to about 25000.

Figure 115:
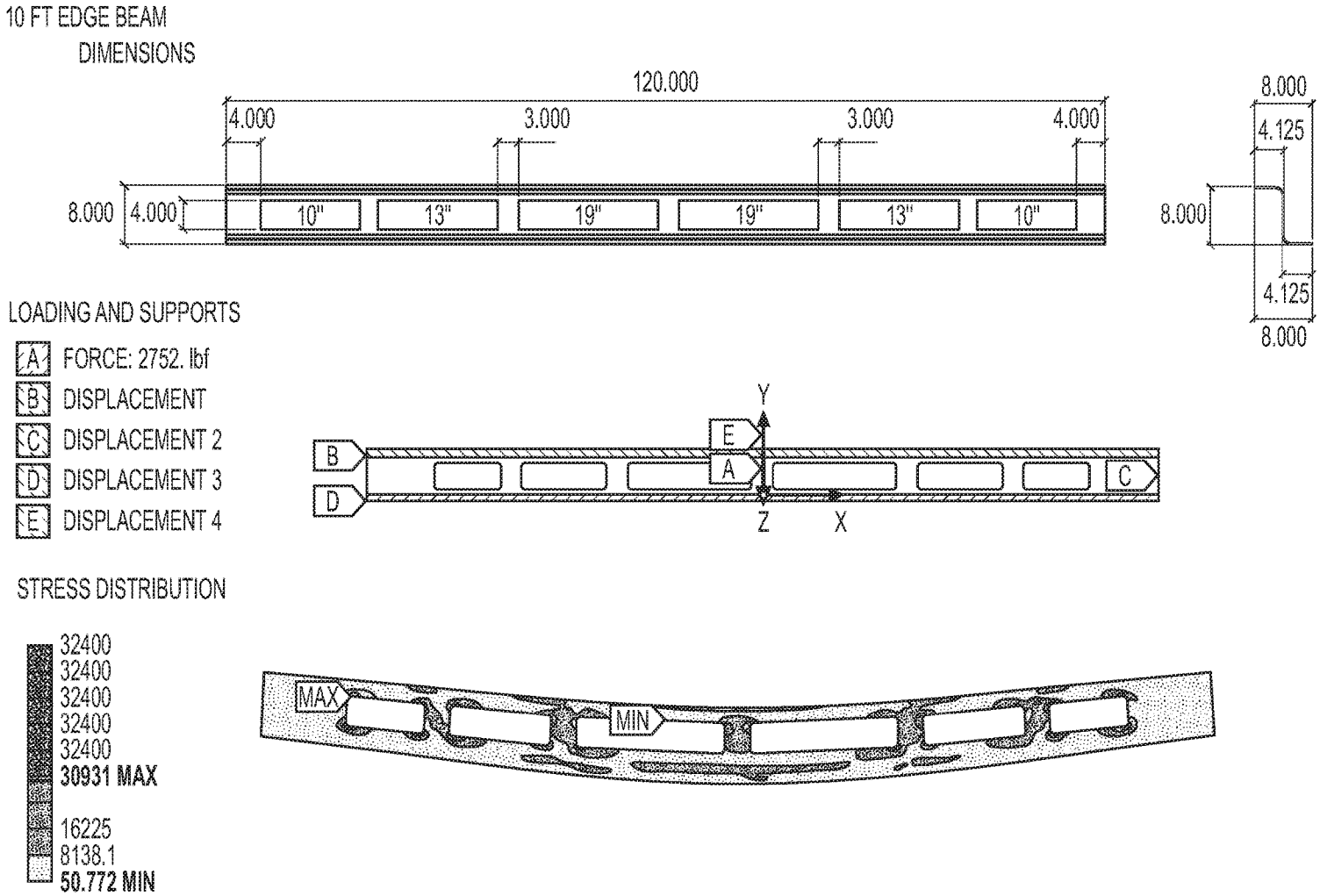

FIG. 115 illustrates a force "A" of about 4300 lbf applied on a formed beam having a length of about 10 feet. As shown, the max stress distribution on the formed beam ranges from about 51 to about 31000.

Figure 116:
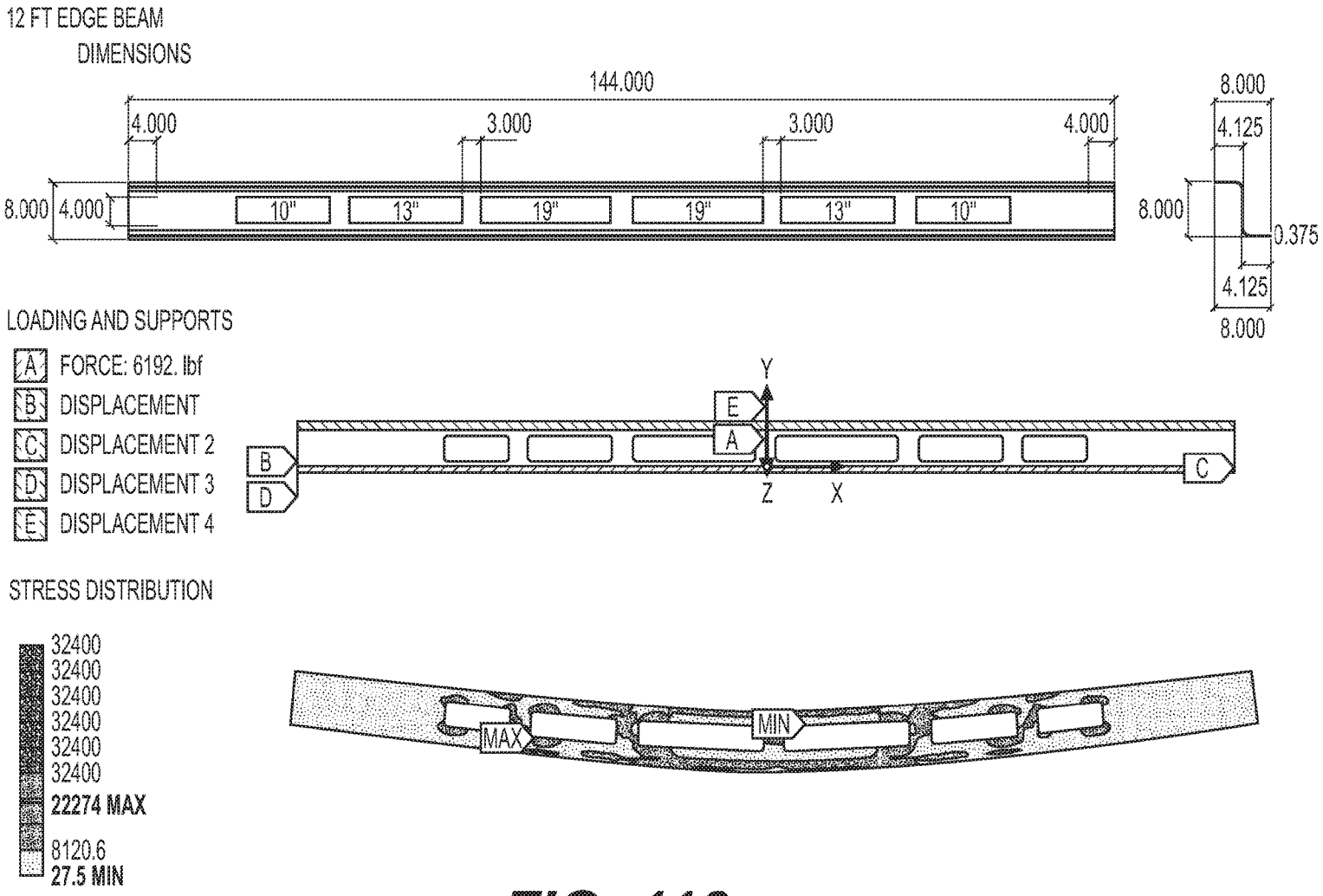

FIG. 116 illustrates a force "A" of about 6192 lbf applied on a formed beam having a length of about 12 feet. As shown, the max stress distribution on the formed beam ranges from about 27 to about 22000.

Figure 117:
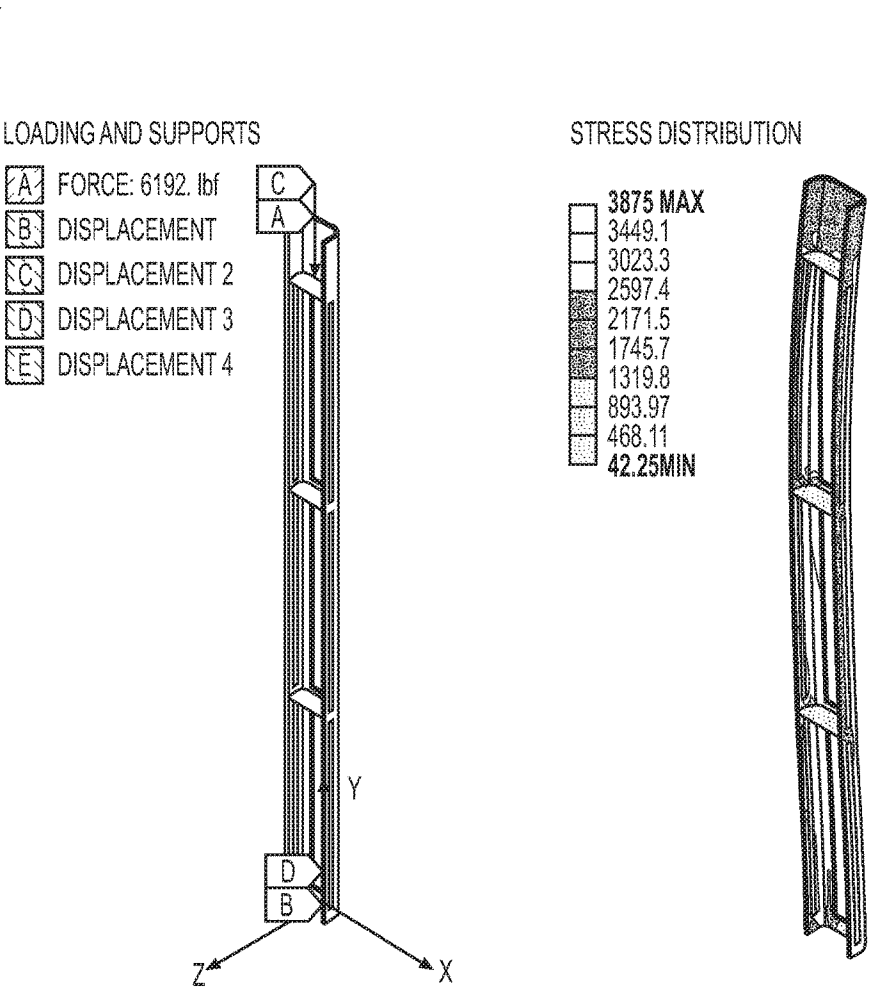
FIG. 117 illustrates an example axial loading of an embodiment of a formed inline post of the post and beam system.

FIG. 117 illustrates an example axial loading of an embodiment of a formed inline post of the post and beam system. FIG. 117 illustrates a force "A" of about 6192 lbf applied on a formed inline post having a vertical height of about 10 feet. As shown, the max stress distribution on the formed inline post ranges from about 42 to 3900.

Figure 118:
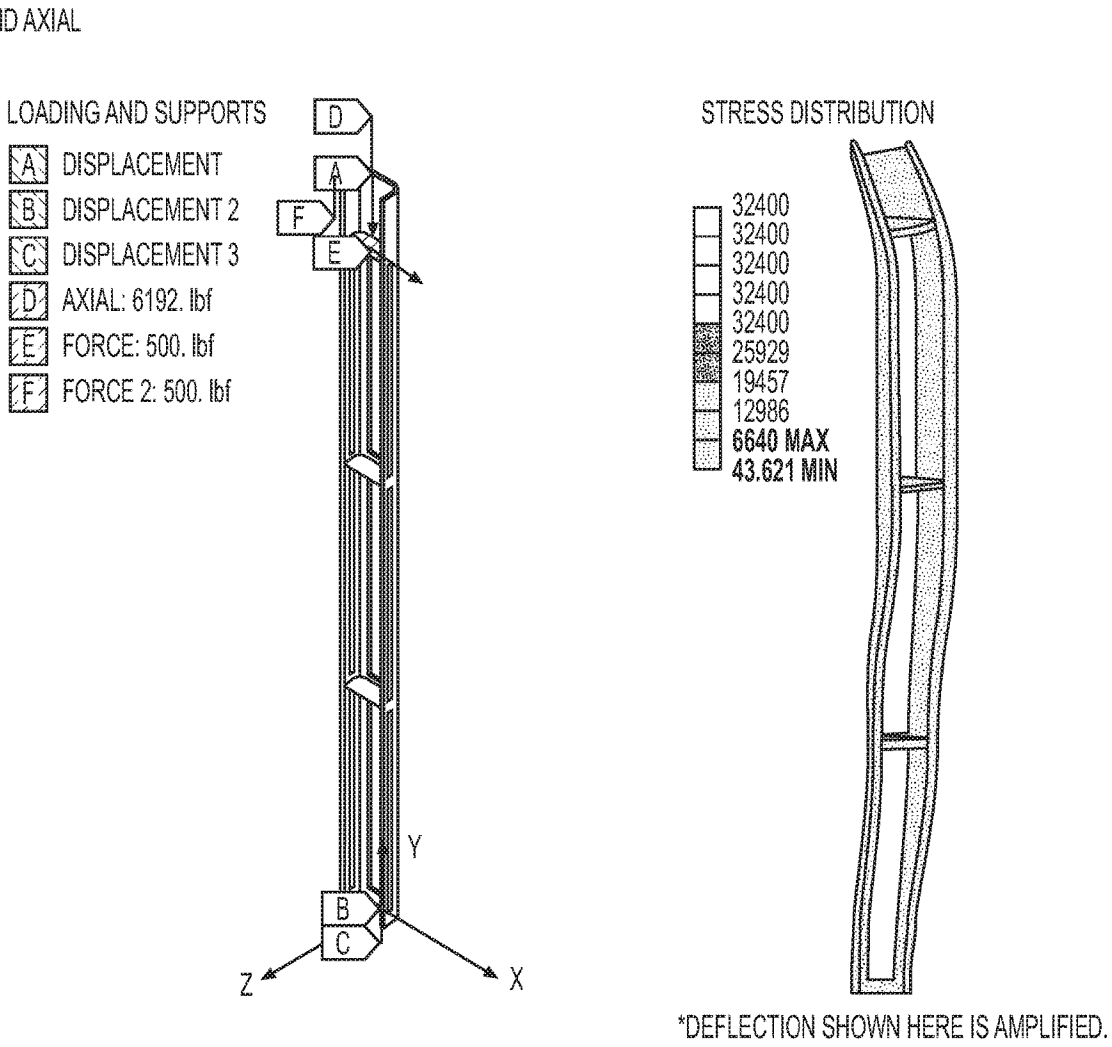
FIG. 118 illustrates an example lateral and axial loading of an embodiment of a formed inline post of the post and beam system.

FIG. 118 illustrates an example lateral and axial loading of an embodiment of a formed inline post of the post and beam system. FIG. 118 illustrates a force "E" of about 500 lbf and a force "F" of about 500 lbf applied on a formed inline post having a vertical height of about 10 feet. As shown, the max stress distribution on the formed inline post ranges from about 43 to 6600.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. For example, the methodological acts need not be performed in the order or combinations described herein, and may be performed in any combination of one or more acts.

What is claimed is:

1. A framing system for constructing at least a portion of a building, the framing system comprising:

a first beam extending a first longitudinal length, the first beam including:

a first flange extending the first longitudinal length, the first flange including a first slot extending at least a portion of the first longitudinal length and a second slot extending at least a portion of the first longitudinal length, a second flange extending the first longitudinal length, the second flange including a third slot extending at least a portion of the first longitudinal length and a fourth slot extending at least a portion of the first longitudinal length, a first wall extending the first longitudinal length and arranged between the first flange and the second flange, the first wall including a first open area extending at least a portion of the first longitudinal length and a second open area extending at least a portion of the first longitudinal length, and wherein the first flange, the second flange, and the first wall are attached and have a substantially S-shaped cross-section extending the first longitudinal length;

a second beam extending a second longitudinal length and connectable to the first beam, the second beam including:

a third flange extending the second longitudinal length, the third flange including a fifth slot extending at least a portion of the second longitudinal length and a sixth slot extending at least a portion of the second longitudinal length, a fourth flange extending the second longitudinal length, the fourth flange including a seventh slot extending at least a portion of the second longitudinal length and an eighth slot extending at least a portion of the second longitudinal length, a second wall extending the second longitudinal length and arranged between the third flange and the fourth flange, the second wall including a third open area extending at least a portion of the second longitudinal length and a fourth open area extending at least a portion of the second longitudinal length, and wherein the third flange, the fourth flange, and the second wall are attached and have a substantially S-shaped cross-section extending the second longitudinal length; and a corner post extending a longitudinal length and perpendicularly connectable to at least a portion of the first beam or to at least a portion of the second beam, the corner post including:

a first wall extending the longitudinal length, the first wall including a first open area extending at least a portion of the longitudinal length, a second open area extending at least a portion of the longitudinal length, and a third open area extending at least a portion of the longitudinal length, a first flange extending the longitudinal length and attached to the first wall, the first flange including a first slot extending at least a portion of the longitudinal length, a second slot extending at least a portion of the longitudinal length, and a third slot extending at least a portion of the longitudinal length, a second wall extending the longitudinal length and attached perpendicularly to the first wall, the second wall including a fourth open area extending at least a portion of the longitudinal length, a fifth open area extending at least a portion of the longitudinal length, and a sixth open area extending at least a portion of the longitudinal length, a second flange extending the longitudinal length and attached to the second wall, the second flange including a fourth slot extending at least a portion of the longitudinal length, a fifth slot extending at least a portion of the longitudinal length, and a sixth slot extending at least a portion of the longitudinal length, and wherein the first flange attached to the first wall, the second wall attached to the first wall, and the second flange attached to the second wall have a substantially A-shaped cross-section extending the longitudinal length.

2. The framing system of claim 1, further comprising a decorative pattern integrally formed in the first open area of the first wall of the first beam or in the second open area of the first wall of the first beam, or a decorative pattern integrally formed in the third open area of the second wall of the second beam or in the fourth open area of the second wall of the second beam.

3. The framing system of claim 1, further comprising a decorative pattern integrally formed in the first open area of the first wall of the corner post, integrally formed in the second open area of the first wall of the corner post, or integrally formed in the third open area of the first wall of the corner post, or a decorative pattern integrally formed in the fourth open area of the second wall of the corner post, integrally formed in the fifth open area of the second wall of the corner post, or integrally formed in the sixth open area of the second wall of the corner post.

4. The framing system of claim 1, further comprising a panel having a first edge and a second edge, the first edge attached to at least a portion of the first beam or attached to at least a portion of the second beam, and the second edge attached to at least a portion of the corner post.

5. The framing system of claim 4, further comprising a decorative pattern integrally formed in the panel.

6. The framing system of claim 1, further comprising:

an inline post extending a longitudinal length and perpendicularly connectable to at least a portion of the first beam or perpendicularly connectable to at least a portion of the second beam, the inline post including:

a first flange extending the longitudinal length, the first flange including a first slot extending at least a portion of the longitudinal length, a second slot extending at least a portion of the longitudinal length, and a third slot extending at least a portion of the longitudinal length, a second flange extending the longitudinal length, the second flange including a fourth slot extending at least a portion of the longitudinal length, a fifth slot extending at least a portion of the longitudinal length, and a sixth slot extending at least a portion of the longitudinal length, a wall extending the longitudinal length and arranged between the first flange and the second flange, the wall including a first open area extending at least a portion of the longitudinal length, a second open area extending at least a portion of the longitudinal length, and a third open area extending at least a portion of the longitudinal length, and wherein the first flange, the second flange, and the wall are attached and have a substantially C-shaped cross-section extending the longitudinal length.

7. The framing system of claim 6, further comprising a cross beam extending a longitudinal length and connectable to at least a portion of the inline post, the cross beam including:

a flange extending the longitudinal length, the flange including a first slot extending at least a portion of the longitudinal length and a second slot extending at least a portion of the longitudinal length, a wall extending the longitudinal length, the wall including a first open area extending at least a portion of the longitudinal length and a second open area extending at least a portion of the longitudinal length, and wherein the flange and the wall are attached and have a substantially T-shaped cross-section extending the longitudinal length.

8. The framing system of claim 7, further comprising a decorative pattern integrally formed in the first open area of the wall of the cross beam or integrally formed in the second open area of the wall of the cross beam.

9. The framing system of claim 6, further comprising a decorative pattern integrally formed in the first open area of the wall of the inline post, integrally formed in the second open area of the wall of the inline post, or integrally formed in the third open area of the wall of the inline post.

10. The framing system of claim 6, further comprising a panel having a first edge and a second edge, the first edge attached to at least a portion of the first beam or attached to at least a portion of the second beam and the second edge attached to at least a portion of the inline post.

11. The framing system of claim 10, further comprising a decorative pattern integrally formed in the panel.

12. The framing system of claim 10, further comprising a panel connectable to at least a portion of the beam.

13. A framing system for constructing at least a portion of a building, the framing system comprising:

a beam extending a horizontal length, the beam including:

a first flange extending the horizontal length, the first flange including a first slot extending at least a portion of the horizontal length and a second slot extending at least a portion of the horizontal length, a second flange extending the horizontal length, the second flange including a third slot extending at least a portion of the horizontal length and a fourth slot extending at least a portion of the horizontal length, a wall extending the horizontal length and arranged between the first flange and the second flange, the wall including a first open area extending at least a portion of the horizontal length and a second open area extending at least a portion of the horizontal length, wherein the first flange, the second flange, and the wall are attached and have a substantially S-shaped cross-section extending the horizontal length; and a corner post extending a vertical length and perpendicularly connectable to at least a portion of the beam, the corner post including:

a first wall extending the vertical length, the first wall including a third open area extending at least a portion of the vertical length, a fourth open area extending at least a portion of the vertical length, and a fifth open area extending at least a portion of the vertical length, a first flange extending the vertical length and attached to the first wall, the first flange including a fifth slot extending at least a portion of the vertical length, a sixth slot extending at least a portion of the vertical length, and a seventh slot extending at least a portion of the vertical length, a second wall extending the vertical length and attached perpendicularly to the first wall, the second wall including a sixth open area extending at least a portion of the vertical length, a seventh open area extending at least a portion of the vertical length, and an eighth open area extending at least a portion of the vertical length, a second flange extending the vertical length and attached to the second wall, the second flange including an eighth slot extending at least a portion of the vertical length, a ninth slot extending at least a portion of the vertical length, and a tenth slot extending at least a portion of the vertical length, wherein the first flange attached to the first wall, the second wall attached to the first wall, and the second flange attached to the second wall have a substantially A-shaped cross-section extending the longitudinal length.

14. The framing system of claim 13, wherein the horizontal length of the beam is about eight (8) feet, ten (10) feet, or twelve (12) feet long.

15. The framing system of claim 13, wherein the vertical length of the corner post is about eight (8) feet, ten (10) feet, or twelve (12) feet long.

* * * * *